US011471005B2

(12) United States Patent
Ciavarella et al.

(10) Patent No.: US 11,471,005 B2
(45) **Date of Patent: *Oct. 18, 2022**

(54) FLUID DISPENSER AND FLUID REFILL SYSTEM FOR FLUID DISPENSER

(71) Applicant: GOJO Industries, Inc., Akron, OH (US)

(72) Inventors: Nick E. Ciavarella, Seven Hills, OH (US); Scott T. Proper, Stow, OH (US); Chin P. Richards, Tallmadge, OH (US); Eric M. Chalko, Alpharetta, GA (US); Aaron D. Marshall, Silver Lake, OH (US); Scott E. Urban, University Heights, OH (US); Christopher S. Welsh, North Royalton, OH (US); Paul R. Metcalfe, Solon, OH (US)

(73) Assignee: GOJO Industries, Inc., Akron, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/468,751

(22) Filed: Sep. 8, 2021

(65) Prior Publication Data

US 2021/0401238 A1 Dec. 30, 2021

Related U.S. Application Data

(60) Continuation of application No. 16/928,066, filed on Jul. 14, 2020, now Pat. No. 11,122,939, which is a continuation of application No. 16/027,507, filed on Jul. 5, 2018, now Pat. No. 10,716,436, which is a division of application No. 14/638,918, filed on Mar. 4, 2015, now Pat. No. 10,034,584.

(60) Provisional application No. 61/974,591, filed on Apr. 3, 2014, provisional application No. 61/947,609, filed on Mar. 4, 2014.

(51) Int. Cl.
*A47K 5/12* (2006.01)

(52) U.S. Cl.
CPC .... *A47K 5/1204* (2013.01); *A47K 2005/1218* (2013.01)

(58) Field of Classification Search
CPC ..... A47K 5/1204; A47K 2005/1218
USPC ..... 4/628; 141/290, 319, 346, 347, 363, 364
See application file for complete search history.

(56) References Cited

U.S. PATENT DOCUMENTS

| | | | |
|---|---|---|---|
| 3,581,998 | A | 6/1971 | Roche |
| 3,963,063 | A | 6/1976 | Pascarella |
| 4,090,525 | A | 5/1978 | Potter |
| 4,173,858 | A | 11/1979 | Cassia |
| 4,313,477 | A | 2/1982 | Sebalos |
| 4,322,019 | A | 3/1982 | Smith |
| 4,615,362 | A | 10/1986 | Hartman et al. |
| 4,682,734 | A | 7/1987 | Proctor et al. |
| 4,807,675 | A | 2/1989 | Sharp |

(Continued)

FOREIGN PATENT DOCUMENTS

| | | | |
|---|---|---|---|
| DE | 29707536 | U1 | 10/1998 |
| DE | 19948462 | A1 | 9/2000 |

*Primary Examiner* — Timothy L Maust
(74) *Attorney, Agent, or Firm* — Calfee, Halter & Griswold LLP

(57) ABSTRACT

A fluid dispenser includes a dispensation conduit and a refill conduit. A refill system includes a refill reservoir and a refill distribution conduit. The refill distribution conduit is configured for selective fluid coupling with the refill conduit to facilitate refilling of the fluid dispenser.

20 Claims, 46 Drawing Sheets

(56) References Cited

U.S. PATENT DOCUMENTS 5,018,558 A 5/1991 Sharp
5,088,530 A 2/1992 Harp
5,226,566 A 7/1993 Brandenburg
5,390,713 A 2/1995 Fiech
5,392,827 A 2/1995 Yasso et al.
5,474,112 A * 12/1995 Carola ..... A61M 16/183 141/366
5,540,362 A 7/1996 Azuma et al.
5,586,586 A 12/1996 Fiech
5,632,414 A 5/1997 Merriweather
5,829,681 A 11/1998 Hamel et al.
6,000,626 A 12/1999 Futo et al.
6,142,342 A 11/2000 Lewis
6,345,738 B1 2/2002 Brozell et al.
6,371,386 B1 4/2002 Hoy
6,467,651 B1 10/2002 Muderlak et al.
6,651,851 B2 11/2003 Muderlak et al.
6,749,135 B2 6/2004 Groblebe et al.
6,929,150 B2 8/2005 Muderlak et al.
7,228,874 B2 6/2007 Bolderheij et al.
7,364,053 B2 4/2008 Ophardt
7,455,197 B2 11/2008 Ophardt
7,527,174 B2 5/2009 Meehan et al.
7,533,787 B2 5/2009 Muderlak et al.
7,611,317 B2 11/2009 Muderlak et al.
7,647,653 B1 1/2010 Catania
7,753,087 B2 7/2010 Rhodenbaugh et al.
7,798,370 B2 9/2010 Ciavarella et al.
7,815,074 B2 10/2010 Ciavarella et al.
7,950,548 B2 5/2011 Ciavarella et al.
8,051,507 B2 11/2011 Lin
8,100,299 B2 1/2012 Phelps et al.
8,251,110 B2 8/2012 Bassett et al.
8,256,472 B2 9/2012 De Vries et al.
8,261,950 B2 9/2012 Cittadino et al.
8,371,474 B2 2/2013 Tramontina et al.
8,579,157 B2 11/2013 Bem et al.
8,800,815 B1 8/2014 Butler et al.
8,863,992 B2 10/2014 Wing et al.
8,893,928 B2 11/2014 Proper
8,950,628 B2 2/2015 Muderlak et al.
9,437,103 B2 9/2016 Ophardt
9,681,779 B2 6/2017 Babikian et al.
9,681,780 B2 6/2017 Ciavarella et al.
9,913,562 B2 3/2018 Wegelin et al.
10,034,584 B2 7/2018 Ciavarella et al.
10,189,698 B2 1/2019 Proper et al.
10,358,335 B2 7/2019 Proper et al.
10,716,436 B2 7/2020 Ciavarella et al.
11,122,939 B2 * 9/2021 Ciavarella ..... A47K 5/1204
2002/0185500 A1 12/2002 Muderlak et al.
2004/0050876 A1 3/2004 Muderlak et al.
2005/0205612 A1 9/2005 Muderlak et al.
2005/0218161 A1 10/2005 Muderlak et al.
2006/0011655 A1 1/2006 Ophardt
2007/0084521 A1 4/2007 Rhodenbaugh et al.
2007/0204925 A1 9/2007 Bolderheij et al.
2008/0185399 A1 8/2008 Yang et al.
2009/0084813 A1 4/2009 Chen
2009/0101671 A1 4/2009 Cittadino et al.
2011/0127291 A1 6/2011 Tramontina et al.
2011/0131714 A1 6/2011 Remijn et al.
2011/0215115 A1 9/2011 Proper
2012/0048420 A1 3/2012 Martin
2013/0075420 A1 3/2013 Tramontina et al.
2014/0124540 A1 5/2014 Ciavarella et al.
2014/0253336 A1 9/2014 Ophardt
2014/0263421 A1 * 9/2014 Urban ..... A47K 5/1217 222/173
2014/0263427 A1 9/2014 Muderlak et al.
2014/0263430 A1 9/2014 Keating et al.
2015/0083748 A1 3/2015 Mchale et al.
2015/0223646 A1 8/2015 Wegelin et al.
2015/0230668 A1 8/2015 Shakkour et al.
2016/0184851 A1 6/2016 Mcnulty et al.
2016/0316975 A1 11/2016 Ophardt
2017/0112329 A1 4/2017 Babikian
2017/0190565 A1 7/2017 Proper et al.
2018/0078958 A1 3/2018 Ophardt et al.

* cited by examiner

FLUID DISPENSER AND FLUID REFILL SYSTEM FOR FLUID DISPENSER

RELATED APPLICATIONS

This application is a continuation of U.S. patent application Ser. No. 16/928,066 which was filed on Jul. 14, 2020 and will issue as U.S. Pat. No. 11,122,939 on Sep. 21, 2021, which was a continuation of U.S. patent application Ser. No. 16/027,507 which was filed on Jul. 5, 2018 and issued as U.S. Pat. No. 10,716,436 on Jul. 21, 2020, which was a divisional application of U.S. patent application Ser. No. 14/638,918, titled Fluid Dispenser and Fluid Refill System for Fluid Dispenser, which was filed on Mar. 4, 2015 and issued on Jul. 31, 2018 as U.S. Pat. No. 10,034,584. Each of which are incorporated herein by reference in their entirety. Each of which claim priority to U.S. Provisional Application Ser. No. 61/974,591, titled Fluid Dispenser and Fluid Refill System for Fluid Dispenser, filed on Apr. 3, 2014, and U.S. Provisional Application Ser. No. 61/947,609 titled Fluid Dispenser Having a Refill Port, filed on Mar. 4, 2014; both of which are incorporated by reference in their entirety.

TECHNICAL FIELD

A fluid dispensing system comprises a fluid dispenser and a fluid reservoir in fluid communication with the fluid dispenser. The fluid dispenser includes a refill port for refilling the fluid reservoir.

BACKGROUND

A fluid dispensing system includes a fluid dispenser, such as a soap dispensing fluid dispenser, that is mounted adjacent to a sink for dispensing soap to a user's hands. The fluid dispenser is in fluid communication with a reservoir that can be mounted below a countertop. Mounting the reservoir and other components below the countertop can be aesthetically pleasing and can deter tampering with the reservoir. However, refilling or replacing the reservoir from beneath the countertop can be cumbersome, difficult, and can allow soap to spill on the floor.

SUMMARY

According to one embodiment, a fluid dispenser comprises a housing, a dispensation conduit, a refill conduit, and an access member. The dispensation conduit is routed through the housing and is configured for dispensing fluid therethrough. The refill conduit comprises a refill port. The access member is coupled with the refill conduit. The access member is movable between a stored position and a refilling position. Movement of the access member from the stored position to the refilling position positions the refill port to facilitate refilling of a fluid reservoir through the refill port.

According to another embodiment, a fluid dispenser comprises a base, a housing, a dispensation conduit, and a refill conduit. The housing is movably coupled with the base and is movable between a stored position and a refilling position. The dispensation conduit is routed through the housing and is configured for dispensing of fluid therethrough. The refill conduit comprises a refill port. The refill port is coupled with the base. The refill port is concealed when the housing is in the stored position. Movement of the housing from the stored position to the refilling position exposes the refill port to facilitate refilling of a fluid reservoir through the refill port.

According to yet another embodiment, a fluid dispenser comprises a housing, a dispensation conduit, and a refill conduit. The housing comprises a front end and a rear end. The dispensation conduit is routed through the housing and is configured for dispensing fluid therethrough at the front end of the housing. The refill conduit comprises a refill port. The refill conduit is routed through the housing. The refill port defines an opening that is downwardly facing and is accessible at the rear end of the housing.

According to still yet another embodiment, a fluid dispenser comprises a housing, a dispensation conduit, a refill conduit, and an activator. The housing comprises a front end and a rear end. The dispensation conduit is routed through the housing and is configured for dispensation of fluid therethrough. The refill conduit comprises a refill port. The refill port comprises a refill valve and is configured to receive and retain a refill distribution conduit inserted therein to facilitate refilling of a storage reservoir with fluid. The activator, which when activated, facilitates dispensation of fluid from the dispensation conduit. The refill valve is biased closed.

According to still yet another embodiment, a fluid dispenser comprises a housing, a dispensation conduit, and a refill conduit. The housing comprises an upper surface and a lower exterior surface. The dispensation conduit is routed through at least a portion of the housing. The dispensation conduit is configured for dispensation of fluid therethrough and defines a dispensation zone at the front end of the housing. The refill conduit is routed through at least a portion of the housing. The refill conduit comprises a refill port for receiving a refill distribution conduit to facilitate refilling of a storage reservoir with fluid. The refill port defines an opening. The opening generally faces the dispensation zone.

According to still yet another embodiment, a system comprises a fluid dispensing system and a fluid refill system. The fluid dispensing system comprises a storage reservoir, a pump, and a fluid dispenser. The storage reservoir is for storing fluid to be dispensed. The pump is in fluid communication with the storage reservoir. The fluid dispenser comprises a dispensation conduit and a refill conduit. The dispensation conduit is fluidly coupled with the pump and is in fluid communication with the lower end of the storage reservoir. The dispensation conduit is configured for dispensation of fluid therethrough. The refill conduit is fluidly coupled with the storage reservoir and comprises a refill port. The refill port comprises a valve. The fluid refill system comprises a refill reservoir and a refill distribution conduit. The refill reservoir is for storing refill fluid. The refill reservoir comprises an upper end and a lower end. The storage reservoir comprises an upper end and a lower end. The refill distribution conduit is in fluid communication with the refill reservoir. The refill distribution conduit has a distal end that is selectively insertable into the refill port to facilitate filling of the storage reservoir with the refill fluid from the refill reservoir. Insertion of the distal end of the refill distribution conduit into the refill port opens the valve.

According to still yet another embodiment, a fluid dispenser comprises a housing, a storage reservoir, a dispensation conduit, a refill conduit, and a storage vent conduit. The housing comprises a front end and a rear end. The storage reservoir is coupled with the housing for storing fluid. The storage reservoir comprises an upper end and a lower end. The dispensation conduit is routed through the housing and comprises a first end and a second end. The first end is configured for dispensation of fluid therefrom. The second end is in fluid communication with the lower end of the storage reservoir. The refill conduit is in fluid communication with the storage reservoir. The storage vent conduit comprises a first end and a second end. The first end of the storage vent conduit is accessible to a fluid refill system. The second end of the storage vent conduit is in fluid communication with the upper end of the storage reservoir.

According to still yet another embodiment, a fluid refill system for dispensing refill fluid to a fluid dispenser is provided. The fluid refill system comprises a refill reservoir, a refill distribution conduit, and a refill vent conduit. The refill reservoir is for storing refill fluid. The refill reservoir comprises an upper end and a lower end. The refill distribution conduit comprises a first end and a second end. The second end is in fluid communication with the lower end of the refill reservoir. The refill vent conduit comprises a first end and a second end. The second end is in fluid communication with the upper end of the refill reservoir.

BRIEF DESCRIPTION OF THE DRAWINGS

It is believed that certain embodiments will be better understood from the following description taken in conjunction with the accompanying drawings in which.

DETAILED DESCRIPTION

Figure 1:
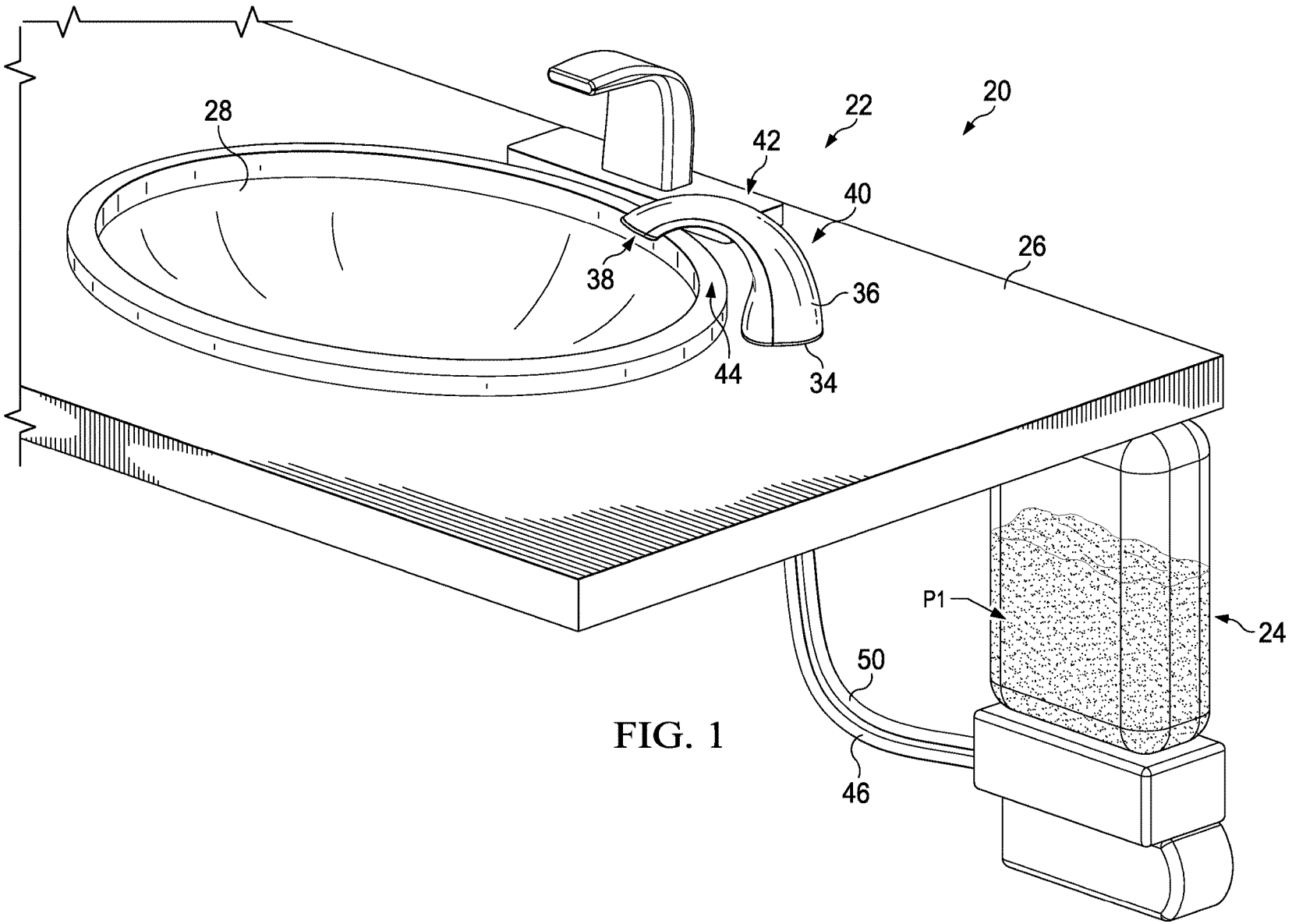
FIG. 1 is an environmental view depicting a fluid dispensing system that includes a fluid dispenser according to one embodiment, wherein the fluid dispensing system is in association with a sink and a countertop.
Figure 55:
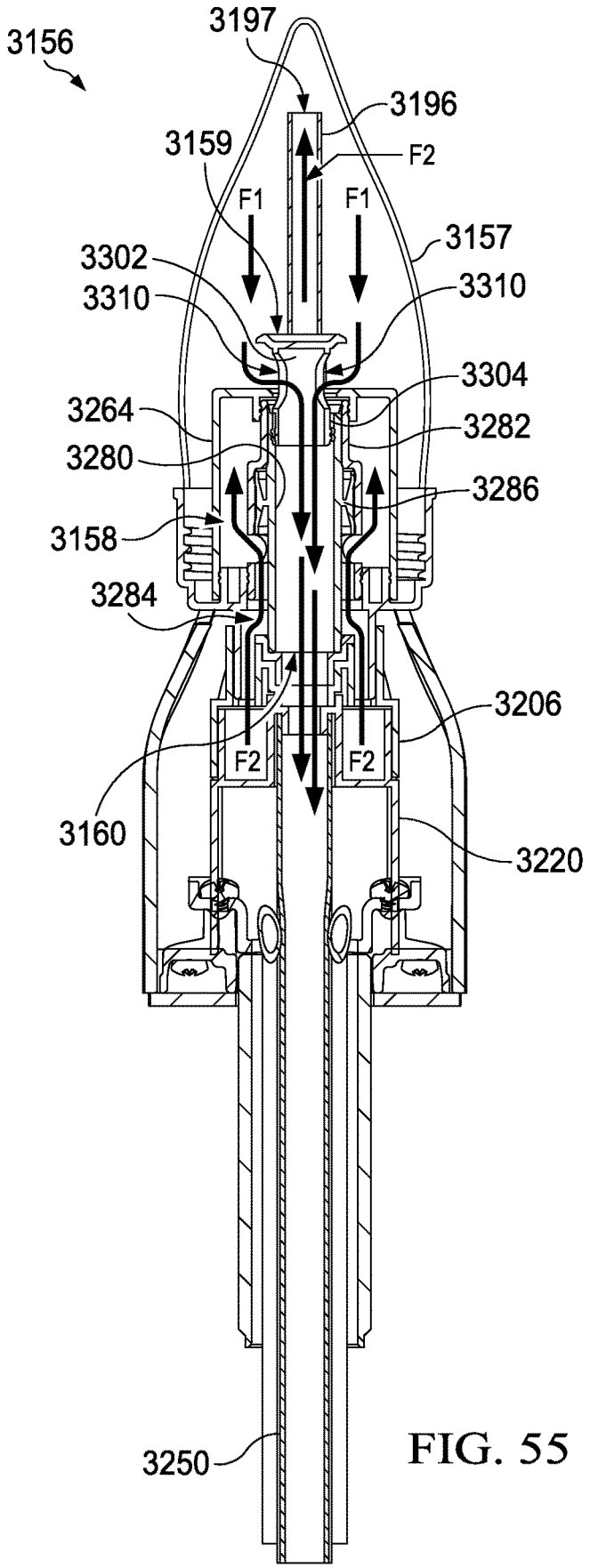
FIG. 55 is a sectional view taken along the section line 55-55 in FIG. 53.

Certain embodiments are described herein in connection with the views and examples of FIGS. 1-55 wherein like numbers indicate the same or corresponding elements throughout the views. FIG. 1 illustrates a fluid dispensing system 20 having a fluid dispenser 22 (e.g., a spout) that is in fluid communication with a reservoir 24. A product P1 can be contained within the reservoir 24 and can be selectively dispensed from the fluid dispenser 22 to a user's hands when positioned beneath the fluid dispenser 22. The product P1 can be a generally flowable material, such as, for example, soap, sanitizer or lotion and can be dispensed in liquid form, gel form, or foam form.

Figure 2:
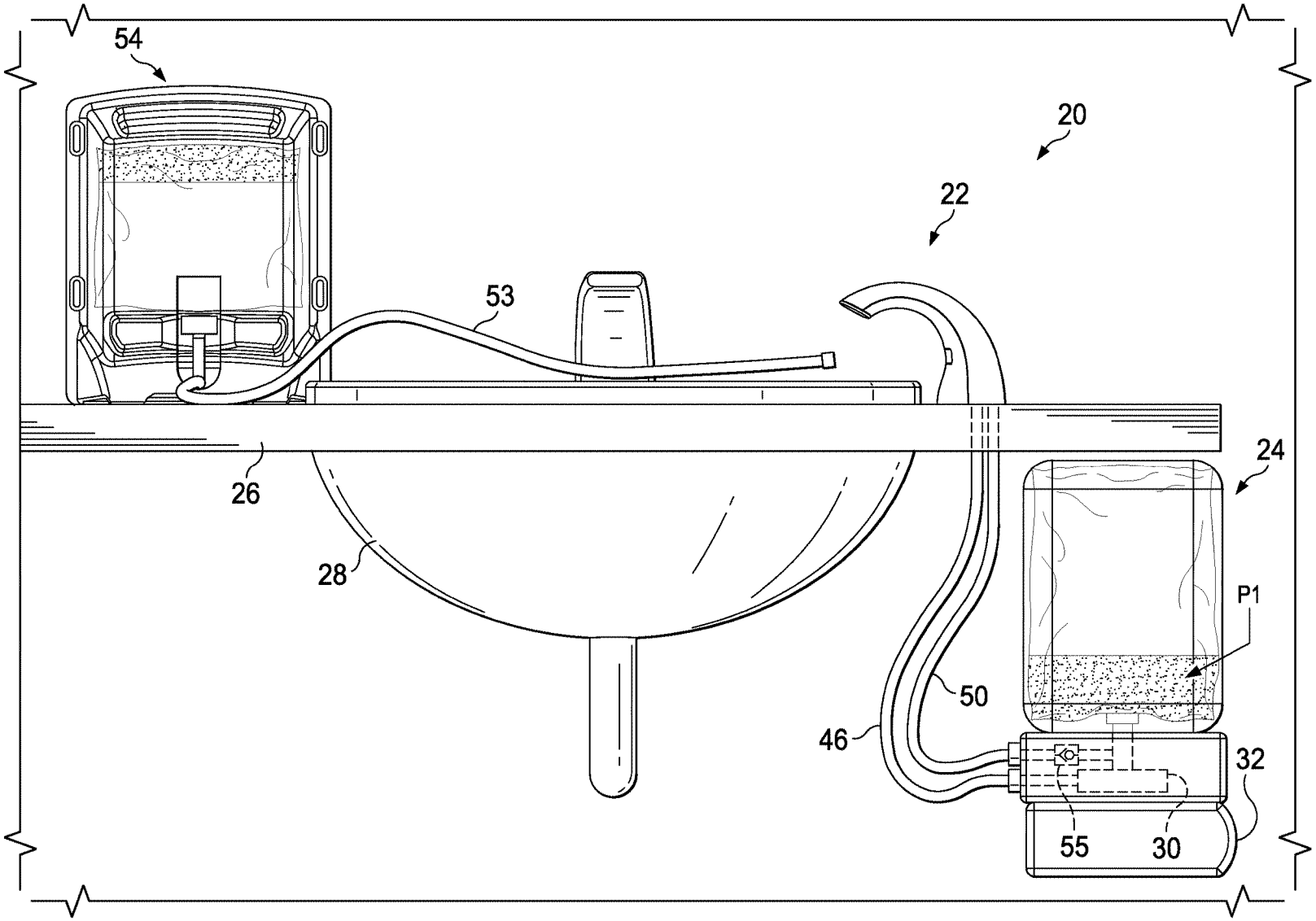
FIG. 2 is a front view depicting the fluid dispensing system of FIG. 1 in association with a refill cartridge.

As illustrated in FIGS. 1 and 2, the fluid dispenser 22 can be mounted above a countertop 26 and adjacent to a sink 28, and the reservoir 24 can be mounted below the countertop 26, such as, for example, to the countertop 26 or an adjacent wall. The reservoir 24 can accordingly be substantially obscured from view thereby contributing to the overall aesthetics of the fluid dispensing system 20. It is to be appreciated that the reservoir can be a bottle, a bag, or any of a variety of suitable other rigid or flexible containers.

The fluid dispensing system 20 can be provided for use in any number of suitable environments, such as a restroom or a kitchen. The location of a fluid dispensing system can depend on the type of fluid being dispensed. For example, a fluid dispensing system for dispensing hand sanitizer can be provided within a restroom but away from a sink or at an office workstation or cubicle. It is also to be appreciated that, although the reservoir 24 is shown as described as being located remotely from the fluid dispenser 22, that any of a variety of suitable alternative fluid dispenser systems can be provided for dispensing fluid to a user's hands, such as, for example, a wall mounted, fluid dispenser having a self-contained reservoir.

As illustrated in FIG. 2, a pump 30 and a motor 32 can be associated with the reservoir 24 and can cooperate to facilitate dispensation of the product P1 from the fluid dispenser 22. The pump 30 and motor 32 can be located together with the reservoir 24 such that the pump 30 and motor 32 are also obscured from view.

The fluid dispenser 22 can include a base 34 and a housing 36. The base 34 can be releasably attached to the countertop 26, and the housing 36 can be releasably attached to the base 34 to facilitate coupling of fluid dispenser 22 to the countertop 26. The housing 36 can include a front end 38, a rear end 40, a top portion 42, and a bottom portion 44. As illustrated in FIGS. 1 and 2, the fluid dispenser 22 can include a dispensation conduit 46 that is configured for dispensing the product P1 therethrough. The dispensation conduit 46 can be routed through the housing 36 of the fluid dispenser 22 to the front end 38. The dispensation conduit 46 can be in fluid communication with the pump 30. When a user's hands are placed under the fluid dispenser 22, the motor 32 can operate the pump 30 to dispense the product P1 from the reservoir 24 through the dispensation conduit 46 to a user's hands placed underneath the fluid dispenser 22 at the front end 38. It is to be appreciated that in one embodiment a component described herein as being in fluid communication or fluidly coupled to another component should be understood to mean that the components are either in direct or indirect fluid communication/coupling.

Although the dispensation conduit 46 is shown be a single conduit, it will be appreciated that any of a variety of suitable alternative conduit configurations are contemplated. When multiple conduits are employed, they can be separate and distinct (e.g., as arranged in a side-by-side relationship), or they can be arranged coaxially. Multiple dispenser conduits can be used, for example, to dispense product P1 in a form different from the form in which it exists in the reservoir 24. For example, product P1 can exist in the reservoir 24 as a liquid, but can be dispensed from the fluid dispenser 22 as foam. In such an example, the fluid dispenser 22 can include an air conduit (not shown) that is in fluid communication with the dispensation conduit 46 via a manifold (not shown). The product P1 and air can be provided to the manifold to dispense foam from the fluid dispenser 22. The manifold can include a mesh screen or other structure that can disperse and homogenize air bubbles throughout the product P.

Figure 3:
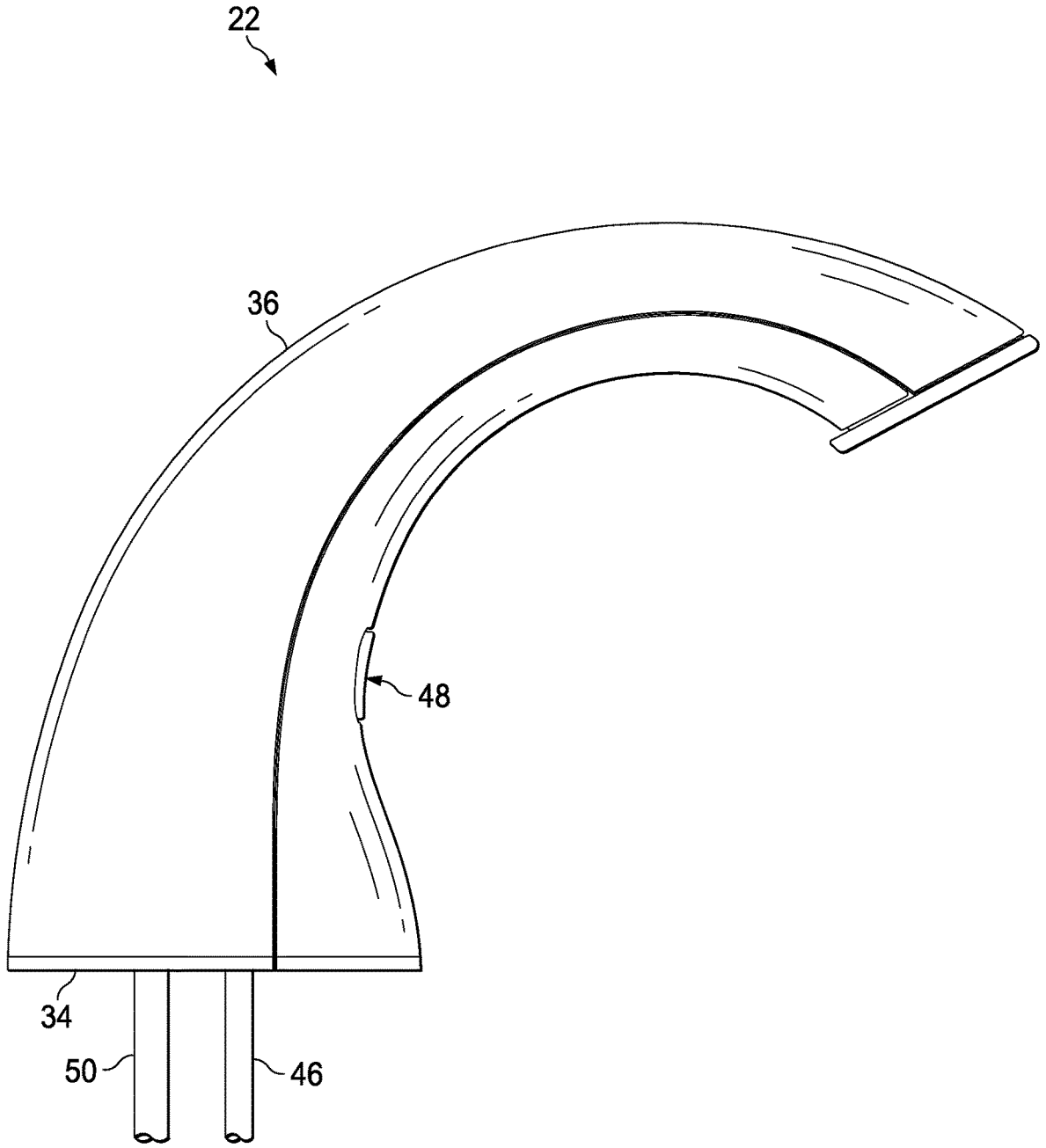
FIG. 3 is a side view depicting the fluid dispenser of FIG. 1.

The fluid dispensing system 20 can include an activator which, when activated, facilitates dispensation of the product P1 from the dispensation conduit 46. In one embodiment, as illustrated in FIGS. 1 and 3, the activator can include a proximity sensor 48 that is in electrical communication with the motor 32. The proximity sensor 48 can detect the presence of a user's hands underneath the fluid dispenser 22 and can facilitate operation of the motor 32 to automatically dispense the product P1 from the fluid dispenser 22. The proximity sensor 48 can be an infrared sensor, a microwave sensor, an ultrasonic wave sensor, or any of a variety of suitable alternative proximity sensors. In another embodiment, the activator can be a contact-type sensor, such as, for example, a capacitive touch sensor or strain gauge. In yet another embodiment, the activator can be a mechanical actuator such as a lever that can be manually actuated to facilitate dispensation of the product P. The proximity sensor 48 is shown to be installed generally centrally along the bottom portion 44 of the fluid dispenser 22 but it is to be appreciated that the proximity sensor 48 can alternatively be installed at any of a variety of suitable locations, such as, for example, more proximate to the front end 38 of the fluid dispenser 22 or at a location separate from the fluid dispenser 22.

As illustrated in FIGS. 1-5, the fluid dispenser 22 can include a refill conduit 50 that is fluidly coupled with the reservoir 24, as illustrated in FIGS. 1 and 2. The refill conduit can comprise a refill port 52. The refill conduit 50 can facilitate refilling of the reservoir 24 through a refill distribution conduit 53 that is coupled with a refill reservoir 54, as illustrated in FIG. 2. As illustrated in FIG. 2, the reservoir 24 and the refill conduit 50 can each be fluidly coupled with a check valve 55 located upstream of the pump 30. The check valve 55 can permit refill fluid to be introduced into the reservoir 24 from the refill conduit 50 but can prevent the product P1 from flowing from the reservoir 24 into the refill conduit 50.

It is to be appreciated that mounting of the refill port 52 on the fluid dispenser 22 can facilitate refilling of the reservoir 24 more effectively than certain conventional fluid dispenser arrangements. For example, accessing the reservoir 24 through the refill port 52 can eliminate the need to directly access the reservoir 24 in order to replenish the product P, thereby reducing time and effort spent refilling the reservoir 24 and reducing the potential for spilling and leaking of the product P1 due to improper installation. In addition, the same reservoir 24 can be repeatedly refilled thereby reducing the amount of waste as compared to cartridge-type refill arrangements.

Figure 4:
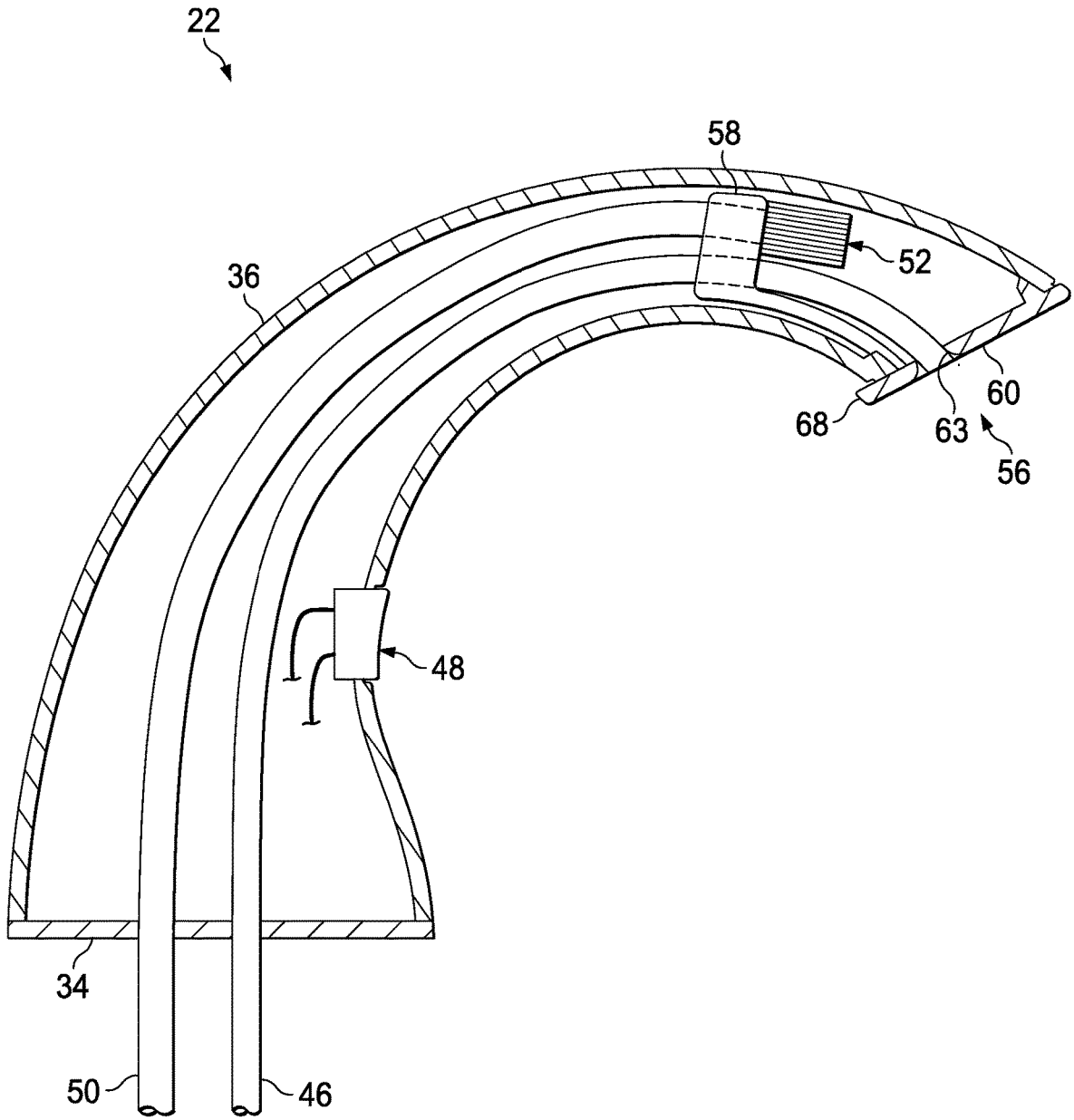
FIG. 4 is a sectional view depicting the fluid dispenser of FIG. 3, wherein a retention member is shown in a stored position.
Figure 5:
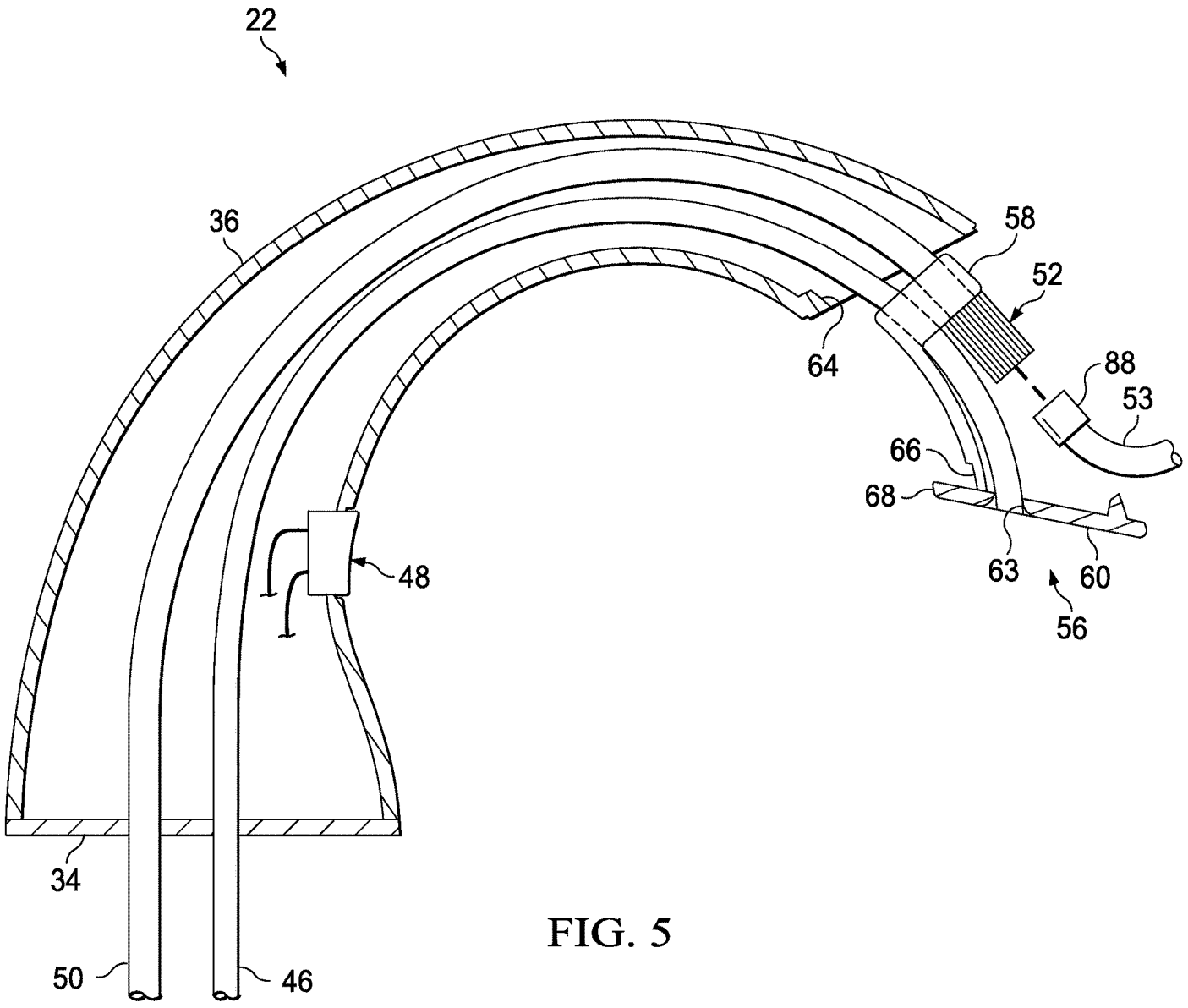
FIG. 5 is a sectional view depicting the fluid dispenser of FIG. 4 but with the retention member in a refilling position.

The fluid dispenser 22 can include an access member that is coupled with the refill port 52 and is movable between a stored position and a refilling position. Movement of the access member from the stored position to the refilling position moves the refill port 52 into a position that facilitates refilling of the fluid reservoir 24 through the refill port 52. In one embodiment, as illustrated in FIGS. 4 and 5, the access member can comprise a retention member 56 having a rear flange 58 that is coupled with the refill port 52. When the retention member 56 is in the stored position, the refill port 52 can be disposed entirely within the housing 36 of the fluid dispenser 22. A face flange 60 of the retention member 56 can cooperate with the housing 36 of the fluid dispenser 22 to substantially conceal the refill port 52 from view. As illustrated in FIG. 5, moving the retention member 56 to the refilling position such that it is spaced away from the housing 36 can permit withdrawal of the refill port 52 from the housing 36 such that the refill port 52 extends away from the housing 36. The refill distribution conduit 53 can then be connected to the refill port 52 (e.g., by a service technician) and fluid from the refill reservoir 54 can be provided into the reservoir 24. When the reservoir 24 has been successfully refilled, the refill distribution conduit 53 can be removed from the refill port 52 and the retention member 56 and the refill port 52 can be returned to the stored position. In one embodiment, the fluid dispenser 22 can include a lockout arrangement (not shown) that prevents dispensation of the product P1 from the fluid dispenser 22 while the retention member 56 is in the refilling position.

The face flange 60 of the retention member 56 can define an aperture 63. The dispensation conduit 46 can extend through the aperture 63 when the retention member 56 is in the stored position. The dispensation conduit 46 can terminate near the face flange 60 such that the product P1 can be dispensed from the face flange 60 at the front end 38 of the fluid dispenser 22. In one embodiment, as illustrated in FIG. 5, the dispensation conduit 46 can be coupled with the retention member 56 such that the retention member 56 and the dispensation conduit 46 are movable together between the stored position and the refilling position. In another embodiment, the retention member 56 can be slidable with respect to the dispensation conduit 46. In such an embodiment, the dispensation conduit can be configured to remain in place when the retention member 56 is moved from the stored position to the refilling position.

The retention member 56 can be releasably secured to the housing 36 of the fluid dispenser 22. In one embodiment, as illustrated in FIG. 5, the housing 36 of the fluid dispenser 22 can have an internal detent 64. When the retention member 56 is in the stored position, the detent 64 can interact with a recess 66 on the retention member 56 to retain the retention member 56 in place. The retention member 56 can be moved to the refilling position by pulling the retention member 56 away from the housing 36 with enough force to overcome the interaction between the detent 64 and the recess 66. The retention member 56 can include a finger tab 68 that can be engaged by a user's finger to facilitate urging of the retention member 56 out of the stored position by applying upward pressure and pulling the finger tab 68 away from the housing 36 of the fluid dispenser 22. It is to be appreciated that any of a variety of locking arrangements can be provided to facilitate releasable securement of the retention member to the housing, such as, for example, a cam-action, snap-action, or slide-action mechanism.

Figure 6:
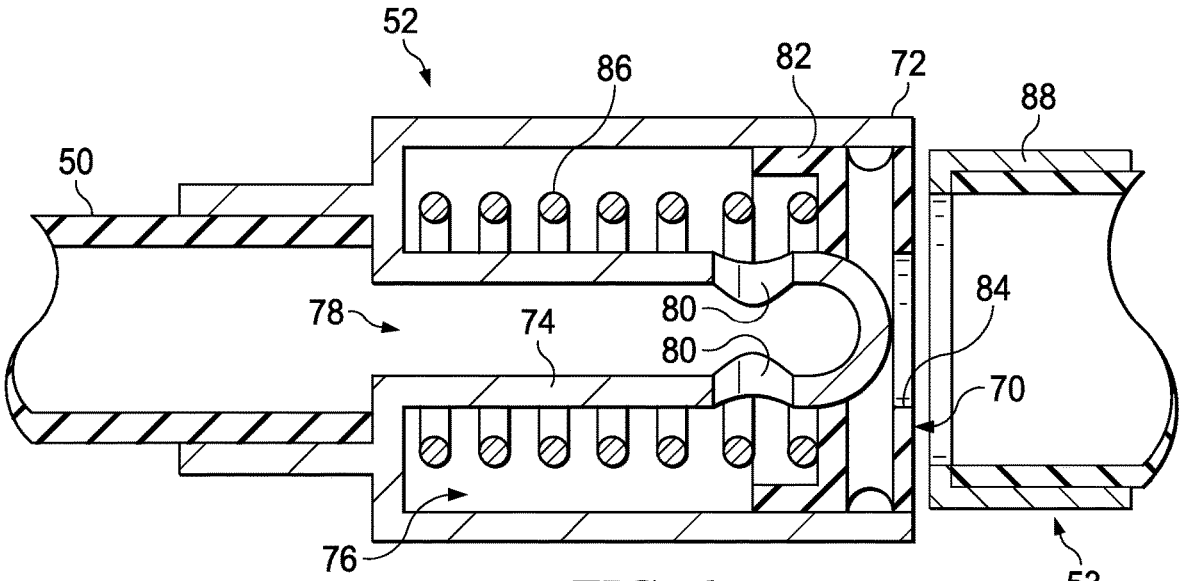
FIG. 6 is a sectional view depicting a refill port and a refill conduit of the fluid dispenser of FIG. 1, wherein a sealing member is shown in a closed position.
Figure 7:
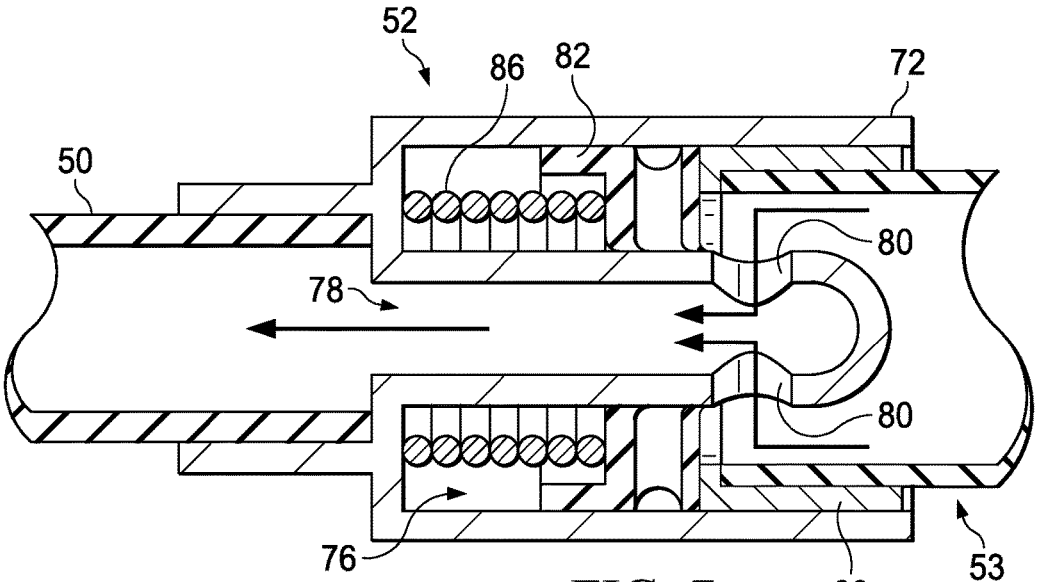
FIG. 7 is a sectional view depicting the refill port and the refill conduit of FIG. 6, but with the sealing member urged into an opened position by a refill distribution conduit.

As illustrated in FIGS. 6 and 7, the refill port 52 can include a valve 70 having a housing 72 that includes an internal needle 74. The housing 72 can define an external chamber 76 and the internal needle 74 can define an internal chamber 78. The refill conduit 50 can be coupled with the housing 72 such that the internal chamber 78 is in fluid communication with the refill conduit 50. The internal needle 74 can define a pair of apertures 80 that facilitate fluid communication between the external chamber 76 and the internal chamber 78. The valve 70 can also include a sealing member 82 that is in sealing interaction with the housing 72. The sealing member 82 can define a central aperture 84. The internal needle 74 can extend through the central aperture 84 of the sealing member 82 such that the sealing member 82 can surround the internal needle 74 to create an effective seal there between as the sealing member 82 is slid along the internal needle 74.

The sealing member 82 can be movable between a closed position, as illustrated in FIG. 6 and an opened position, as illustrated in FIG. 7. A spring 86 can bias the sealing member 82 into the closed position. When the sealing member 82 is in the closed position, it can cooperate with the housing 72 and the internal needle 74 to substantially seal the external and internal chambers 76, 78 from the outside environment. When the refill distribution conduit 53 is connected to the refill port 52, the refill distribution conduit 53 can urge the sealing member 82 into the opened position and the internal needle 74 can project into the refill distribution conduit 53 such that the refill distribution conduit 53 is in fluid communication with the internal chamber 78. Refill fluid from the refill distribution conduit 53 can accordingly flow through the pair of apertures 80, though the internal chamber 78, and to the refill conduit 50 to facilitate refilling of the reservoir 24.

The sealing member 82 can engage the housing 72 to create a sealed interface when the sealing member 82 is in each of the closed position and the opened position. As a result, the internal and external chambers 76, 78 can remain substantially sealed from the outside environment irrespective of whether the refill distribution conduit 53 is inserted in the housing 72. The refill port 52 is accordingly less prone to becoming contaminated with foreign substances, germs, and other contaminants than non-valved arrangements (e.g., such as fluid dispensers that are refillable through an integral funnel provided in the fluid dispenser and covered with a lid).

The refill port 52 can be configured to receive and retain the refill distribution conduit 53 when it is connected to the refill port 52. In one embodiment, as illustrated in FIGS. 6 and 7, the refill distribution conduit 53 can include a collar 88 that engages the housing 72 in an interference fit to retain the refill distribution conduit 53 within the refill port 52 and create an effective seal there between. As a result, fluid from the refill assembly 54 can be prevented from leaking from the refill port 52 when the refill distribution conduit 53 is connected thereto.

It is to be appreciated that the refill port 52 and the refill distribution conduit 53 can be releasably and fluidly coupled together with any of a variety of suitable alternative arrangements and/or any of a variety of sealing arrangements. In some embodiments, the refill port 52 can be configured to include a keyed connection or other unique connection which can prevent or deter unauthorized connection to the refill port 52 (e.g., with an unauthorized refill distribution conduit). The refill port 52 can also be configured to include a locking mechanism to secure the refill distribution conduit 53 to the refill port 52 and ensure that the connection is not altered or prematurely terminated before the intended amount of product P1 has been transferred. It is to be appreciated that, although the refill port 52 is illustrated as extending generally horizontally from the fluid dispenser 22, a refill port 52 can be provided in various alternative locations, positions, and orientations on a fluid dispenser.

It is to be appreciated, that movement of the refill port 52 to the stored position (e.g., with the retention member 56) can mitigate contamination of the refill port 52 and any unwanted tampering of the dispenser system by users. In addition, the refill port 52 can be generally obstructed from view when in the stored position, thereby contributing to the overall aesthetics of the fluid dispenser 22.

Figure 8:
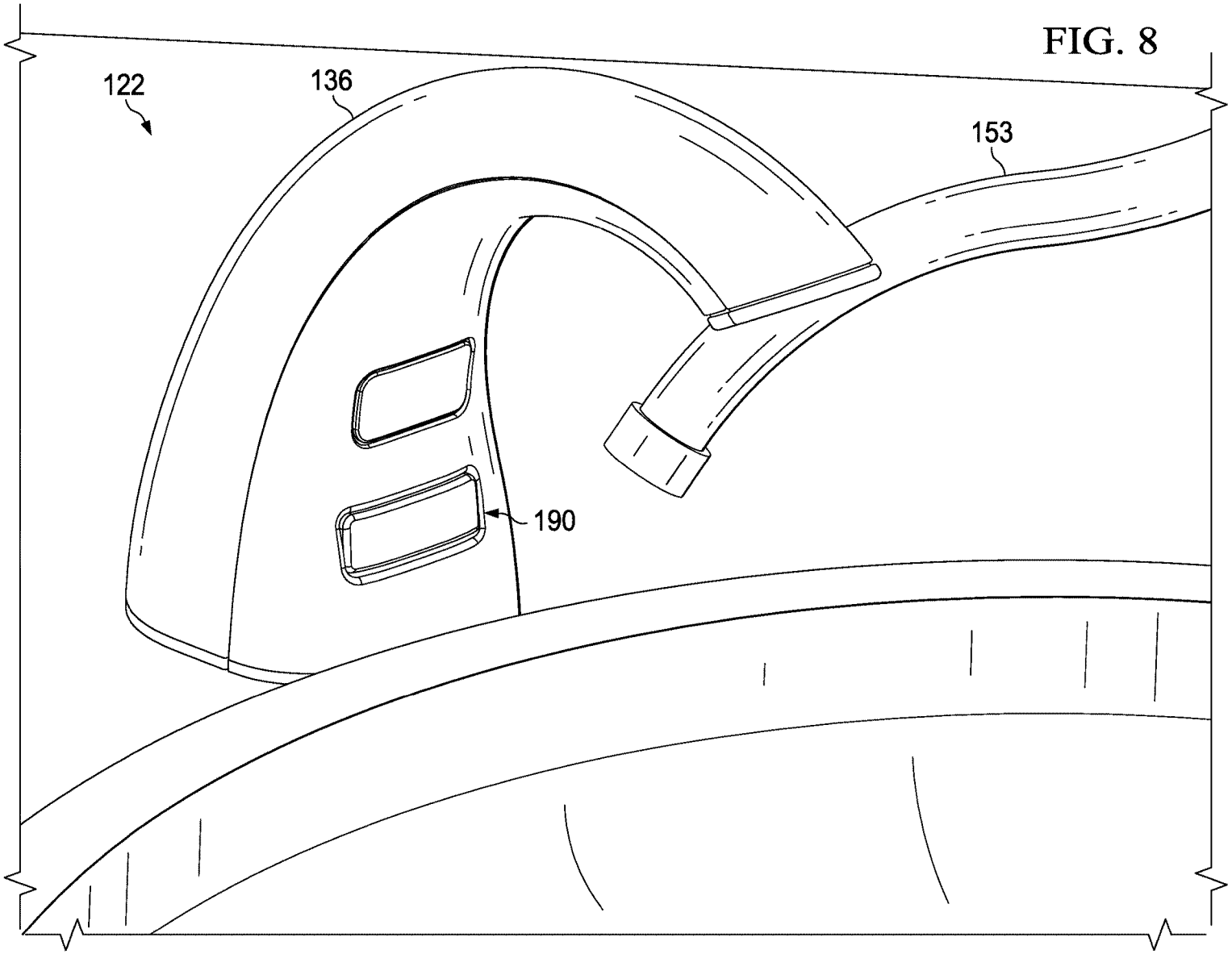
FIG. 8 is a perspective view depicting a fluid dispenser according to another embodiment and in association with various other components, wherein a tray of the fluid dispenser is shown in a stored position.
Figure 9:
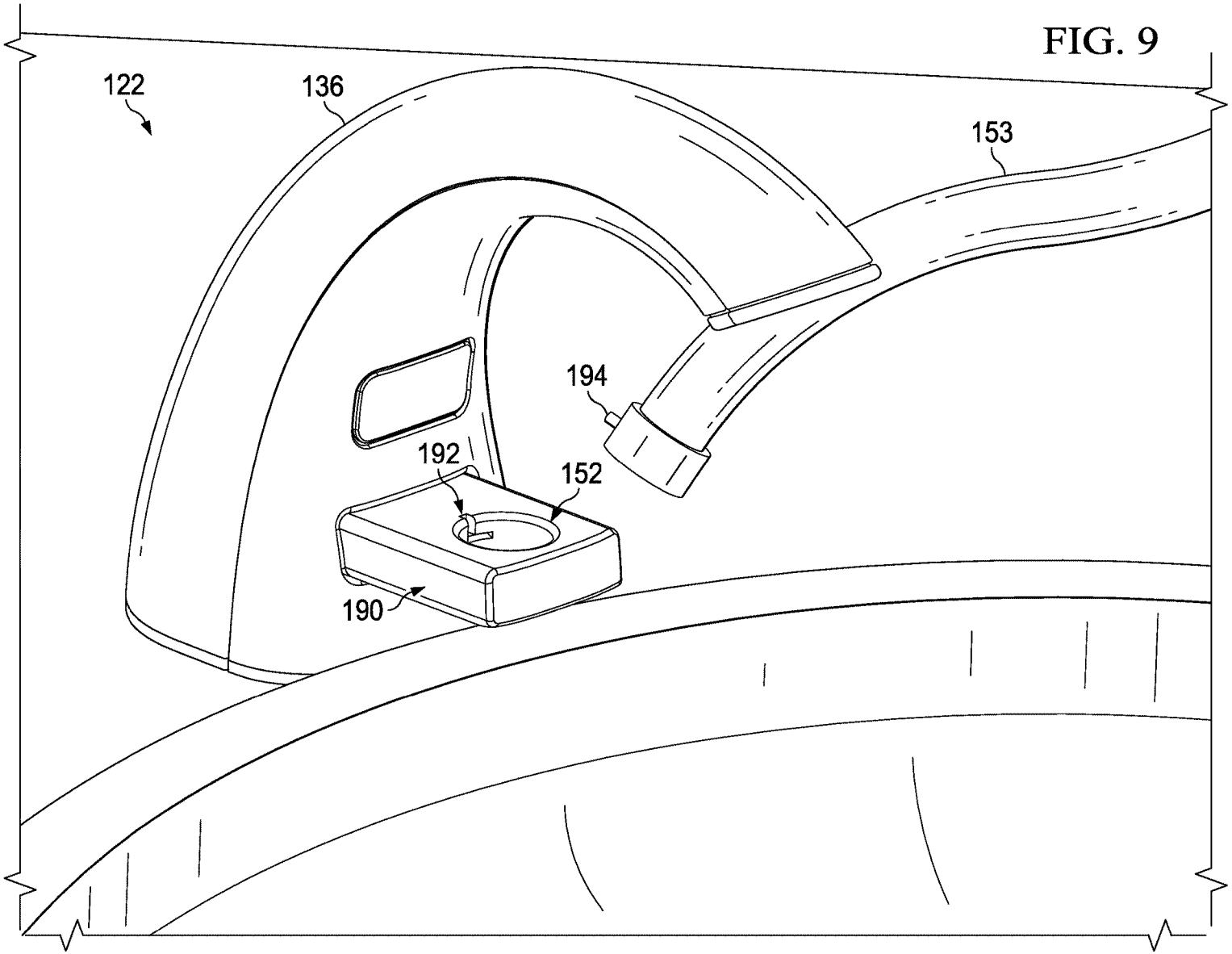
FIG. 9 is a perspective view depicting the fluid dispenser of FIG. 8, but with the tray shown in a refilling position.

FIGS. 8 and 9 illustrate a fluid dispenser 122 according to another embodiment. The fluid dispenser 122 illustrated in FIGS. 8 and 9 can be similar to, or the same in many respects as, the fluid dispenser 22 shown in FIGS. 1-7. For example, the fluid dispenser 122 can comprise a refill port 152 (FIG. 9) that facilitates refilling of a reservoir (not shown) from the fluid dispenser 122. The refill port 152 can be coupled with an access member. However, the access member can be a tray 190 that is slidably coupled with a housing 136 of the fluid dispenser 122 and is slidable with respect to the housing 136 between a stored position (FIG. 8) and a refilling position (FIG. 9). The refill port 152 can be disposed on the tray 190 and can be in fluid communication with a refill conduit (not shown). When the tray 190 is in stored position, the refill port 152 can be substantially concealed within the housing 136. When the tray 190 is in the refilling position, the refill port 152 can be exposed and available to receive a refill distribution conduit 153. In one embodiment, the tray 190 can be spring-actuated and biased into the refilling position such that when the tray 190 is in the stored position and depressed and released (e.g., with a user's finger), the tray 190 can automatically move to the refilling position. When the tray 190 is then returned to the stored position, a catch arrangement (not shown) can hold the tray 190 in place until it is depressed again to release it into the refilling position. In another embodiment, the tray 190 can include a finger tab (not shown) or similar arrangement that can facilitate urging of the tray 190 between the stored and refilling positions with a user's finger. In one embodiment, the fluid dispenser 122 can include a lockout arrangement (not shown) that prevents dispensation of the product P1 from the fluid dispenser 122 when the tray 190 is in the refilling position.

The refill port 152 can include an interlock arrangement (not shown) that is configured to facilitate selective securement of the refill distribution conduit 153 to the refill port 152. As illustrated in FIG. 9, the refill port 152 can include a L-shaped slot 192 that cooperates with a projection 194 on the refill distribution conduit 153 to facilitate selective securement of the refill distribution conduit 153 to the refill port 152 (e.g., a twist-lock type arrangement). For example, when the refill distribution conduit 153 is connected to the refill port 152 and rotated, the projection 194 can slide into the L-shaped slot 192 such that the refill distribution conduit 153 is temporarily locked in place.

It is to be appreciated that the tray 190 can be located at any of a variety of suitable alternative locations on the fluid dispenser 122. Furthermore, although the tray is shown to be extended generally horizontally, a tray can be configured to extend in any direction, such as, for example, generally vertically along a top of a fluid dispenser.

Figure 10:
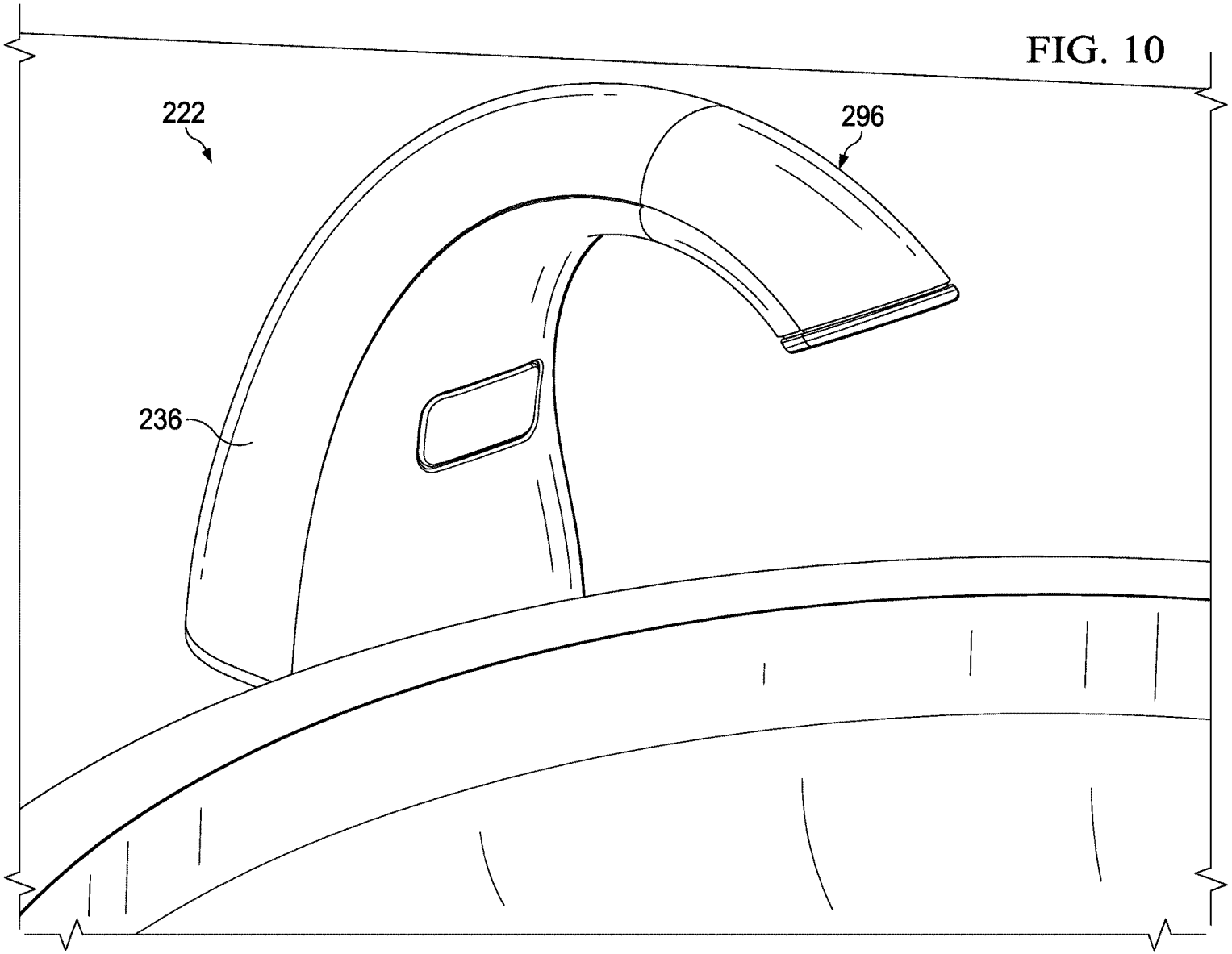
FIG. 10 is a perspective view depicting a fluid dispenser according to yet another embodiment and in association with various other components, wherein a head unit of the fluid dispenser is shown in a stored position.
Figure 11:
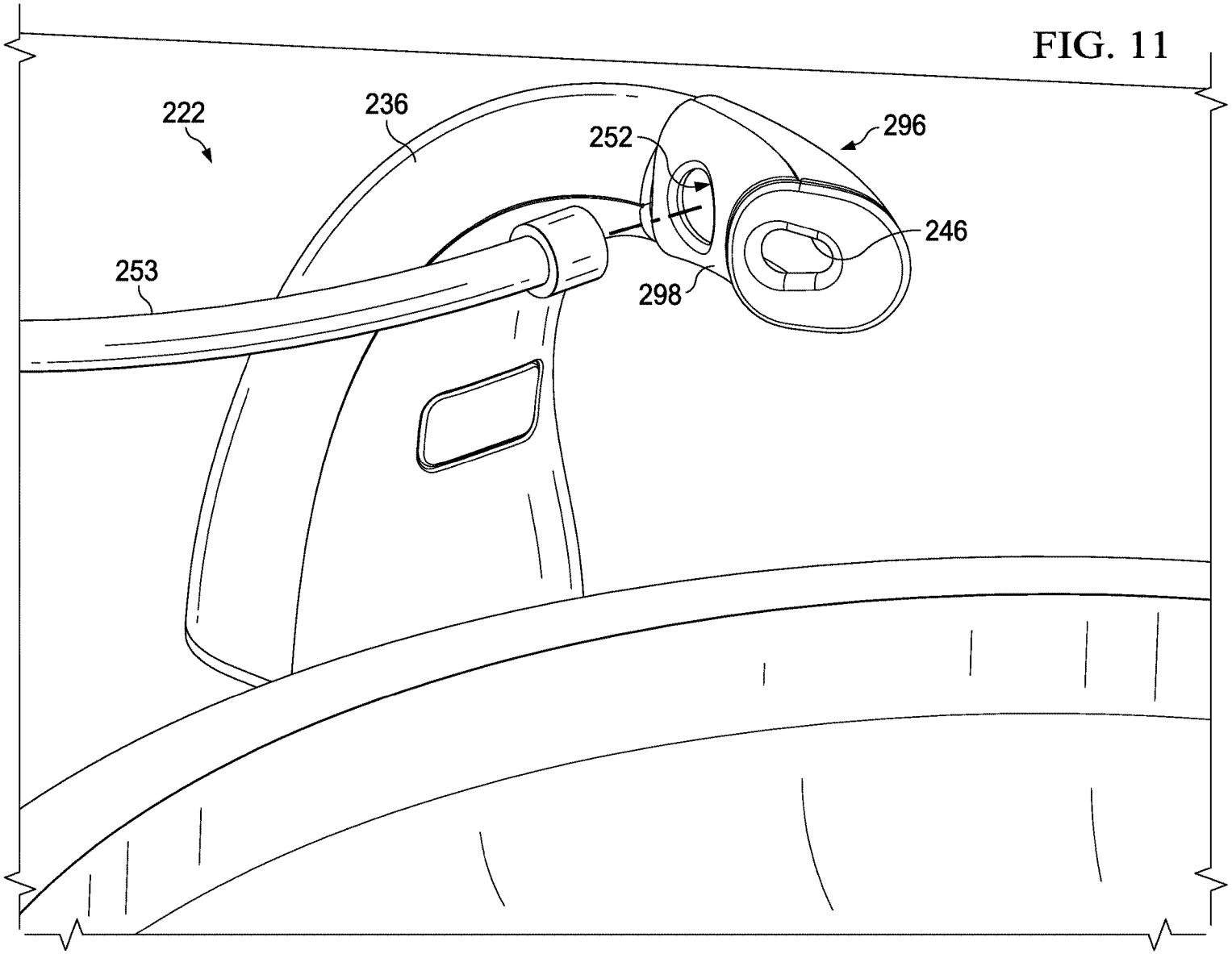
FIG. 11 is a perspective view depicting the fluid dispenser of FIG. 10, but with the head unit shown in a refilling position.

FIGS. 10 and 11 illustrate a fluid dispenser 222 according to another embodiment. The fluid dispenser 222 illustrated in FIGS. 10 and 11 can be similar to, or the same in many respects as, the fluid dispenser 22 shown in FIGS. 1-7. For example, the fluid dispenser 222 can comprise a refill port 252 (FIG. 11) that facilitates refilling of a reservoir (not shown) from the fluid dispenser 222. The refill port 252 can be coupled with an access member. However, the access member of the fluid dispenser 222 can be a head unit 296 that is rotatably coupled with a housing 236 of the fluid dispenser 222 and that is rotatable with respect to the housing 236 between a stored position (FIG. 10) and a refilling position (FIG. 11). The refill port 252 is located on a lower surface 298 of the head unit 296. When the head unit 296 is in the stored position, the refill port 252 can be substantially concealed by the head unit 296. When the head unit 296 is rotated to the refilling position, the refill port 252 can be exposed on a side of the fluid dispenser 222 and thus available to receive a refill distribution conduit 253. As illustrated in FIG. 11, the head unit 296 can house a dispensation conduit 246 such that the product P1 can be dispensed from the head unit when in the stored position and a user's hands are provided beneath the fluid dispenser 222. In one embodiment, the fluid dispenser 222 can include a lockout arrangement (not shown) that prevents dispensation of the product P1 from the head unit 296 when the head unit 296 is in the refilling position. Although the head unit 296 is shown to be rotatable by about 90 degrees, it is to be appreciated that the head unit 296 can be configured for rotation to any of a variety of selectable positions, and in some embodiments can be configured to fully rotate.

Figure 12:
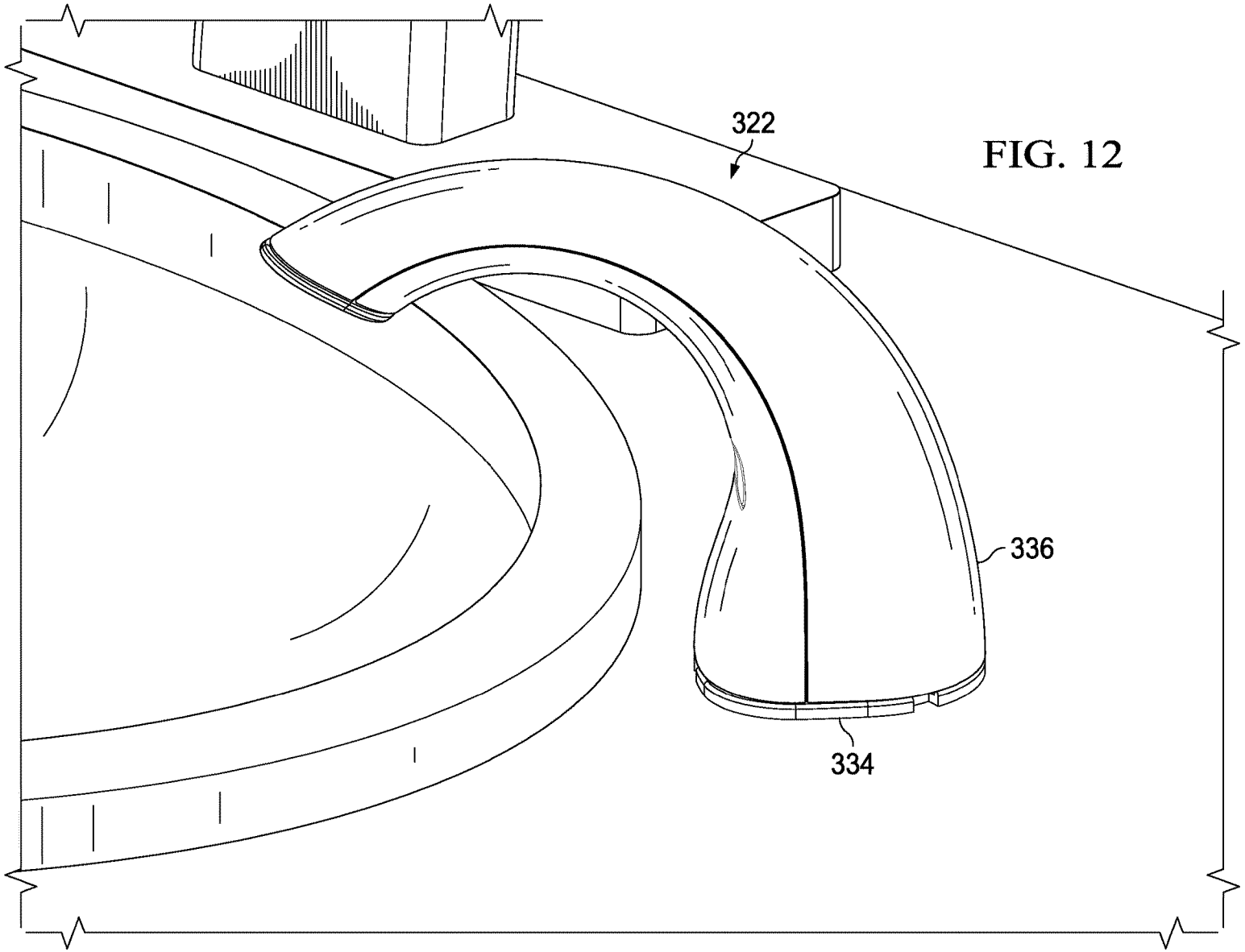
FIG. 12 is a perspective view depicting a fluid dispenser according to yet another embodiment and in association with various other components, wherein a housing of the fluid dispenser is shown in a stored position.
Figure 13:
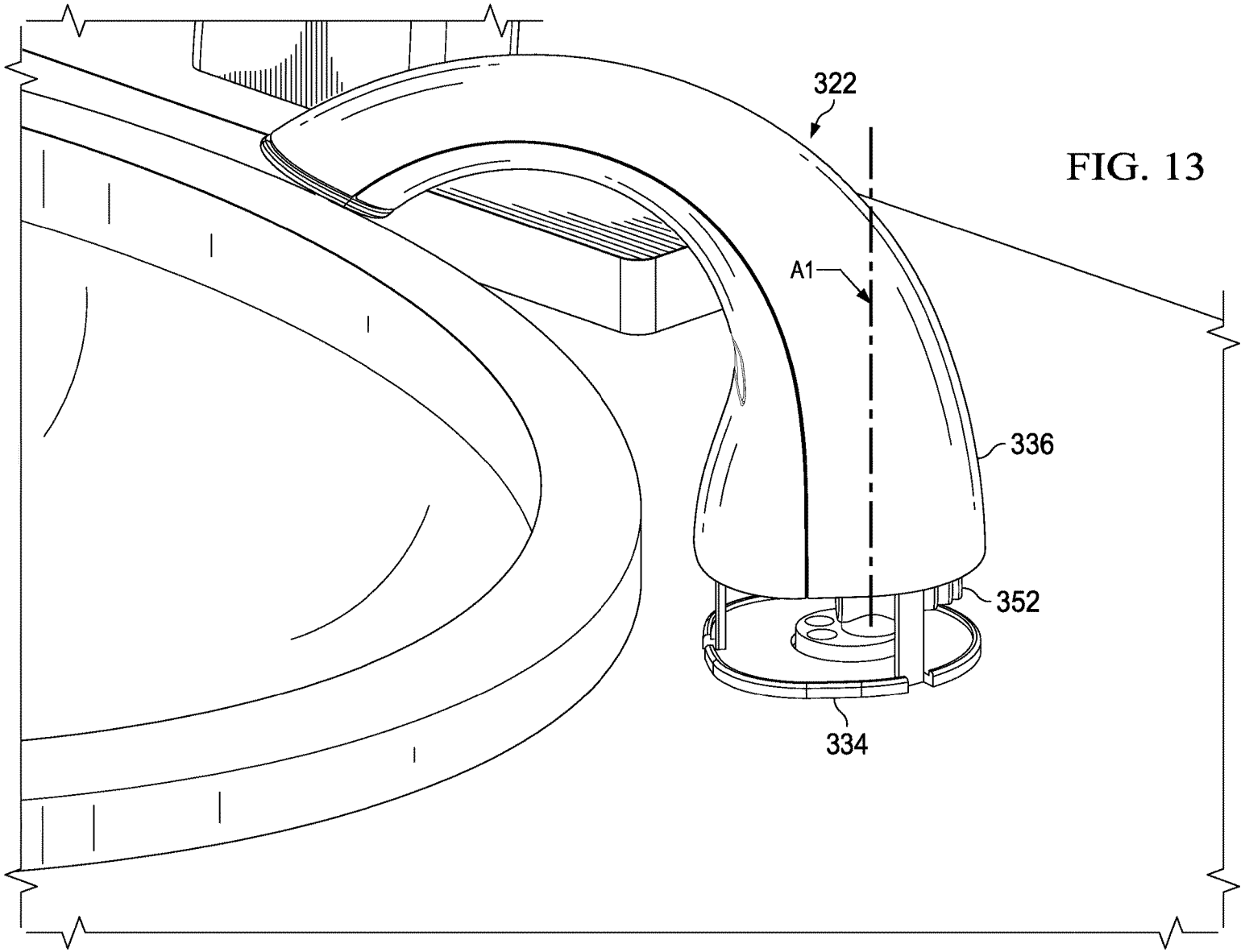
FIG. 13 is a perspective view depicting the fluid dispenser of FIG. 12, but with the housing shown in a refilling position.

FIGS. 12 and 13 illustrate a fluid dispenser 322 according to another embodiment. The fluid dispenser 322 illustrated in FIGS. 12 and 13 can be similar to, or the same in many respects as, the fluid dispenser 22 shown in FIGS. 1-7. For example, the fluid dispenser 322 comprises a refill port 352 (FIG. 13) that facilitates refilling of a reservoir (not shown) from the fluid dispenser 322. The fluid dispenser 322 can have a base 334 and a housing 336. However, instead of the refill port 352 being located on an access member, the refill port 352 can be fixed to the base 334, and the housing 336 can be movably coupled with the base 334 and movable between a stored position (FIG. 12) and a refilling position (FIG. 13) to selectively expose the refill port 352 from beneath the housing 336. More particularly, and as illustrated in FIGS. 12 and 13, the housing 336 can be slidably coupled to the base 334 and slidable along a substantially vertical axis A1 between the stored position and the refilling position. When the housing 336 is in the stored position, the housing 336 can overlie the refill port 352 such that the refill port 352 is concealed within the housing 336. When refilling of the reservoir (not shown) is desired, the housing 336 can be pulled upwardly to reveal the refill port 352 and a refill distribution conduit (not shown) can be connected to the refill port 352 for refilling of the reservoir. In one embodiment, the base 334 and the housing 336 can be configured to interact with each other to releasably retain the housing 336 in the stored position, such as, for example, with a detent arrangement (not shown). In one embodiment, the fluid dispenser 322 can include a lockout arrangement (not shown) that prevents dispensation of the product P1 from the fluid dispenser 322 when the fluid dispenser is in the refilling position. It is to be appreciated that in some embodiments, a refill port can additionally be movably coupled with the base and movable with respect to the base. In such embodiments, the refill port can move in conjunction with the housing or subsequent to movement of the housing to provide easier access to the refill port 352.

Figure 14:
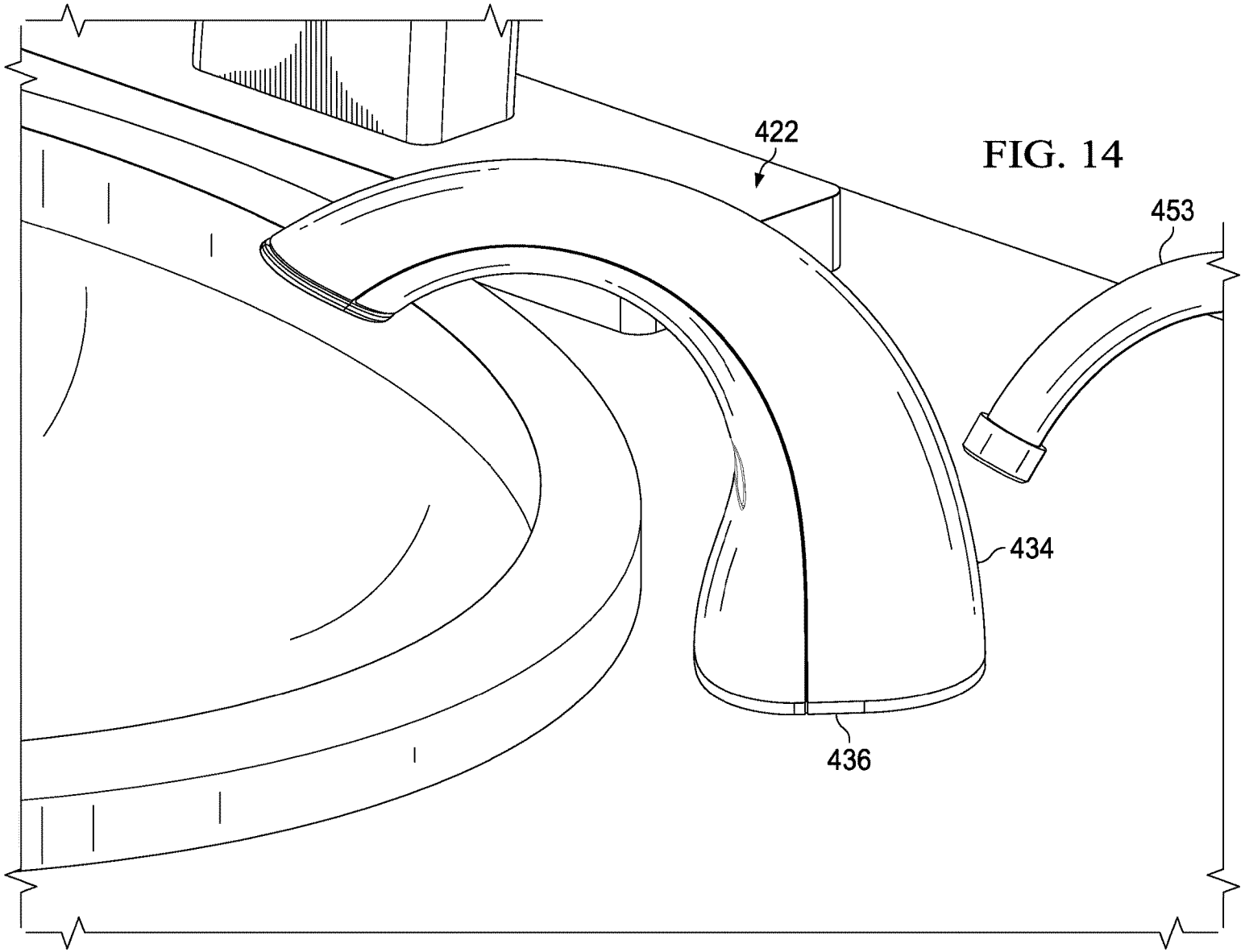
FIG. 14 is a perspective view depicting a fluid dispenser according to still yet another embodiment and in association with various other components, wherein a housing of the fluid dispenser is shown in a stored position.
Figure 15:
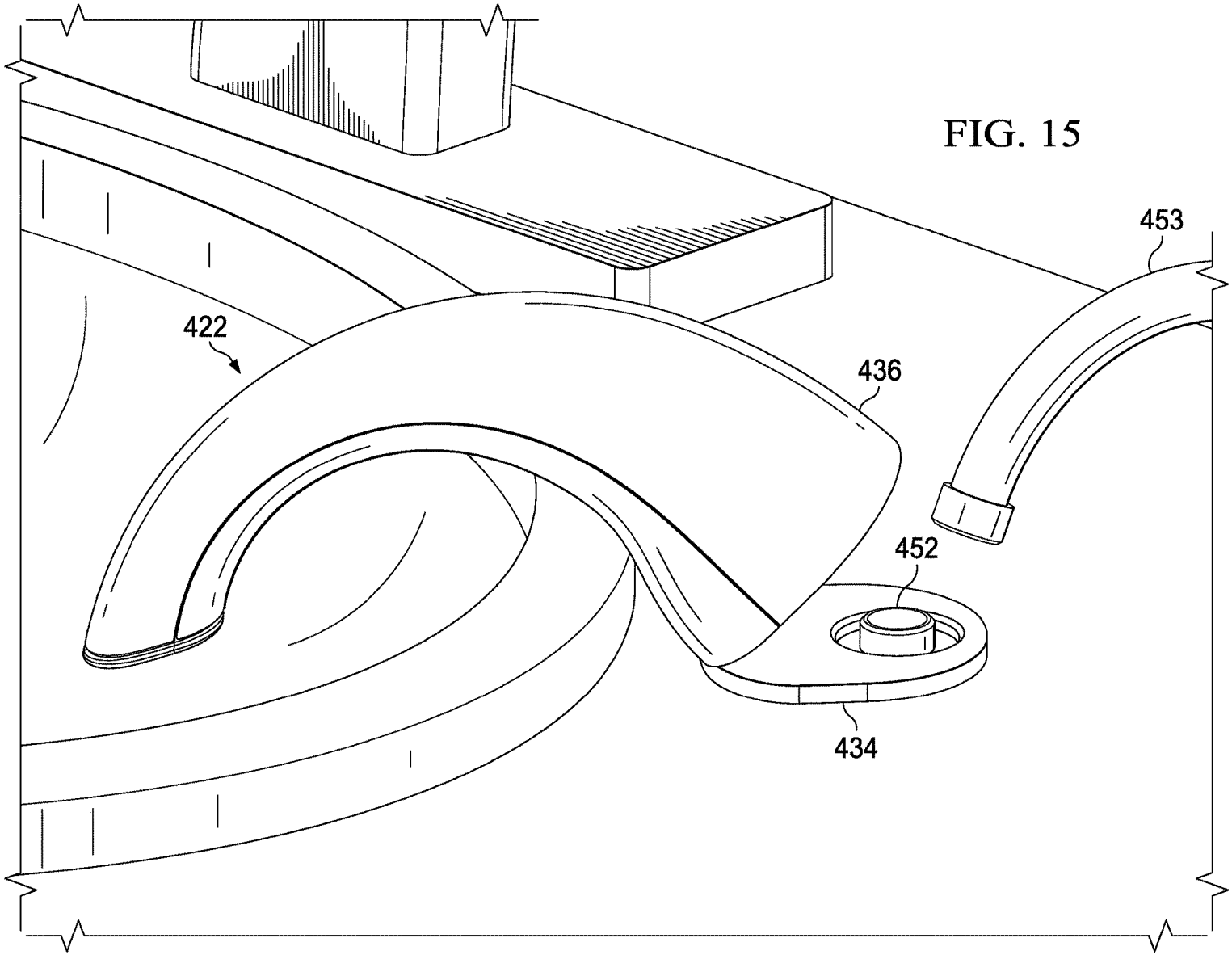
FIG. 15 is a perspective view depicting the fluid dispenser of FIG. 14, but with the housing shown in a refilling position.

FIGS. 14 and 15 illustrate a fluid dispenser 422 according to another embodiment. The fluid dispenser 422 illustrated in FIGS. 14 and 15 can be similar to, or the same in many respects as, the fluid dispenser 22 shown in FIGS. 1-7. For example, the fluid dispenser 422 can comprise a refill port 452 (FIG. 15) that facilitates refilling of a reservoir (not shown) from the fluid dispenser 422. The fluid dispenser 422 can have a base 434 and a housing 436. However, instead of the refill port 452 being located on an access member, the refill port 452 can be fixed to the base 434, and the housing 436 can be pivotally coupled to the base 434 and pivotable with respect to the base 434 between the stored position and the refilling position. When the housing 436 is in the stored position, the housing 436 can overlie the refill port 452 such that the refill port 452 can be substantially concealed within the housing 436. When refilling of the reservoir (not show) is desired, the housing 436 can be pivoted forwardly to reveal the refill port 452 and a refill distribution conduit 453 can be connected to the refill port 452 for refilling of the reservoir. In one embodiment, the base 434 and the housing 436 can be configured to interact with each other to releasably retain the housing 436 in the stored position, such as, for example, with a detent arrangement (not shown). In one embodiment, the fluid dispenser 422 can include a lockout arrangement (not shown) that prevents dispensation of the product P1 from the fluid dispenser 422 when the fluid dispenser is in the refilling position.

Figure 16:
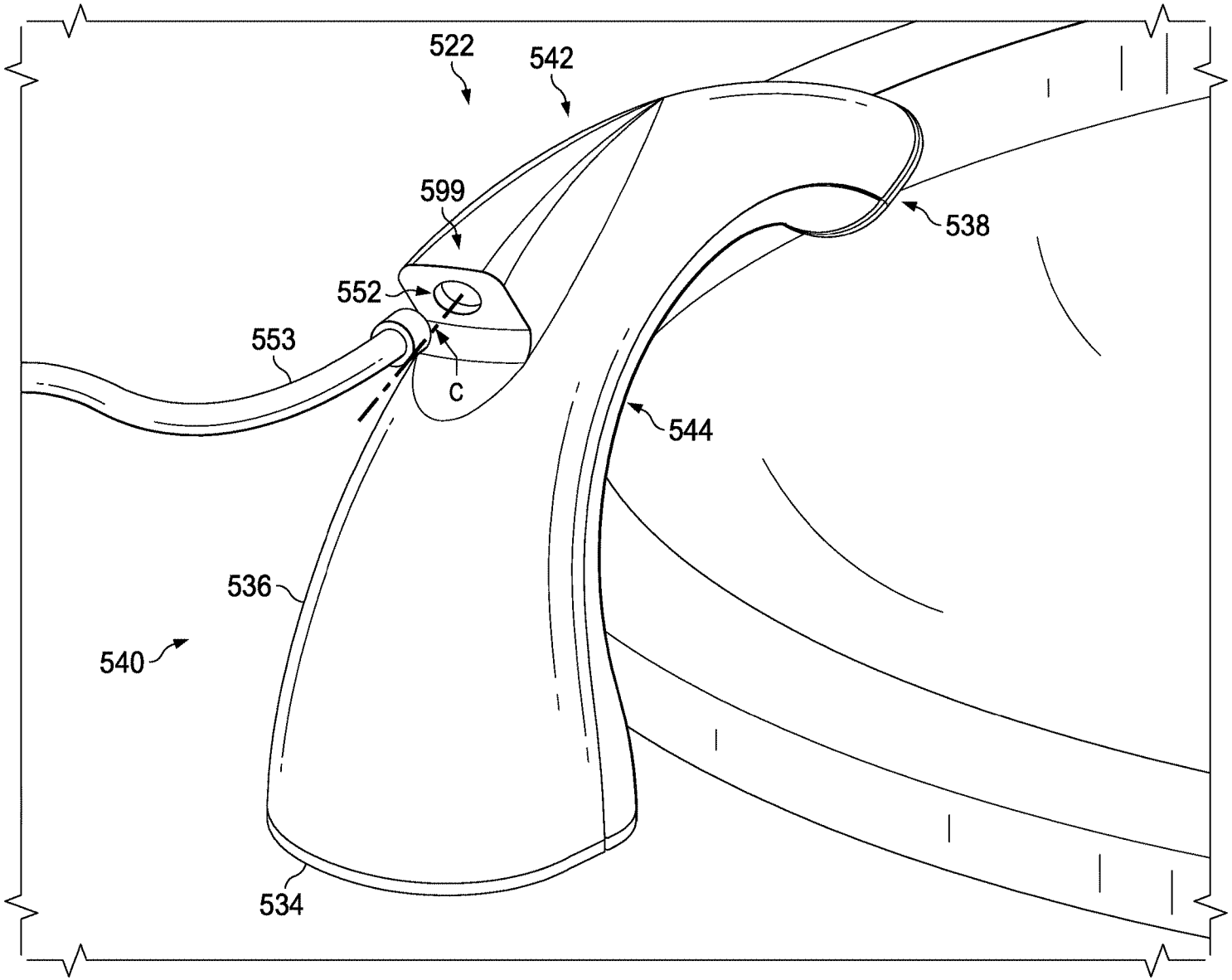
FIG. 16 is a perspective view depicting a fluid dispenser according to still yet another embodiment and in association with various other components.
Figure 17:
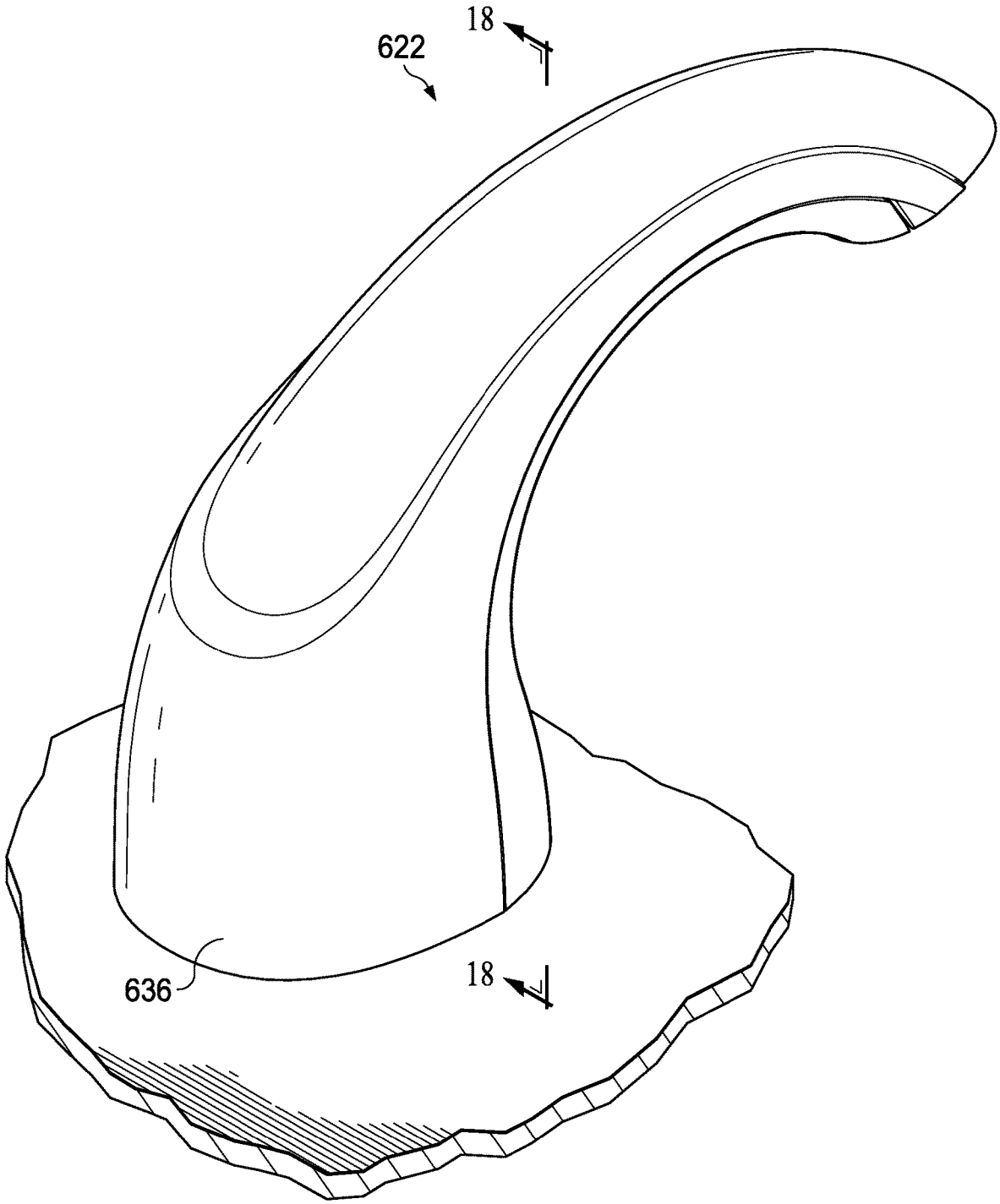
FIG. 17 is a perspective view depicting a fluid dispenser according to still yet another embodiment, wherein a housing of the fluid dispenser is shown in a stored position.
Figure 18:
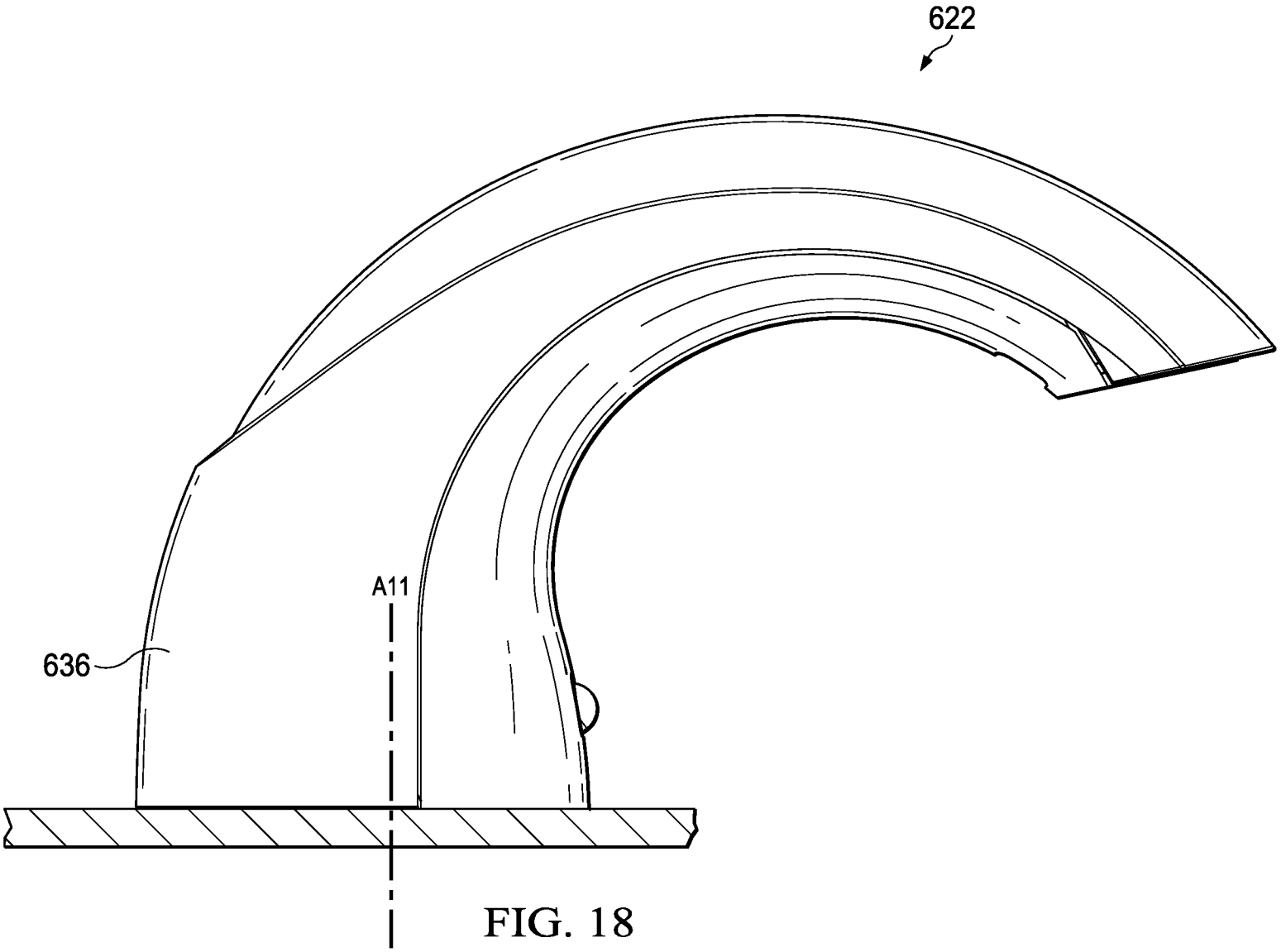
FIG. 18 is a sectional view taken along the section line 17-17 in FIG. 17.
Figure 19:
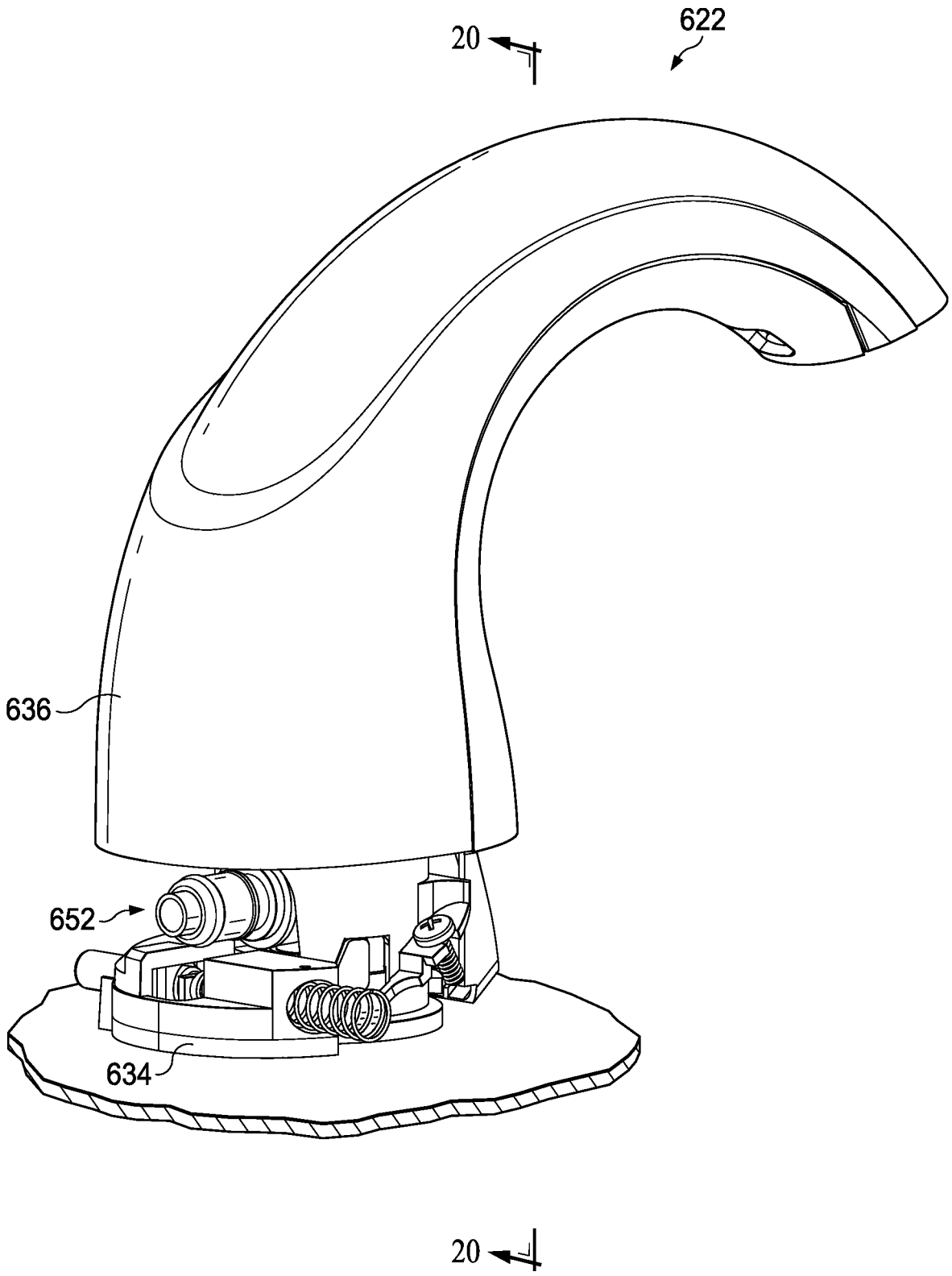
FIG. 19 is a perspective view depicting the fluid dispenser of FIG. 17, but with the housing shown in a refilling position.
Figure 20:
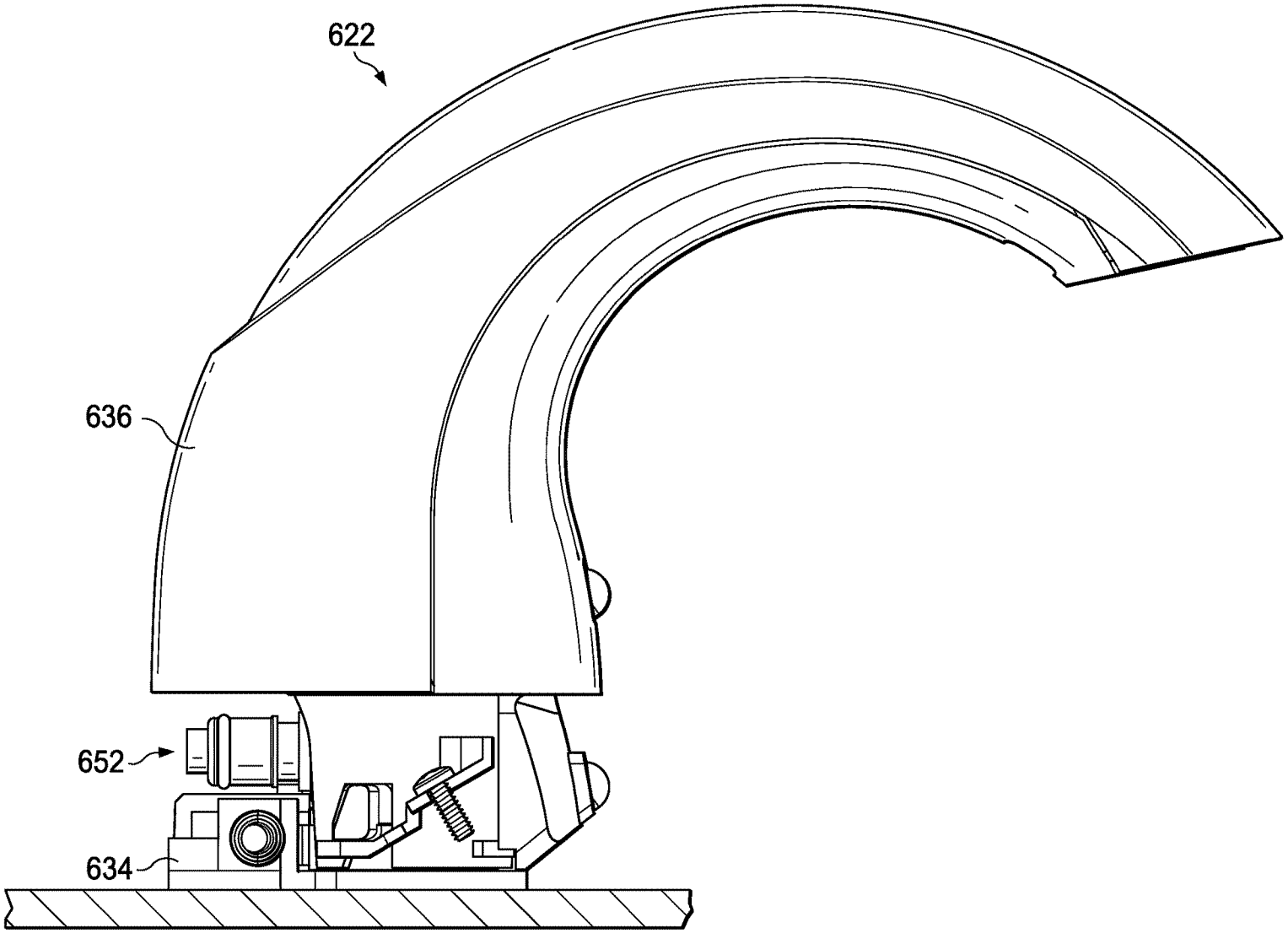
FIG. 20 is a sectional view taken along the section line 19-19 in FIG. 17.

FIG. 16 illustrates a fluid dispenser 522 according to another embodiment. The fluid dispenser 522 illustrated in FIG. 16 can be similar to, or the same in many respects as, the fluid dispenser 22 shown in FIGS. 1-7. For example, the fluid dispenser 522 can comprise a refill port 552 that facilitates refilling of a reservoir (not shown) from the fluid dispenser 522. The fluid dispenser 522 can have a base 534 and a housing 536. The housing 536 can include a front end 538, a rear end 540, a top portion 542, and a bottom portion 544. The fluid dispenser 522 can dispense fluid from the front end 538 in a generally forwardly direction (e.g., from a dispensation conduit). The refill port 552 can be located along the rear end 540 of the housing 536 such that the reservoir (not shown) is refilled from the rear of the fluid dispenser 522 by way of a refill distribution conduit 553. The refill port 552 can have an opening that defines a centerline C and can be arranged along the housing 536 such that the centerline C extends from the rear end 540 of the housing 536 and out of the refill port 552 in a generally downward and/or rearward direction. In certain embodiments, the opening of the refill port 552 can be angled such that the centerline C is angled from vertical by about 0 degrees to about 90 degrees. In one embodiment, the opening of the refill port 552 can be angled such that the centerline C is angled from vertical by at least 30 degrees from vertical. The rear end 540 can include a rigid overhang portion 599 located above the refill port 552 and configured to at least partially conceal or guard the refill port 552 from contaminants, and/or unauthorized/unwanted access.

Figure 21:
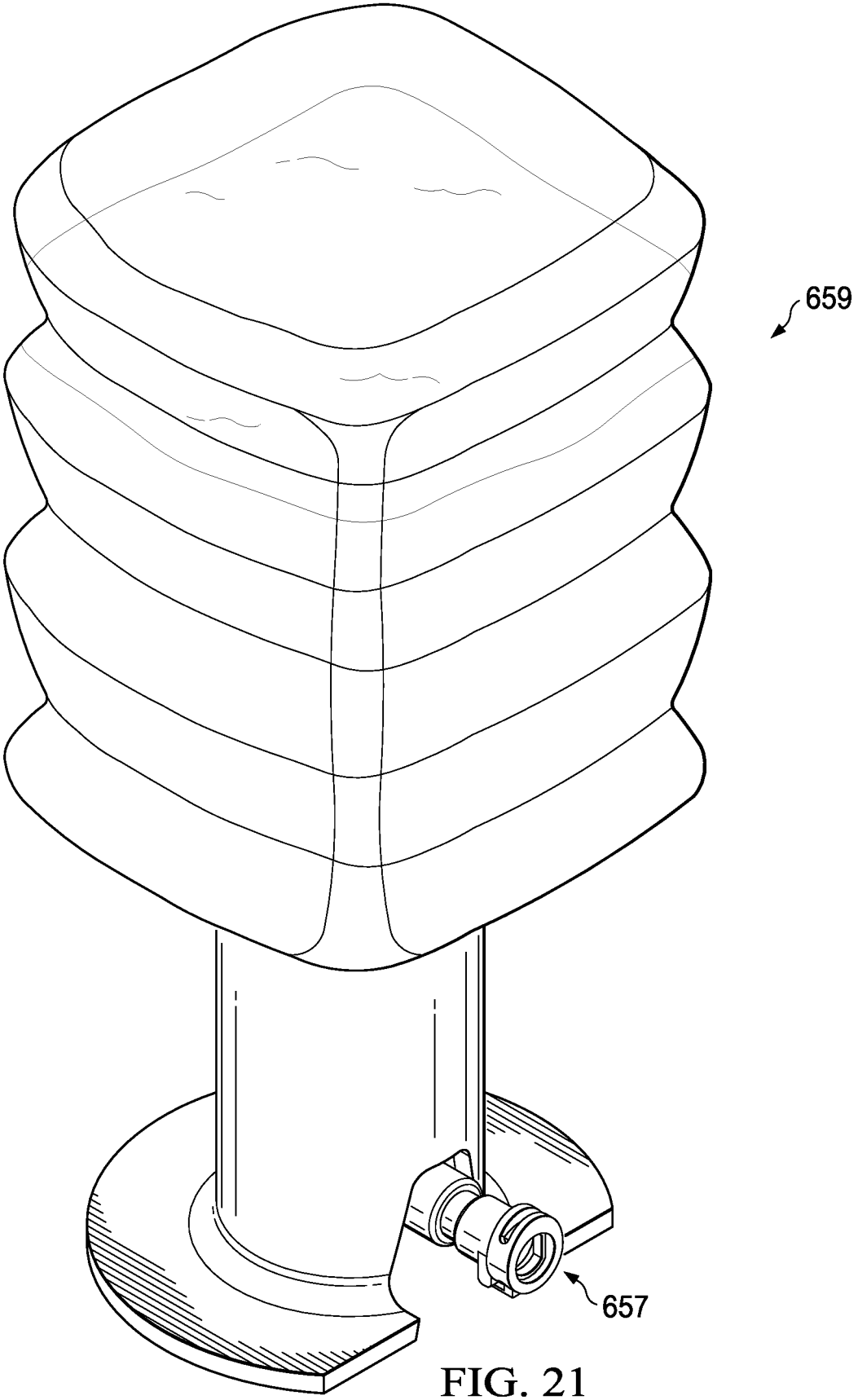
FIG. 21 is a perspective view of a refill cartridge according to one embodiment.

FIGS. 17-20 illustrate a fluid dispenser 622 according to another embodiment. The fluid dispenser 622 illustrated in FIGS. 17-20 can be similar to, or the same in many respects as, the fluid dispenser 622 shown in FIGS. 12 and 13. For example, the fluid dispenser 622 comprises a refill port 652 (FIGS. 19 and 20) that facilitates refilling of a reservoir (not shown) from the fluid dispenser 622. The fluid dispenser 622 can have a base 634 and a housing 636. The housing 636 can be slidably coupled with the base 634 and slidable along a substantially vertical axis A11 between a stored position (FIGS. 17 and 18) and a refilling position (FIGS. 19 and 20) to selectively expose the refill port 652 from beneath the housing 636. When the housing 636 is in the stored position, the housing 636 can conceal the refill port 652. When refilling of the reservoir (not shown) is desired, the housing 636 can be pulled upwardly to reveal the refill port 652 and a refill distribution conduit 657 of a refill cartridge 659 (shown in FIG. 21) can be connected to the refill port 652 for refilling of the reservoir.

Figure 23:
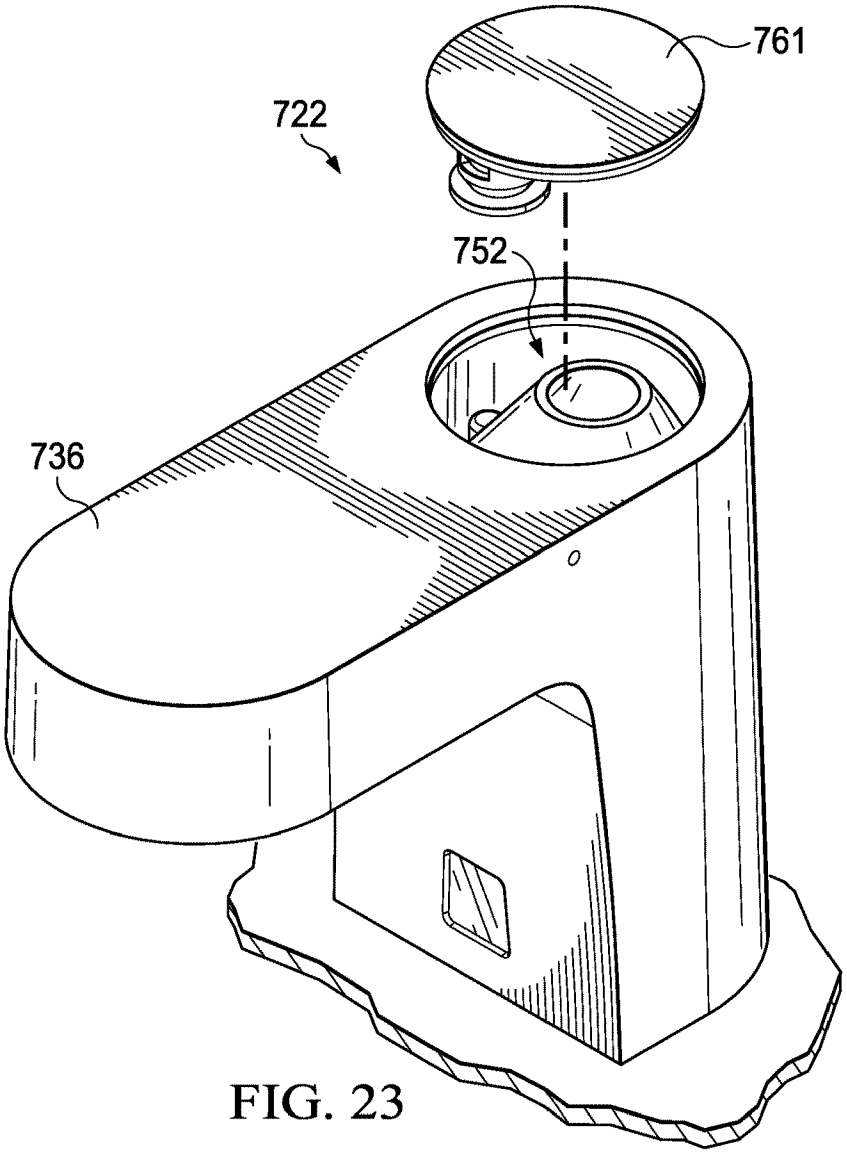
FIG. 23 is a perspective view depicting the fluid dispenser of FIG. 22, but with the lid shown in an opened position.
Figure 22:
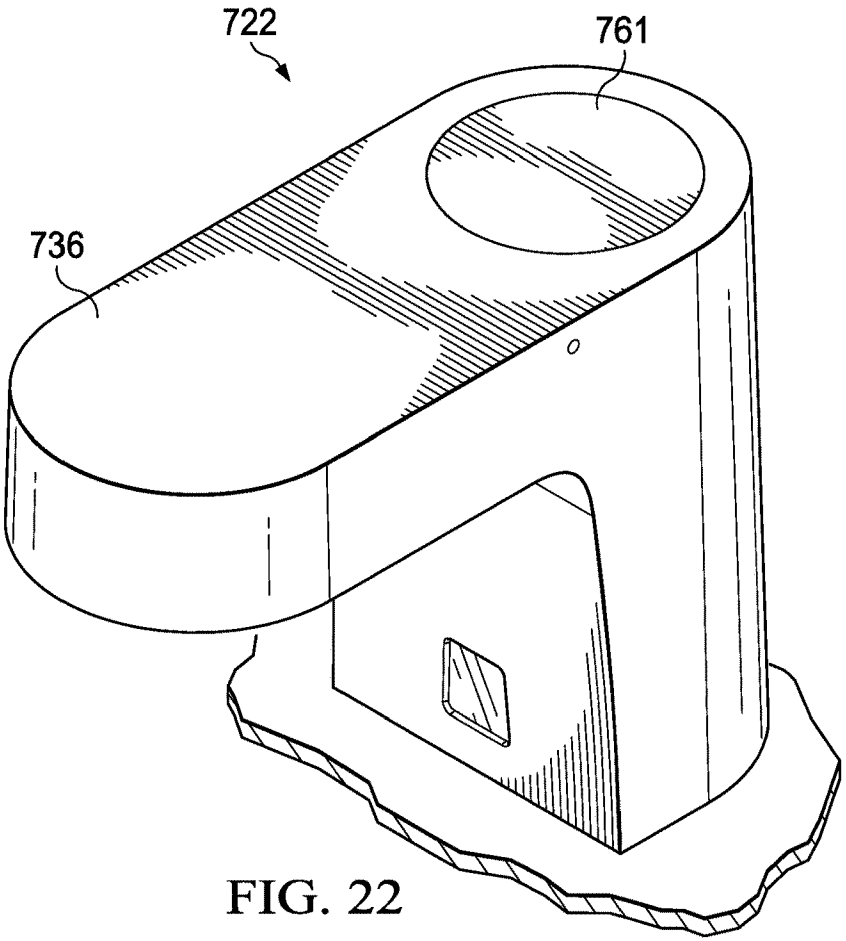
FIG. 22 is a perspective view depicting a fluid dispenser according to yet another embodiment, wherein a lid of the fluid dispenser is shown in a closed position.

FIGS. 22 and 23 illustrate a fluid dispenser 722 according to another embodiment. The fluid dispenser 722 illustrated in FIGS. 22 and 23 can be similar to, or the same in many respects as, the fluid dispenser 22 shown in FIGS. 1-7. For example, the fluid dispenser 722 can comprise a refill port 752 (FIG. 23) that facilitates refilling of a reservoir (not shown) from the fluid dispenser 722. However, the fluid dispenser 722 can include a lid 761 that is releasably coupled with a housing 736 of the fluid dispenser 722 and that can be positioned in one of a closed position (FIG. 22) and an opened position (FIG. 23). When the lid 761 is in the closed position, the refill port 752 can be substantially concealed by the lid 761. When the lid 761 is pivoted to the opened position, the refill port 752 can be exposed and thus available to receive a refill cartridge (not shown).

Figure 24:
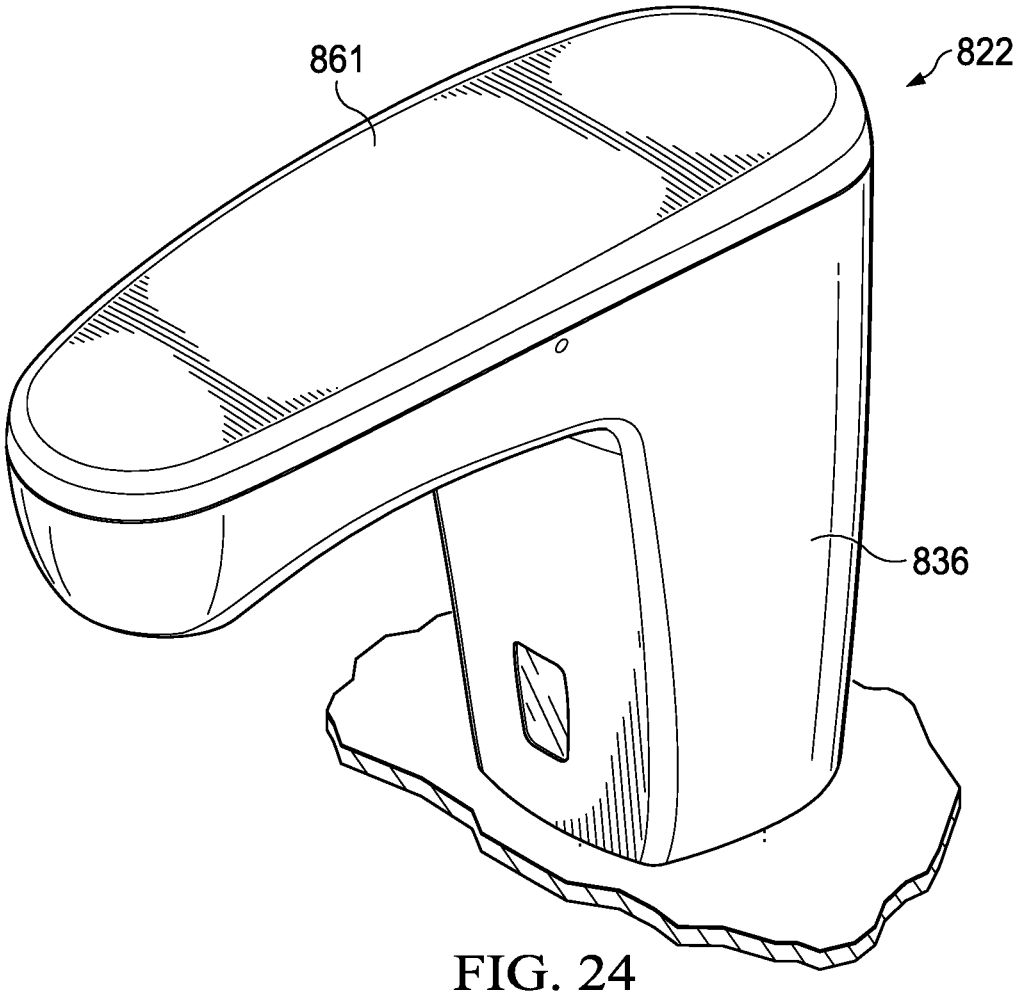
FIG. 24 is a perspective view depicting a fluid dispenser according to still yet another embodiment, wherein a lid of the fluid dispenser is shown in a closed position.
Figure 25:
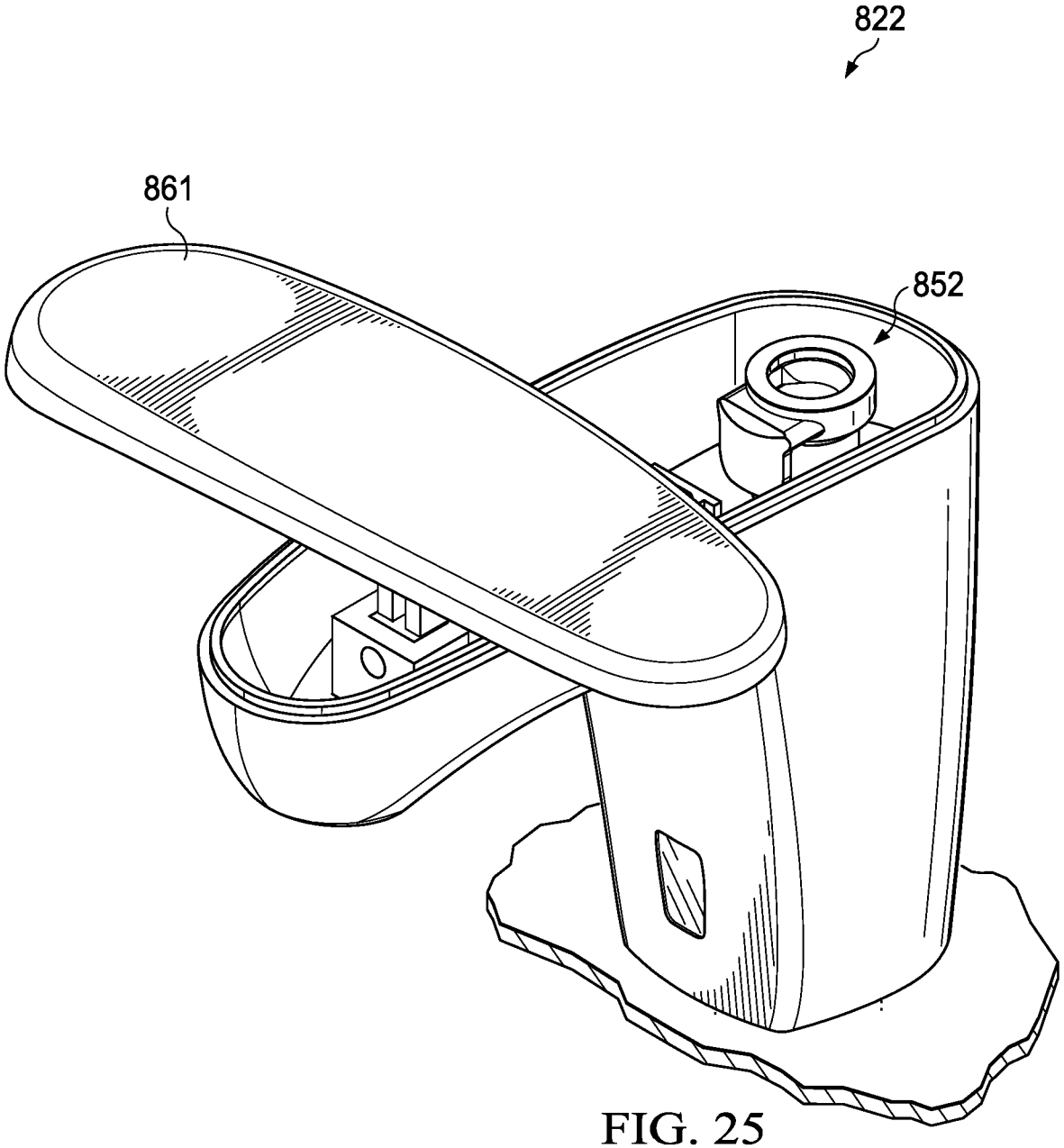
FIG. 25 is a perspective view depicting the fluid dispenser of FIG. 24, but with the lid shown in an opened position.

FIGS. 24 and 25 illustrate a fluid dispenser 822 according to another embodiment. The fluid dispenser 822 illustrated in FIGS. 24 and 25 can be similar to, or the same in many respects as, the fluid dispenser 22 shown in FIGS. 1-7. For example, the fluid dispenser 822 can comprise a refill port 852 (FIG. 25) that facilitates refilling of a reservoir (not shown) from the fluid dispenser 822. However, the fluid dispenser 822 can include a lid 861 that is pivotally coupled with a housing 836 of the fluid dispenser 822 and that is pivotable with respect to the housing 836 between a closed position (FIG. 24) and an opened position (FIG. 25). When the lid 861 is in the closed position, the refill port 852 can be substantially concealed by the lid 861. When the lid 861 is pivoted to the opened position, the refill port 852 can be exposed and thus available to receive a refill cartridge (not shown).

Figure 26:
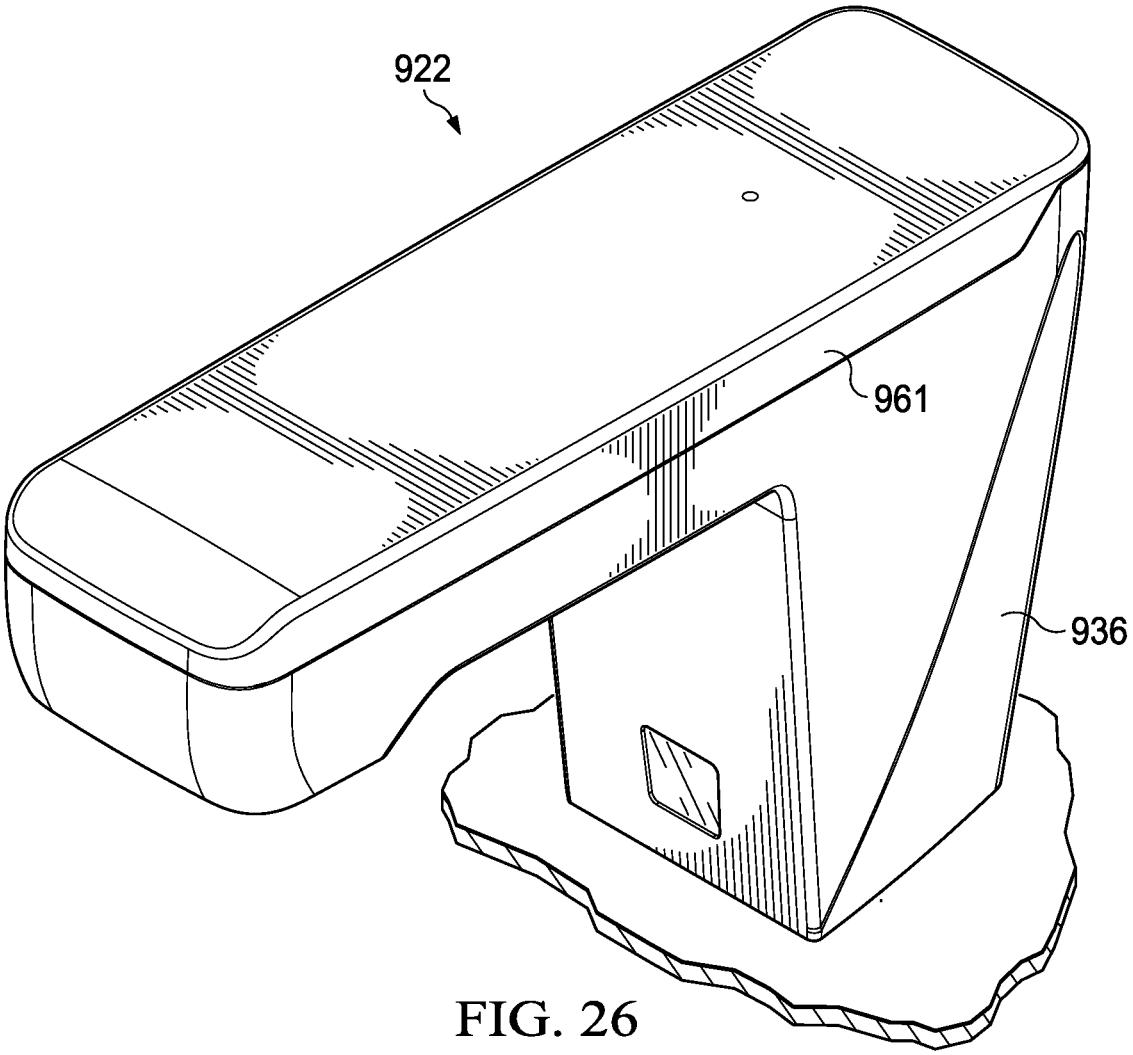
FIG. 26 is a perspective view depicting a fluid dispenser according to still yet another embodiment, wherein a lid of the fluid dispenser is shown in a closed position.
Figure 27:
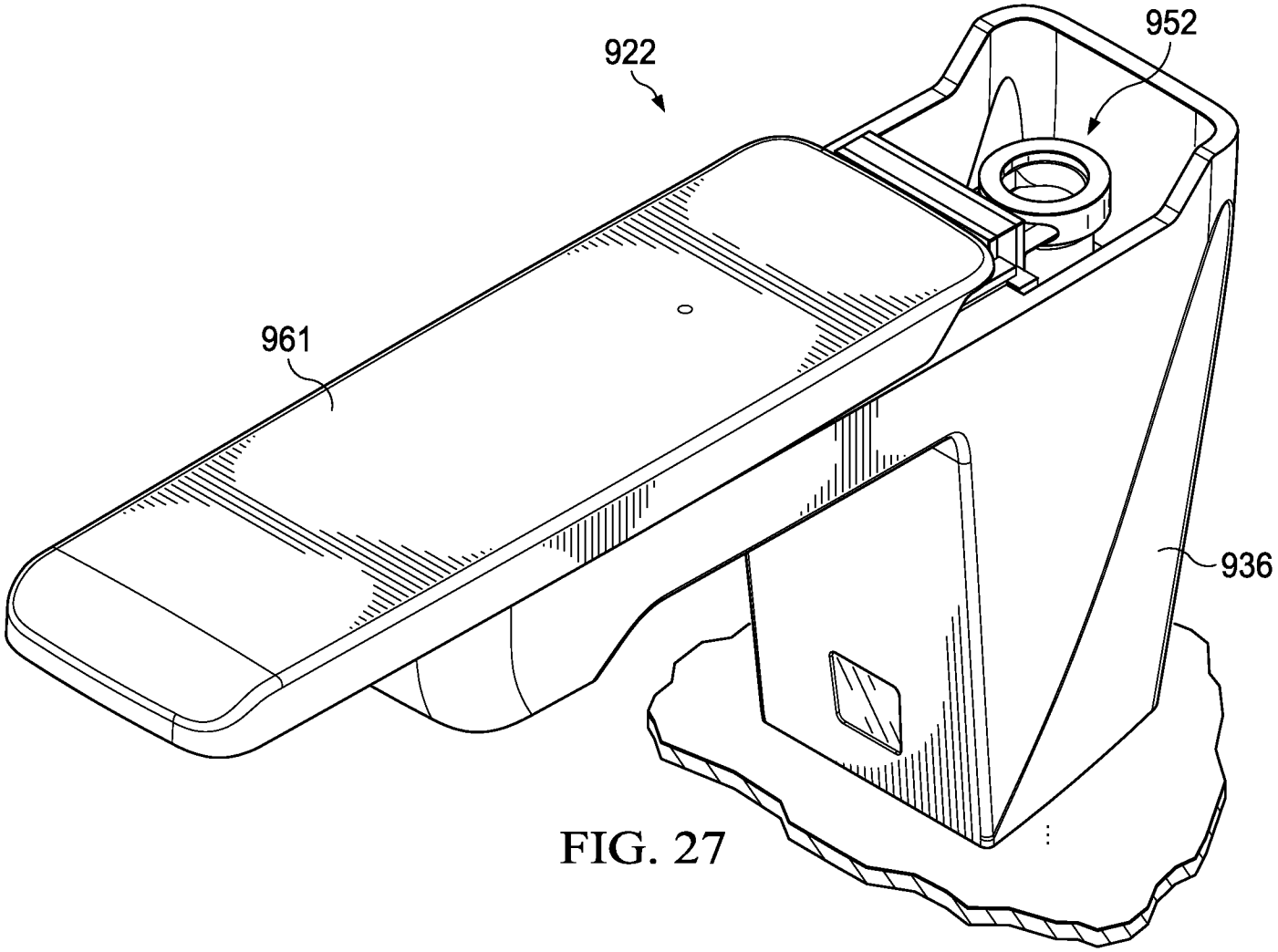
FIG. 27 is a perspective view depicting the fluid dispenser of FIG. 26, but with the lid shown in an opened position.

FIGS. 26 and 27 illustrate a fluid dispenser 922 according to another embodiment. The fluid dispenser 922 illustrated in FIGS. 26 and 27 can be similar to, or the same in many respects as, the fluid dispenser 822 shown in FIGS. 24 and 25. For example, the fluid dispenser 922 can comprise a refill port 952 (FIG. 27) that facilitates refilling of a reservoir (not shown) from the fluid dispenser 922. However, the fluid dispenser 922 can include a lid 2060 that is slidably coupled with a housing 936 of the fluid dispenser 922 and that is slidable with respect to the housing 936 between a closed position (FIG. 26) and an opened position (FIG. 27).

Figure 28:
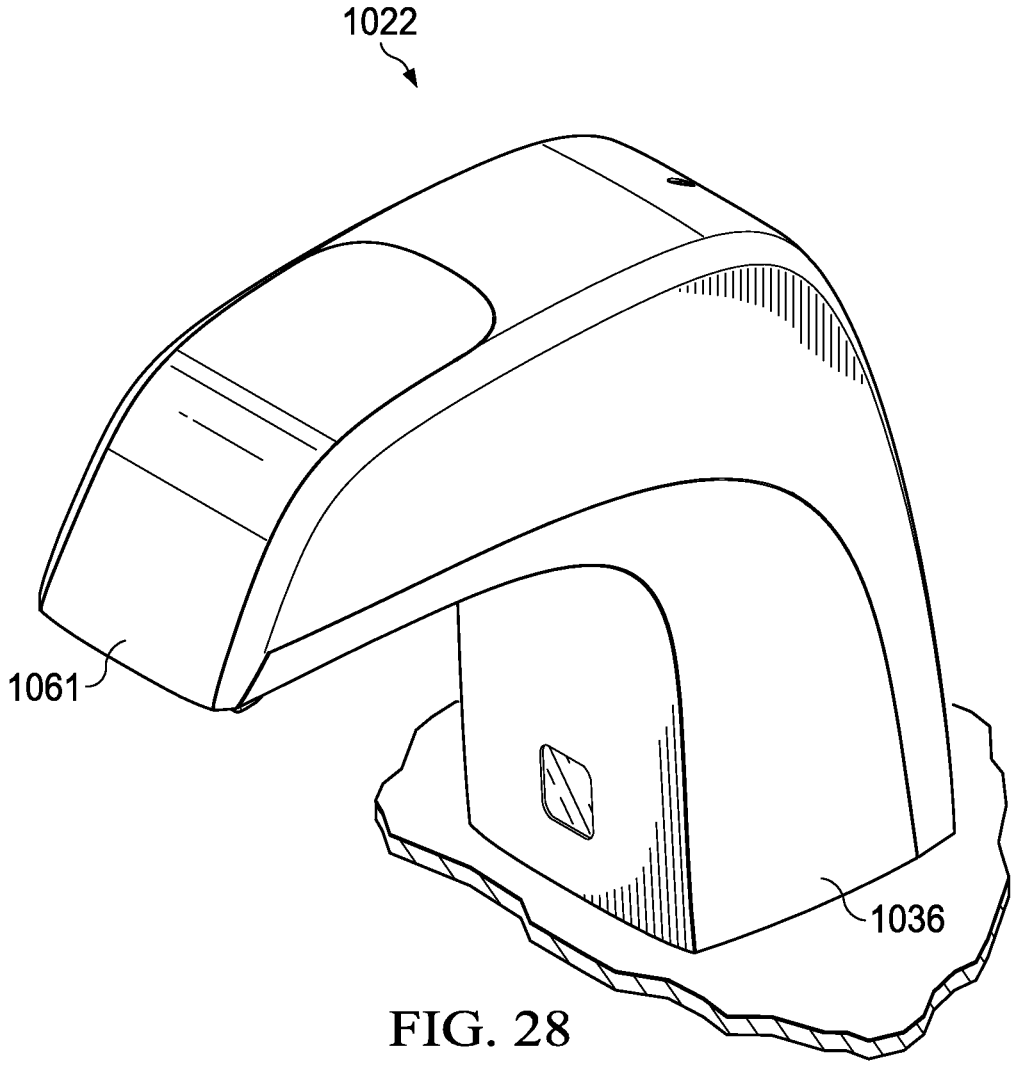
FIG. 28 is a perspective view depicting a fluid dispenser according to still yet another embodiment, wherein a lid of the fluid dispenser is shown in a closed position.
Figure 29:
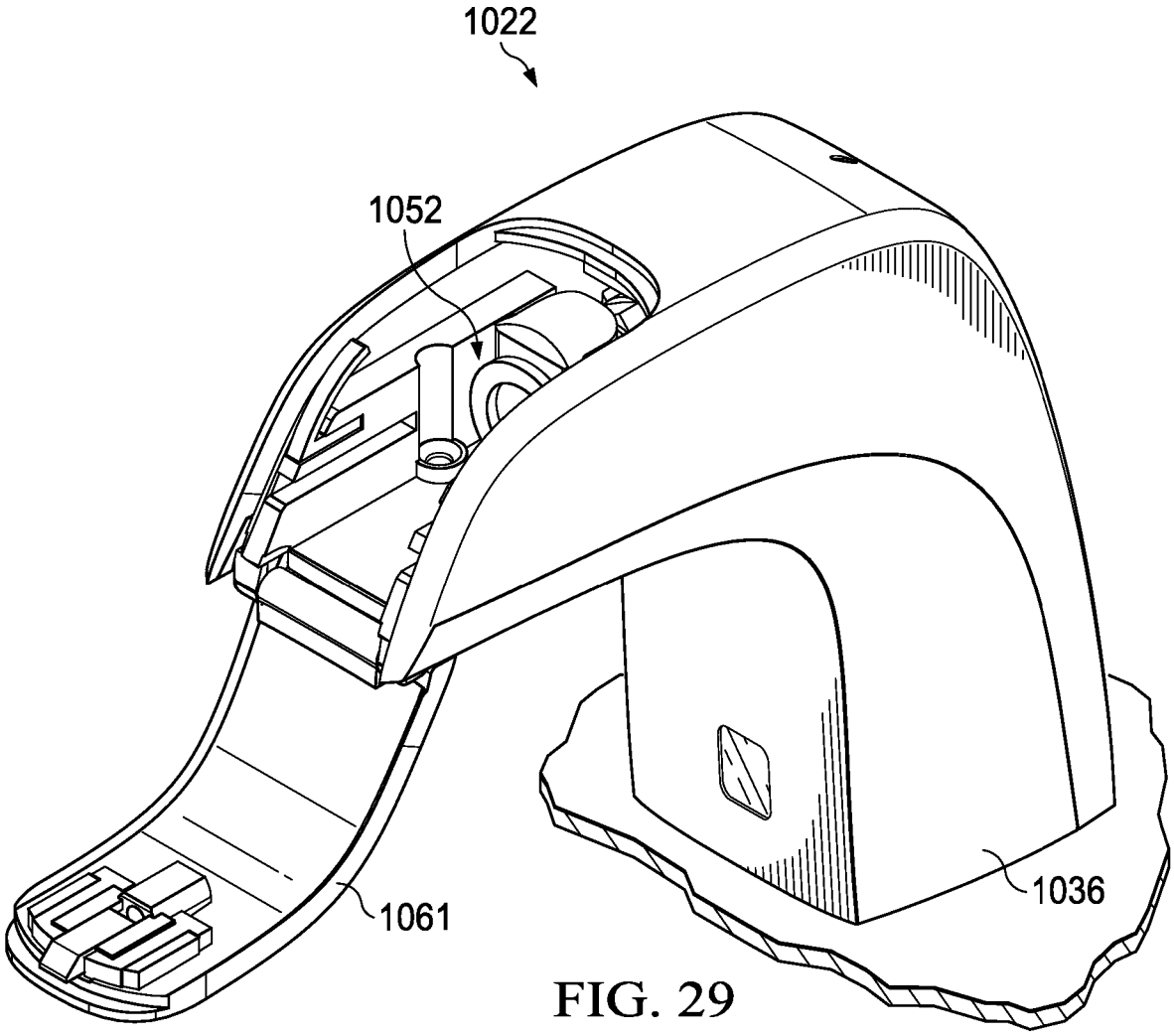
FIG. 29 is a perspective view depicting the fluid dispenser of FIG. 28, but with the lid shown in an opened position.

FIGS. 28 and 29 illustrate a fluid dispenser 1022 according to another embodiment. The fluid dispenser 1022 illustrated in FIGS. 28 and 29 can be similar to, or the same in many respects as, the fluid dispenser 822 shown in FIGS. 24 and 25. For example, the fluid dispenser 1022 can comprise a refill port 1052 (FIG. 29) that facilitates refilling of a reservoir (not shown) from the fluid dispenser 1022. However, the fluid dispenser 1022 can include a lid 1061 that is pivotally coupled with a housing 1036 of the fluid dispenser 1022 and that is pivotable with respect to the housing 1036 between a closed position (FIG. 28) and an opened position (FIG. 29).

Figure 30:
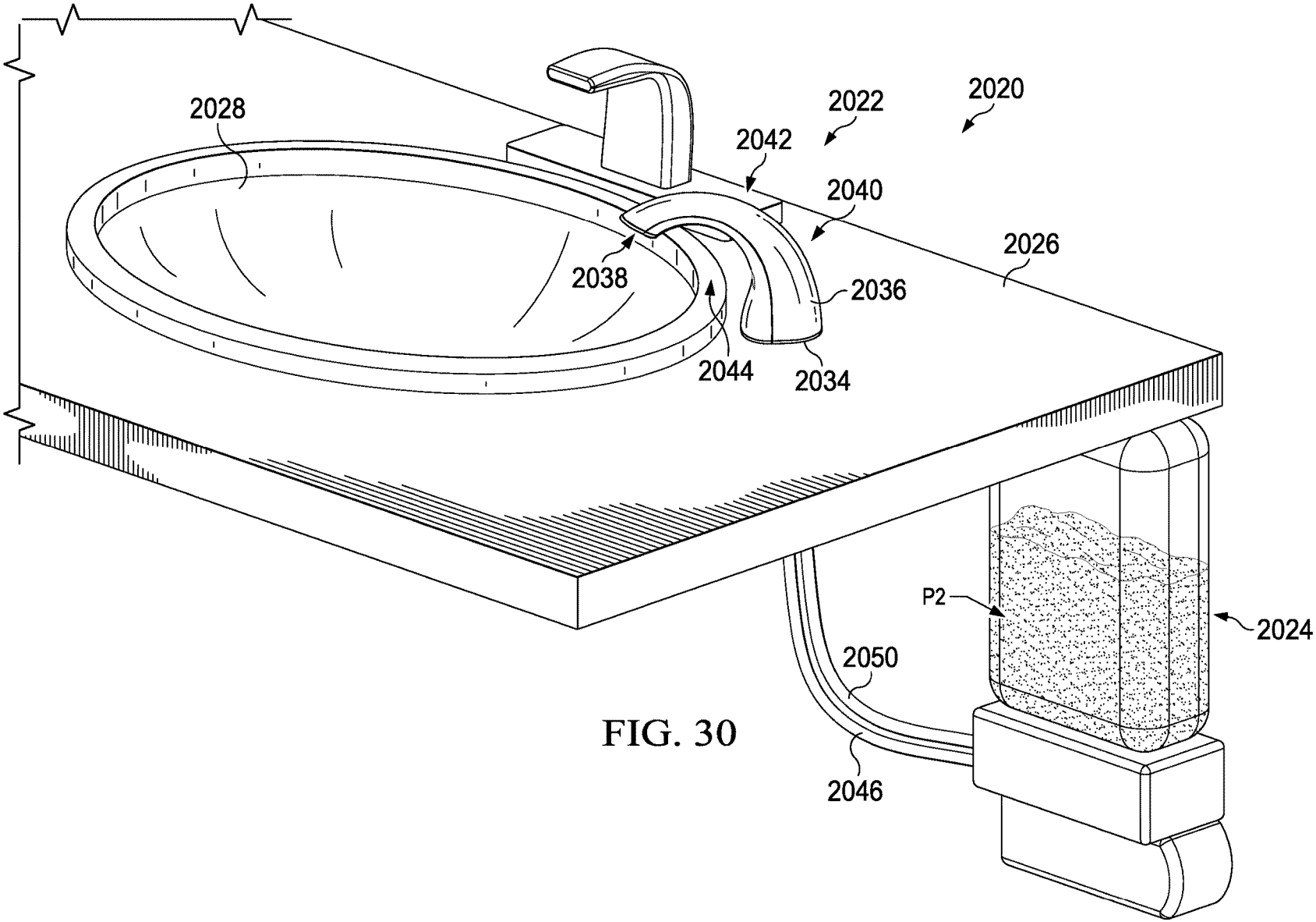
FIG. 30 is an environmental view depicting a fluid dispensing system that includes a fluid dispenser according to another embodiment, wherein the fluid dispensing system is in association with a sink and a countertop.
Figure 31:
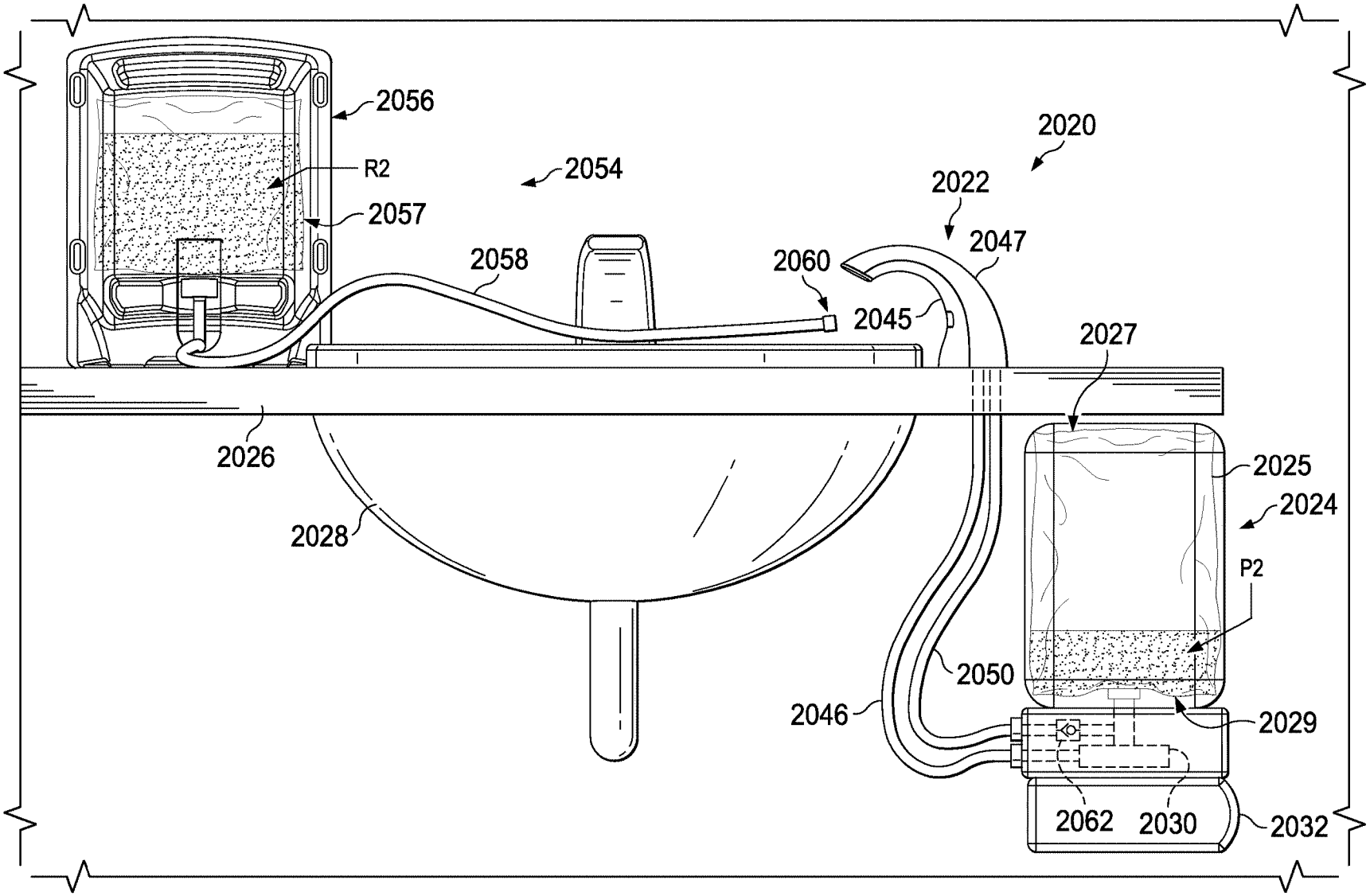
FIG. 31 is a front view depicting the fluid dispensing system of FIG. 30 in association with a fluid refill system according to another embodiment, wherein a storage reservoir is shown substantially depleted.
Figure 32:
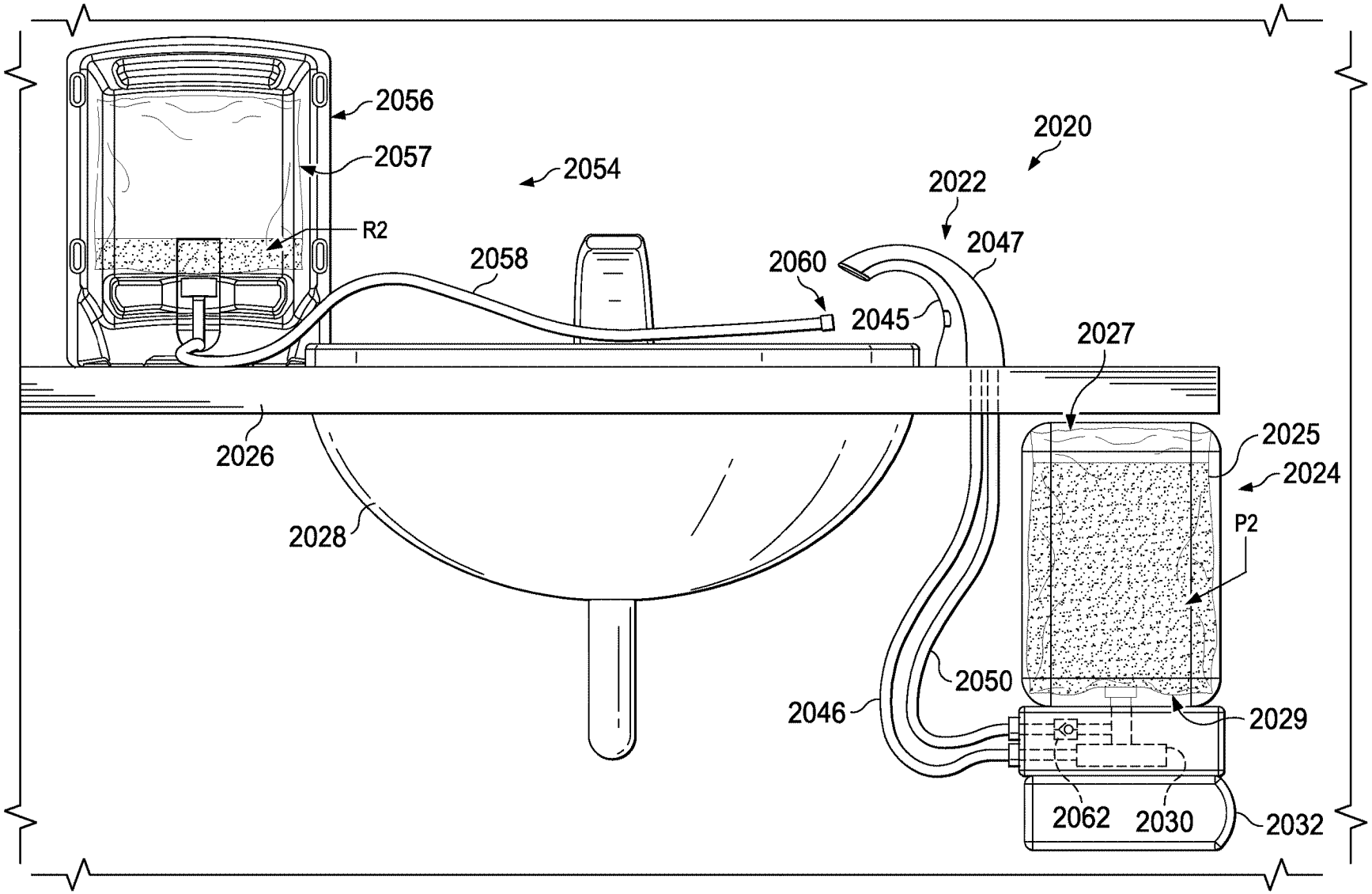
FIG. 32 is a front view depicting the fluid dispensing system and the fluid refill system of FIG. 31, but with the storage reservoir shown substantially full.

FIGS. 30-32 illustrate a fluid dispensing system 2020 according to another embodiment. The fluid dispensing system has a fluid dispenser 2022 (e.g., a spout) and a fluid storage unit 2024 having a storage reservoir 2025. The storage reservoir 2025 can have an upper end 2027 and a lower end 2029. The fluid dispenser 2022 can be in fluid communication with the storage reservoir 2025. A product P2 can be contained within the fluid storage unit 2024 and can be selectively dispensed from the fluid dispenser 2022 to a user's hands when positioned beneath the fluid dispenser 2022. The product P2 can be a generally flowable material, such as, for example, soap, sanitizer, or lotion and can be dispensed in liquid form, gel form, or foam form.

As illustrated in FIGS. 30 and 31, the fluid dispenser 2022 can be mounted above a countertop 2026 and adjacent to a sink 2028, and the fluid storage unit 2024 can be mounted below the countertop 2026, such as, for example, to the countertop 2026 or an adjacent wall. The fluid storage unit 2024 can accordingly be substantially obscured from view, thereby contributing to the overall aesthetics of the fluid dispensing system 2020. It is to be appreciated that while the storage reservoir 2025 is shown to be a bag-type arrangement, any of a variety of other suitable rigid or flexible fluid storage arrangements are contemplated such as, for example, a bottle arrangement.

The fluid dispensing system 2020 can be provided for use in any number of suitable environments, such as a restroom or a kitchen. The location of the fluid dispensing system 2020 can depend on the type of fluid being dispensed. For example, a fluid dispensing system for dispensing hand sanitizer can be provided within a restroom, but away from a sink, or at an office workstation or cubicle. It is also to be appreciated that, although the fluid storage unit 2024 is shown and described as being located remotely from the fluid dispenser 2022, any of a variety of suitable alternative fluid dispenser systems can be provided for dispensing fluid to a user's hands, such as, for example, a wall mounted, fluid dispenser having a self-contained reservoir.

As illustrated in FIG. 31, a pump 2030 and a motor 2032 can be associated with the fluid storage unit 2024 and can cooperate to facilitate dispensation of the product P2 from the fluid dispenser 2022. The pump 2030 and motor 2032 can be located together with the fluid storage unit 2024 such that the pump 2030 and motor 2032 are also obscured from view.

As illustrated in FIG. 32, the fluid dispenser 2022 can include a base 2034 and a housing 2036. The base 2034 can be releasably attached to the countertop 2026, and the housing 2036 can be releasably attached to the base 2034 to facilitate coupling of fluid dispenser 2022 to the countertop 2026. The housing 2036 can include a front end 2038, a rear end 2040, a top portion 2042, and a bottom portion 2044. The housing 2036 can further include a lower exterior surface 2045 and an upper exterior surface 2047, as illustrated in FIG. 31. The lower exterior surface 2045 can extend from the front end 2038 of the housing 2036 to the base 2034 and can be more proximate to the sink 2028 than an upper exterior surface 2047 of the housing 2036.

Figure 34:
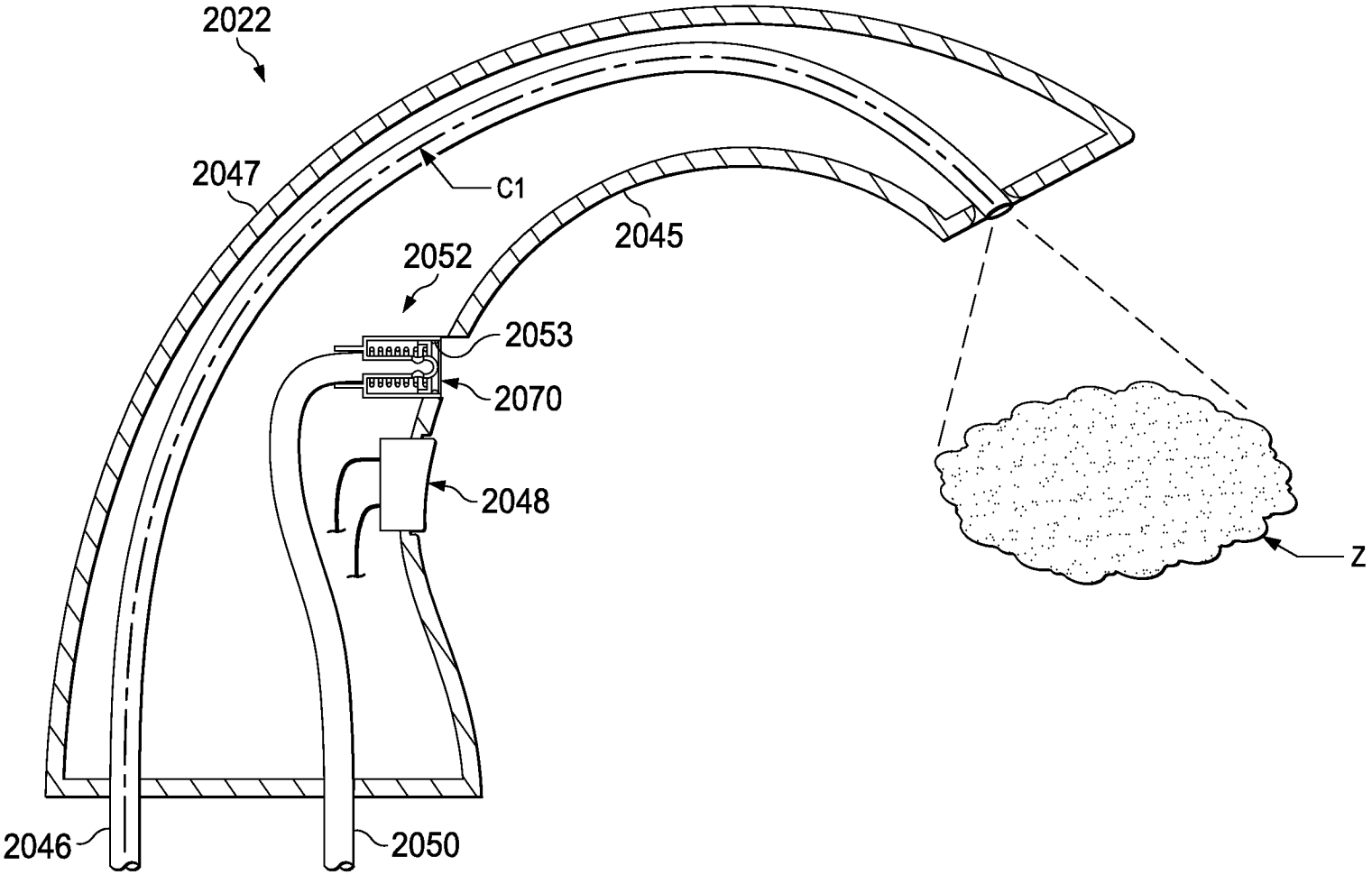
FIG. 34 is a sectional view taken along the section line 34-34 in FIG. 33.

As further illustrated in FIGS. 30 and 31, the fluid dispenser 2022 can include a dispensation conduit 2046 that is configured for dispensing the product P2 therethrough. The dispensation conduit 2046 can be routed through the housing 2036 of the fluid dispenser 2022 to the front end 2038. The dispensation conduit 2046 can define a centerline C1 (FIG. 34). The dispensation conduit 2046 can be in fluid communication with the pump 2030. When a user's hands are placed under the fluid dispenser 2022, the motor 2032 can operate the pump 2030 to dispense the product P2 from the fluid storage unit 2024 through the dispensation conduit 2046 to a user's hands placed underneath the fluid dispenser 2022 at the front end 2038. It is to be appreciated that in one embodiment a component described herein as being in fluid communication or fluidly coupled to another component should be understood to mean that the components are either in direct or indirect fluid communication/coupling.

Although the dispensation conduit 2046 is shown be a single conduit, it will be appreciated that any of a variety of suitable alternative conduit configurations are contemplated. When multiple conduits are employed, they can be separate and distinct (e.g., as arranged in a side-by-side relationship), or they can be arranged coaxially. Multiple dispenser conduits can be used, for example, to dispense product P2 in a form different from the form in which it exists in the fluid storage unit 2024. For example, product P2 can exist in the fluid storage unit 2024 as a liquid, but can be dispensed from the fluid dispenser 2022 as foam. In such an example, the fluid dispenser 2022 can include an air conduit (not shown) that is in fluid communication with the dispensation conduit 2046 via a manifold (not shown). The product P2 and air can be provided to the manifold to dispense foam from the fluid dispenser 2022. The manifold can include a mesh screen or other structure that can disperse and homogenize air bubbles throughout the product P.

The fluid dispensing system 2020 can include an activator which, when activated, facilitates dispensation of the product P2 from the dispensation conduit 2046. In one embodiment, as illustrated in FIGS. 30 and 32, the activator can include a proximity sensor 2048 that is in electrical communication with the motor 2032. The proximity sensor 2048 can detect the presence of a user's hands underneath the fluid dispenser 2022 and can facilitate operation of the motor 2032 to automatically dispense the product P2 from the fluid dispenser 2022. The proximity sensor 2048 can be an infrared sensor, a microwave sensor, an ultrasonic wave sensor, or any of a variety of suitable alternative proximity sensors. In another embodiment, the activator can be a contact-type sensor, such as, for example, a capacitive touch sensor or strain gauge. In yet another embodiment, the activator can be a mechanical actuator such as a lever that can be manually actuated to facilitate dispensation of the product P. The proximity sensor 2048 is shown to be installed generally centrally along the bottom portion 2044 of the fluid dispenser 2022 but it is to be appreciated that the proximity sensor 2048 can alternatively be installed at any of a variety of suitable locations, such as, for example, more proximate to the front end 2038 of the fluid dispenser 2022 or at a location separate from the fluid dispenser 2022.

Figure 33:
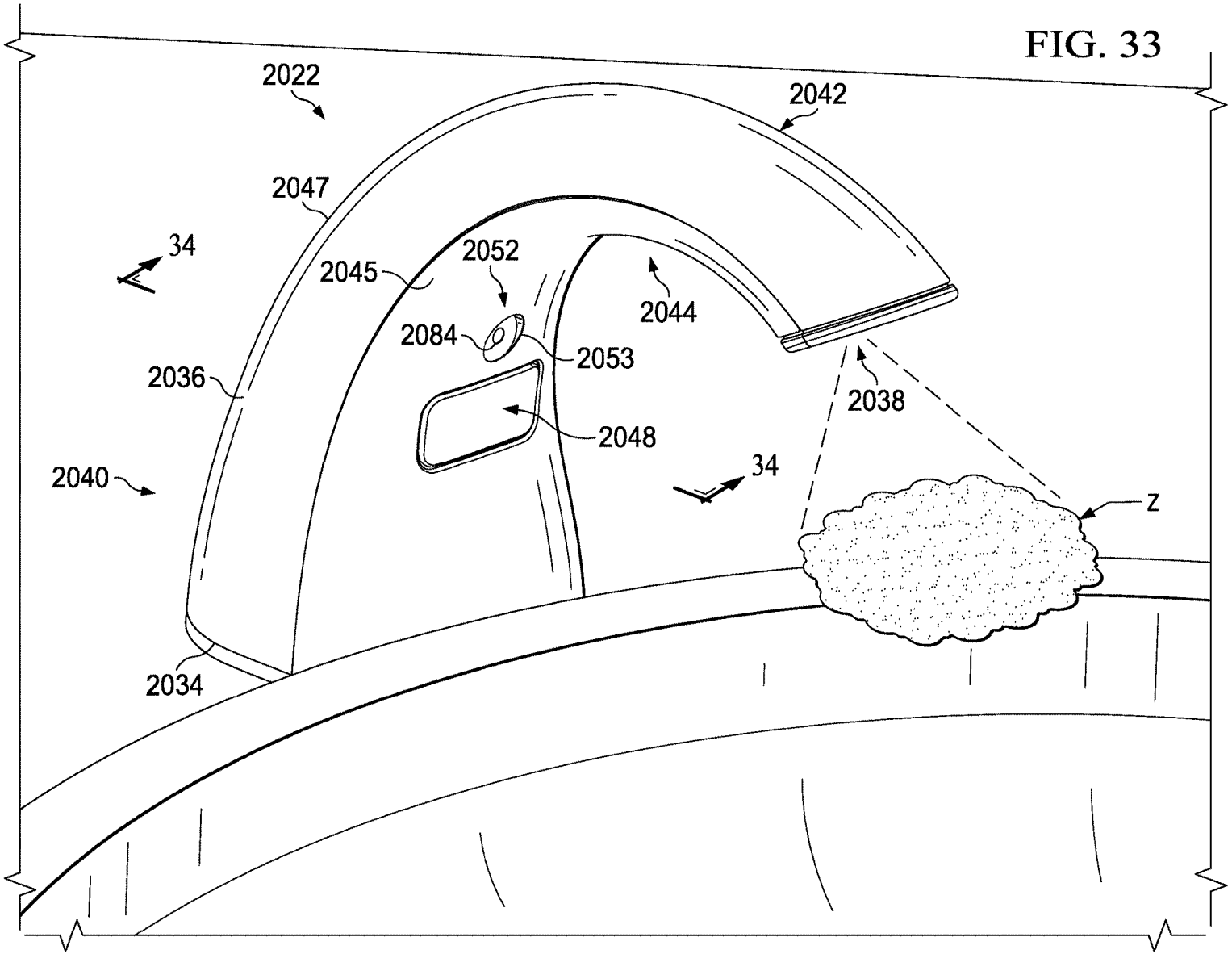
FIG. 33 is a front perspective view depicting the fluid dispenser of FIG. 30.

As illustrated in FIGS. 33 and 34, the fluid dispenser 2022 can include a refill conduit 2050 that is fluidly coupled with the fluid storage unit 2024, as illustrated in FIGS. 31 and 32. The refill conduit 2050 can include a refill port 2052 that defines an opening 2053. The refill conduit 2050 can facilitate refilling of the fluid storage unit 2024 with refill fluid from a fluid refill system 2054. The fluid refill system 2054 (see FIGS. 31 and 32) can comprise a refill unit 2056 having a refill reservoir 2057 and a refill distribution conduit 2058 in fluid communication with the refill reservoir 2057. The refill distribution conduit 2058 can have a distal end 2060 that is selectively insertable into the refill port 2052 to facilitate filling of the fluid storage unit 2024 with refill fluid R2 stored within the refill reservoir 2057. For example, when the fluid storage unit 2024 is substantially depleted, as illustrated in FIG. 31, the distal end 2060 of the refill distribution conduit 2058 can be connected to the refill port 2052 (e.g., by maintenance personnel) and the refill fluid R2 from the refill reservoir 2057 can flow through the refill conduit 2050 to fill the fluid storage unit 2024 with refill fluid R2, as illustrated in FIG. 32. In one embodiment, the refill reservoir 2057 can be a soft-sided cartridge. In such an embodiment, once the distal end 2060 of the refill distribution conduit 2058 is connected to the refill port 2052, the refill unit 2056 can be squeezed (e.g., either manually or electronically) to force the refill fluid R2 into the fluid storage unit 2024. The refill reservoir 2057 can include a filtered vent (not shown) to allow filtered ambient air to be introduced into the refill reservoir 2057 to enhance the flow of refill fluid R2 into the fluid storage unit 2024. The refill fluid R2 and the product P2 can be the same or different.

Still referring to FIGS. 33 and 34, the dispensation conduit 2046 can define a dispensation zone Z for the product P2 at the front end 2038 of the housing 2036. The dispensation zone Z can be generally understood to mean any area adjacent the fluid dispenser 2022 where fluid can be received when dispensed from a distal end of the dispensation conduit 2046. The refill port 2052 can extend through the lower exterior surface 2045 with the opening 2053 of the refill port 2052 facing the dispensation zone Z. As such, the refill port 2052 can be generally accessible underneath the front end 2038 of the housing 2036. Locating the refill port 2052 in this general area can at least partially conceal the refill port 2052, thereby contributing to the overall aesthetic look of the fluid dispenser 2022. It is to be appreciated that the refill port 2052 can be located at any of a variety of suitable locations along the lower exterior surface 2045 of the housing 2036. For example, the refill port 2052 can be located proximate the front end 2038 with the opening 2053 facing towards the sink 2028.

It is to be appreciated that mounting of the refill port 2052 on the fluid dispenser 2022 can facilitate refilling of the fluid storage unit 2024 more effectively than certain conventional fluid dispenser arrangements. For example, accessing the fluid storage unit 2024 through the refill port 2052 can eliminate the need to directly access the fluid storage unit 2024 in order to replenish the product P, thereby reducing time and effort spent refilling the fluid storage unit 2024 and reducing the potential for spilling and leaking of the product P2 due to improper installation. In addition, the same fluid storage unit 2024 can be repeatedly refilled thereby reducing the amount of waste as compared to cartridge-type refill arrangements.

As illustrated in FIGS. 31 and 32, a check valve 2062 can be in fluid communication with each of the fluid storage unit 2024, the pump 2030, and the refill conduit 2050. The check valve 2062 can be upstream of the pump 2030 and downstream of the refill conduit 2050. The check valve 2062 can permit refill fluid R2 from the fluid refill system 2054 to be introduced into the fluid storage unit 2024 from the refill conduit 2050 and can prevent the product P2 in the storage reservoir 2025 from back flowing into the refill conduit 2050. By mounting the refill port 2052 on the fluid dispenser 2022, the fluid storage unit 2024 can be refilled more effectively than conventional fluid dispenser arrangements. For example, accessing the fluid storage unit 2024 through the refill port 2052 can eliminate the need to directly access the fluid storage unit 2024 in order replenish the product P, thereby reducing time and effort spent refilling the fluid storage unit 2024 and reducing the potential for spilling and leaking due to improper installation. In addition, the same fluid storage unit 2024 can be repeatedly refilled thereby reducing the amount of waste as compared to cartridge-type refill arrangements.

Figure 35:
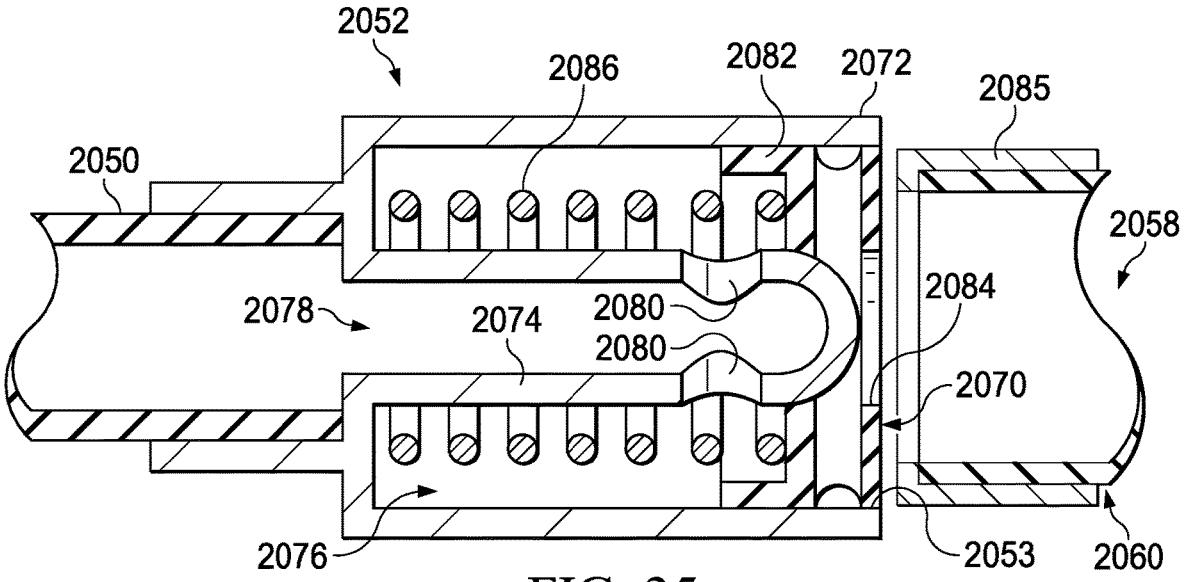
FIG. 35 is a sectional view depicting a refill port and a refill conduit of the fluid dispenser of FIG. 30, wherein a sealing member is shown in a closed position.
Figure 36:
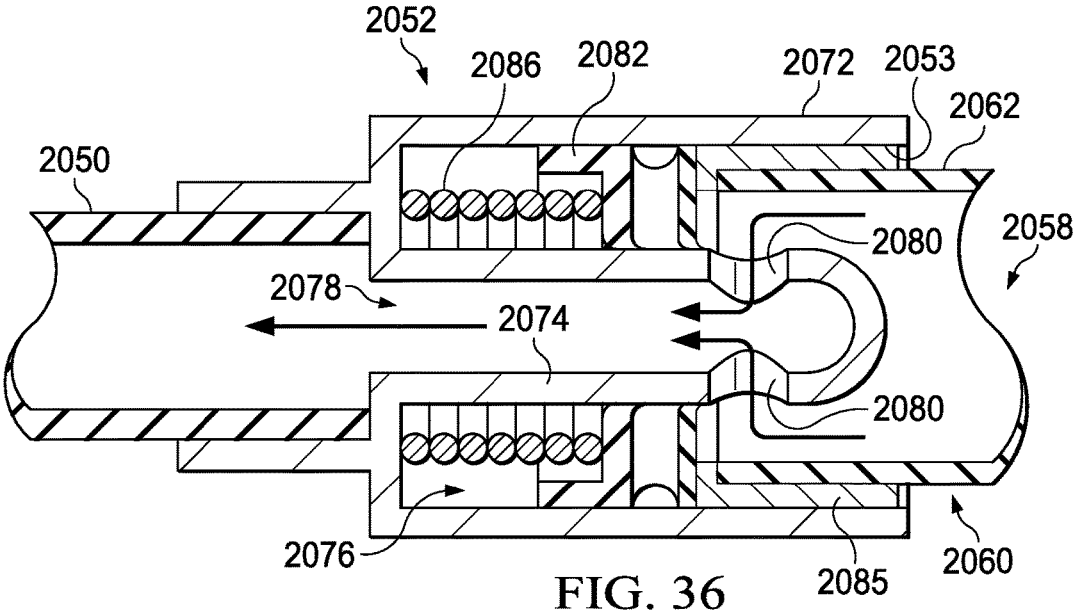
FIG. 36 is a sectional view depicting the refill port and refill conduit of FIG. 35, but with the sealing member urged into an opened position by a refill distribution conduit.

As illustrated in FIGS. 34-36, the refill port 2052 can include a refill valve 2070 having a housing 2072 that includes an internal needle 2074. The housing 2072 can define an external chamber 2076 and the internal needle 2074 can define an internal chamber 2078. The refill conduit 2050 can be coupled with the housing 2072 such that the internal chamber 2078 is in fluid communication with the refill conduit 2050. The internal needle 2074 can define a pair of apertures 2080 that facilitate fluid communication between the external chamber 2076 and the internal chamber 2078. The refill valve 2070 can also include a sealing member 2082 that is in sealing interaction with the housing 2072. The sealing member 2082 can define a central aperture 2084. The internal needle 2074 can extend through the central aperture 2084 of the sealing member 2082 such that the sealing member 2082 can surround the internal needle 2074 to create an effective seal therebetween as the sealing member 2082 is slid along the internal needle 2074.

The sealing member 2082 can be movable between a closed position, as illustrated in FIG. 35 and an opened position, as illustrated in FIG. 36. A spring 2086 can bias the sealing member 2082 into the closed position. When the sealing member 2082 is in the closed position, it can cooperate with the housing 2072 and the internal needle 2074 to substantially seal the external and internal chambers 2076, 2078 from the outside environment. When the refill distribution conduit 2058 is connected to the refill port 2052, the refill distribution conduit 2058 can urge the sealing member 2082 into the opened position and the internal needle 2074 can project into the refill distribution conduit 2058 such that the refill distribution conduit 2058 is in fluid communication with the internal chamber 2078. Refill fluid from the refill distribution conduit 2058 can accordingly flow through the pair of apertures 2080, though the internal chamber 2078, and to the refill conduit 2050 to facilitate refilling of the fluid storage unit 2024 (FIGS. 31 and 32).

The sealing member 2082 can engage the housing 2072 to create a sealed interface when the sealing member 2082 is in each of the closed position and the opened position. As a result, the external and internal chambers 2076, 2078 can remain substantially sealed from the outside environment irrespective of whether the refill distribution conduit 2058 is inserted in the housing 2072. The refill port 2052 is accordingly less prone to becoming contaminated with foreign substances, germs, and other contaminants than non-valved arrangements (e.g., such as fluid dispensers that are refillable through an integral funnel provided in the fluid dispenser and covered with a lid).

The refill port 2052 can be configured to receive and retain the distal end 2060 of the refill distribution conduit 2058 when the distal end 2060 is connected to the refill port 2052. In one embodiment, as illustrated in FIGS. 35 and 36, the distal end 2060 can include a collar 2085 that engages the housing 2072 in an interference fit to retain the distal end 2060 within the refill port 2052 and create an effective seal there between. As a result, fluid from the fluid refill system 2054 can be prevented from leaking from the refill port 2052 when the distal end 2060 of the refill distribution conduit 2058 is connected thereto.

It is to be appreciated that the refill port 2052 and the refill distribution conduit 2058 can be releasably and fluidically coupled together with any of a variety of suitable alternative arrangements and/or any of a variety of sealing arrangements. In some embodiments, the refill port 2052 can be configured to include a keyed connection or otherwise unique connection, which can prevent or deter unauthorized connection to the refill port 2052 (e.g., with an unauthorized refill distribution conduit 2058). The refill port 2052 can also be configured to include a locking mechanism to secure the refill distribution conduit 2058 to the refill port 2052 and ensure that the connection is not altered or prematurely terminated before the intended amount of product P2 has been transferred. It is to be appreciated that although the refill port 2052 is illustrated as extending generally horizontally from the fluid dispenser 2022, the refill port 2052 can be provided in various alternative locations, positions, and orientations on a fluid dispenser.

Figure 37:
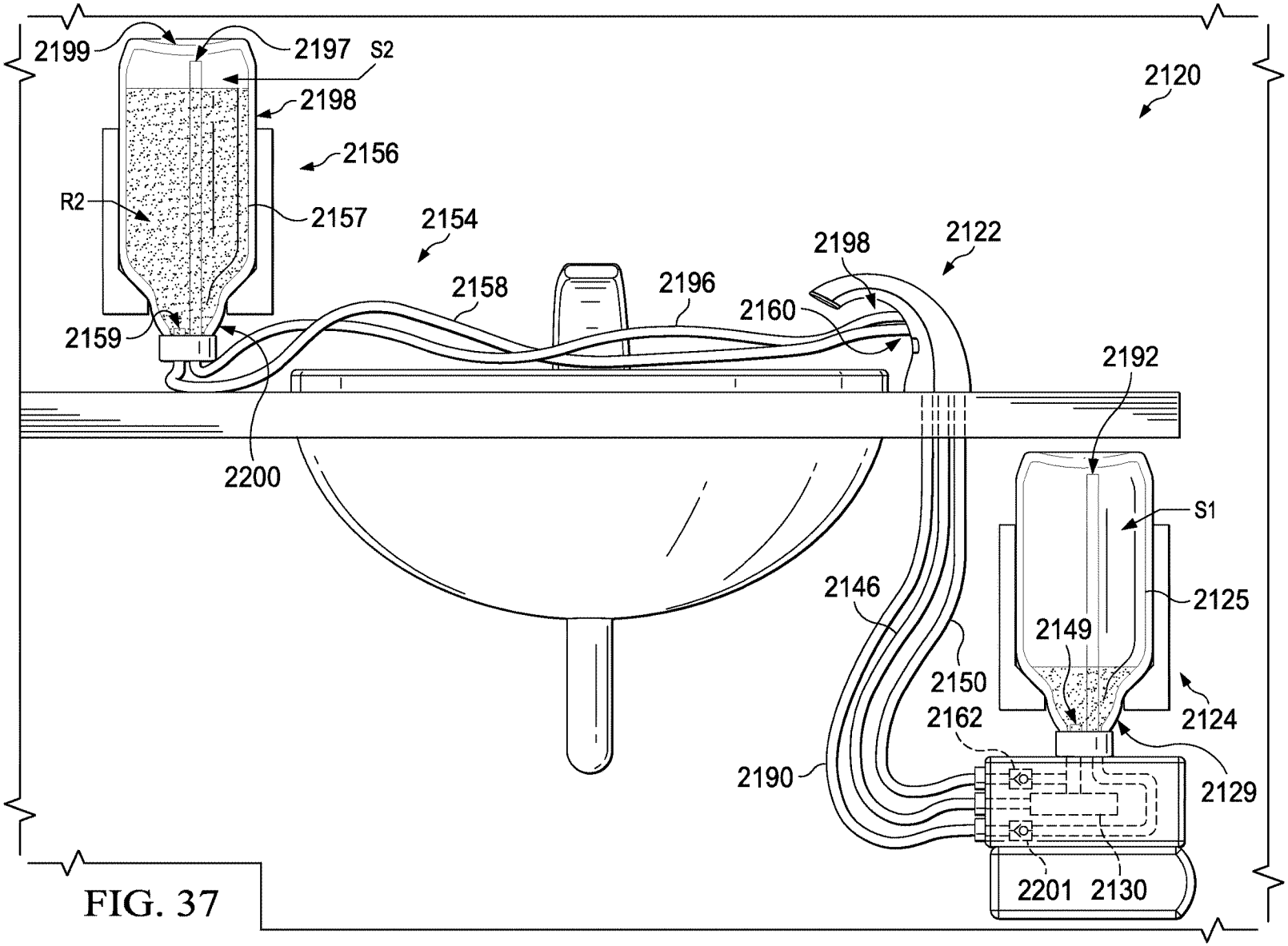
FIG. 37 is a front view depicting a fluid dispensing system in association with a fluid refill system according to another embodiment, wherein a storage reservoir is shown substantially depleted.
Figure 38:
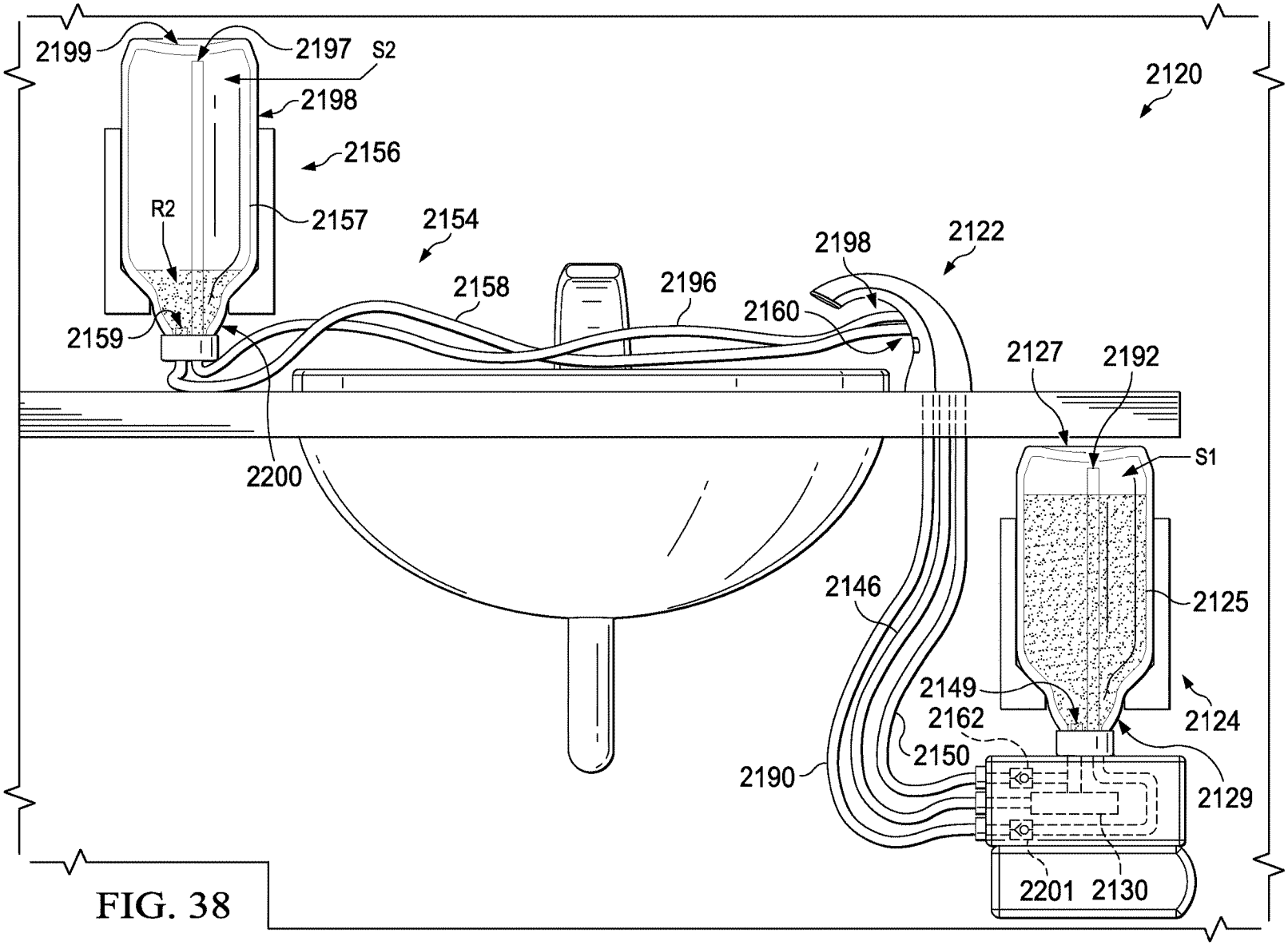
FIG. 38 is a front view depicting the fluid dispensing system and the fluid refill system of FIG. 37, but with the storage reservoir shown substantially full.
Figure 39:
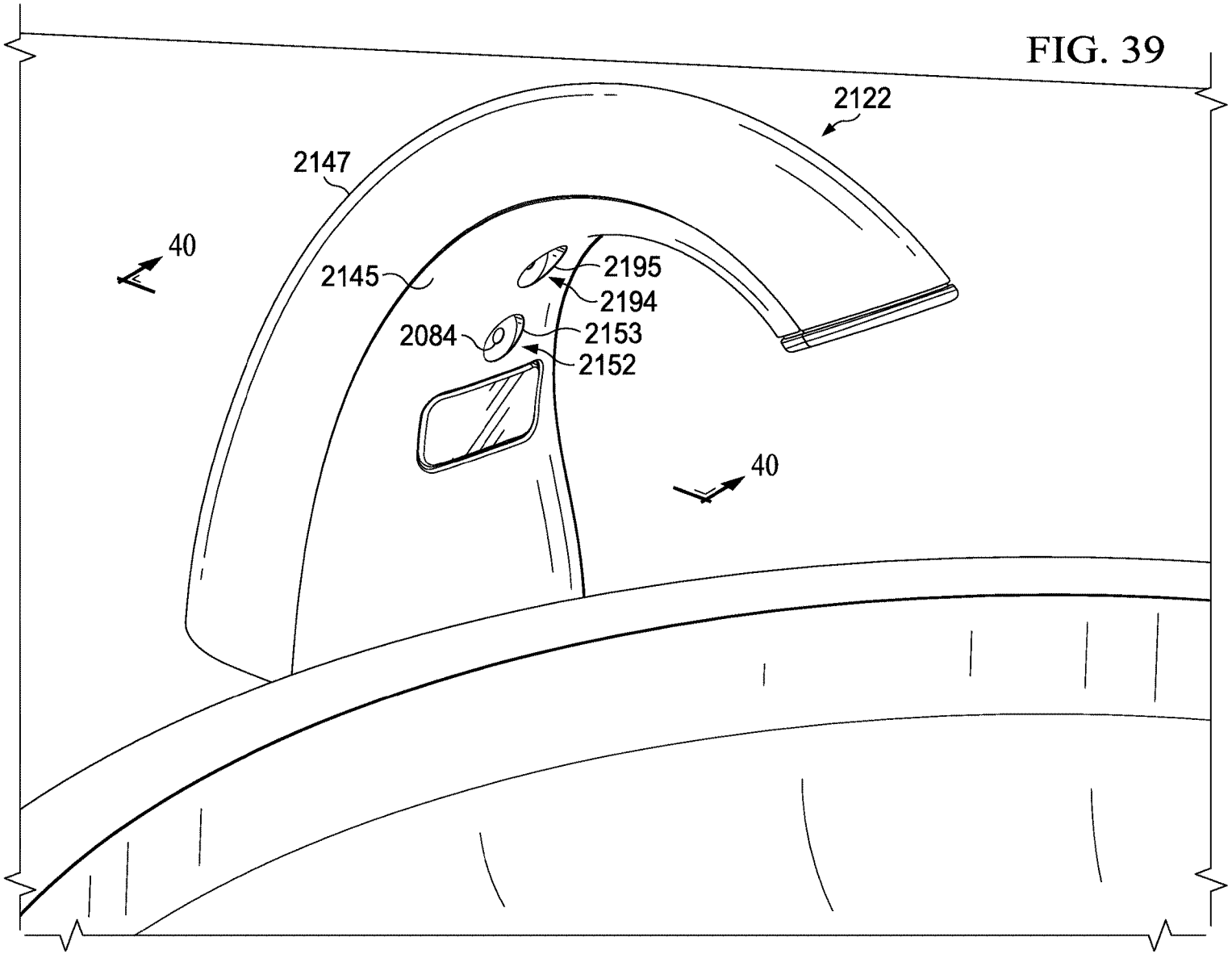
FIG. 39 is a front perspective view depicting a fluid dispenser of the fluid dispensing system of FIG. 38.
Figure 40:
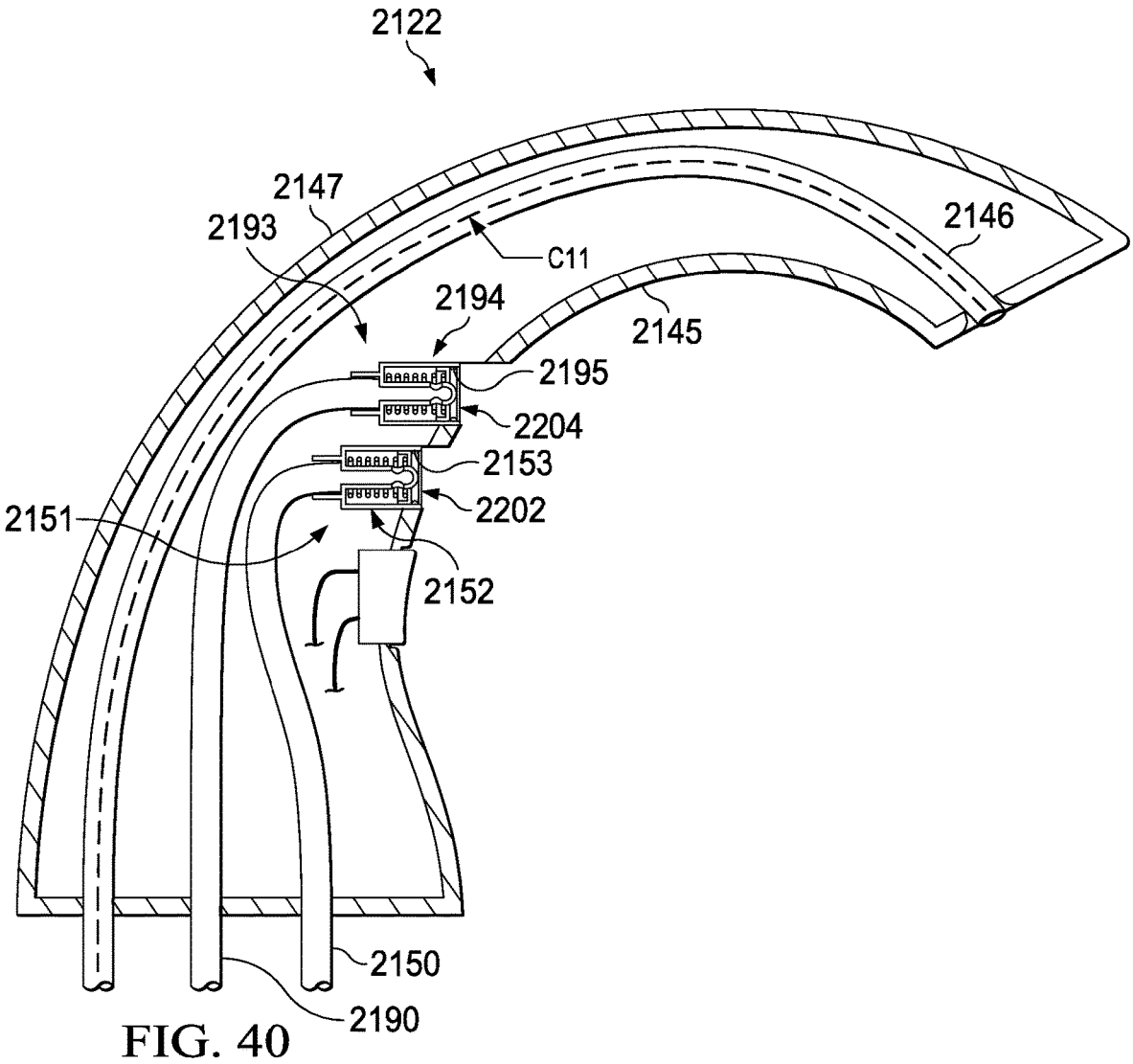
FIG. 40 is a sectional view taken along the section line 40-40 in FIG. 39.

FIGS. 37-40 illustrate a fluid dispensing system 2120 and a fluid refill system 2154 according to another embodiment. The fluid dispensing system 2120 and the fluid refill system 2154 illustrated in FIGS. 37-40 can be similar to, or the same in many respects as, the fluid dispensing system 2020 and the fluid refill system 2054, respectively shown in FIGS. 30-36. For example, the fluid dispensing system 2120 can include a fluid dispenser 2122, a fluid storage unit 2124, a storage reservoir 2125, a dispensation conduit 2146, a refill conduit 2150 and a refill port 2152. The fluid refill system 2154 can include a refill unit 2156 having a refill reservoir 2157 and a refill distribution conduit 2158. The fluid dispenser 2122 can include a lower exterior surface 2145 and an upper exterior surface 2147. The refill port 2152 can be disposed at a distal end 2151 of the refill conduit 2150 and can define an opening 2153. The dispensation conduit 2146 can define a centerline C11. However, the fluid dispensing system 2120 can include a storage vent conduit 2190, as illustrated in FIGS. 37, 38, and 40, having a proximal end 2192 that extends to an upper end 2127 of the storage reservoir 2125 such that the proximal end 2192 is in fluid communication with the upper end 2127 and thus in fluid communication with airspace S1 within the storage reservoir 2125. The dispensation conduit 2146 is shown to include a proximal end 2149 that is in fluid communication with a lower end 2129 of the storage reservoir 2125 and thus in fluid communication with the product P1 within the storage reservoir 2125. In one embodiment, as illustrated in FIGS. 37 and 38, the proximal end 2192 of the storage vent conduit 2190 can be more proximate to the upper end 2127 of the storage reservoir 2125 than to the lower end 2129 of the storage reservoir 2125. The proximal end 2149 of the dispensation conduit 2146 can be more proximate to the lower end 2129 of the storage reservoir 2125 than to the upper end 2127 of the storage reservoir 2125.

Referring now to FIGS. 39 and 40, the storage vent conduit 2190 can include a distal end 2193 and a storage vent port 2194 disposed at the distal end 2193. The storage vent port 2194 can be similar to, or the same in many respects as, the refill port 52 illustrated in FIGS. 30-36. For example, the storage vent port 2194 can define an opening 2195. The refill port 2152 and the storage vent conduit 2190 can extend through the lower exterior surface 2145 with the respective openings 2153, 2195 facing the dispensation zone (e.g., Z in FIGS. 33 and 34).

Referring again to FIGS. 37 and 38, the refill unit 2156 can include a refill vent conduit 2196 having a proximal end 2197 and a distal end 2198. The proximal end 2197 can extend to an upper end 2199 of the refill reservoir 2157 such that the proximal end 2197 is in fluid communication with the upper end 2199 and thus in fluid communication with airspace A2 within the refill reservoir 2157. The refill distribution conduit 2158 is shown to include a proximal end 2159 that is in fluid communication with a lower end 2200 of the refill reservoir 2157 and thus in fluid communication with the refill product R2 within the refill reservoir 2157. In one embodiment, as illustrated in FIGS. 37 and 38, the proximal end 2197 of the refill vent conduit 2196 can be more proximate to the upper end 2199 of the refill reservoir 2157 than to the lower end 2200 of the refill reservoir 2157. The proximal end 2159 of the refill distribution conduit 2158 can be more proximate to the lower end 2200 of the refill reservoir 2157 than to the upper end 2199 of the refill reservoir 2157.

The distal end 2198 of the refill vent conduit 2196 can be selectively insertable into the storage vent port 2194 to facilitate exchange of air between the fluid storage unit 2124 and the refill reservoir 2157 during refilling of the fluid storage unit 2124 with refill fluid R2 from the refill unit 2156. For example, when the fluid storage unit 2124 is substantially depleted, as illustrated in FIG. 8, the distal ends 2160, 2198 of the refill distribution conduit 2158 and the refill vent conduit 2196 can be connected to the refill port 2152 and the storage vent port 2194, respectively. As the refill fluid R2 from the refill unit 2156 flows through the refill conduit 2150 to fill the fluid storage unit 2124 with refill fluid R2, air from the airspace S1 of the fluid storage unit 2124 can be forced through the storage vent conduit 2190, through the refill vent conduit 2196, and into the airspace A2 of the refill reservoir 2157 until the fluid storage unit 2124 is substantially full, as illustrated in FIG. 38.

In one embodiment, as illustrated in FIGS. 37 and 38, the refill unit 2156 can be a hard-sided bottle. In such an embodiment, once the distal ends 2160, 2198 of the refill distribution conduit 2158 and the refill vent conduit 2196 are connected to the refill port 2150 and the storage vent port 2194, the refill fluid R2 from the refill unit 2156 can be gravity fed into the fluid storage unit 2124 without the need to squeeze the refill unit 2156. It is to be appreciated that the exchange of air between the fluid storage unit 2124 and the refill unit 2156 can prevent ambient air from being introduced into the fluid storage unit 2124 during refilling and contaminating the fluid with foreign substances, germs, or other contaminants.

Referring still to FIGS. 37 and 38, a check valve 2162 can be in fluid communication with each of the fluid storage unit 2124, a pump 2130, and the refill conduit 2150. In addition, another check valve 2201 can be in fluid communication with the storage vent conduit 2190 and can permit vent air from back flowing from the refill unit 2156 and into the fluid storage unit 2124 (e.g., due to a siphoning effect).

Referring now to FIG. 40, the refill port 2152 and the storage vent port 2194 can include respective valves 2202, 2204 that are similar to, or the same in many respects as, the refill valve 2070 illustrated in FIGS. 30-36.

FIGS. 41-55 illustrate a fluid dispensing system 3120 and a fluid refill system 3154 according to another embodiment. The fluid dispensing system 3120 and the fluid refill system 3154 illustrated in FIGS. 41-55 can be similar to, or the same in many respects as, the fluid dispensing system 2020 and the fluid refill system 2054, respectively shown in FIGS. 37-40. For example, the fluid dispensing system 3120 can include a fluid dispenser 3122, a fluid storage unit (not shown), and a storage reservoir (not shown). As illustrated in FIGS. 42 and 43, the fluid dispenser 3122 can include a housing 3136, a dispensation conduit 3146, a refill conduit 3150, and a storage vent conduit 3190. The storage vent conduit 3190 can extend into the storage reservoir such that a proximal end (not shown) of the storage vent conduit 3190 is more proximate to an upper end of the storage reservoir than to a lower end of the storage reservoir. A proximal end 3149 of the refill conduit 3150 can be more proximate to the lower end of the storage reservoir than to the upper end of the storage reservoir.

Figure 41:
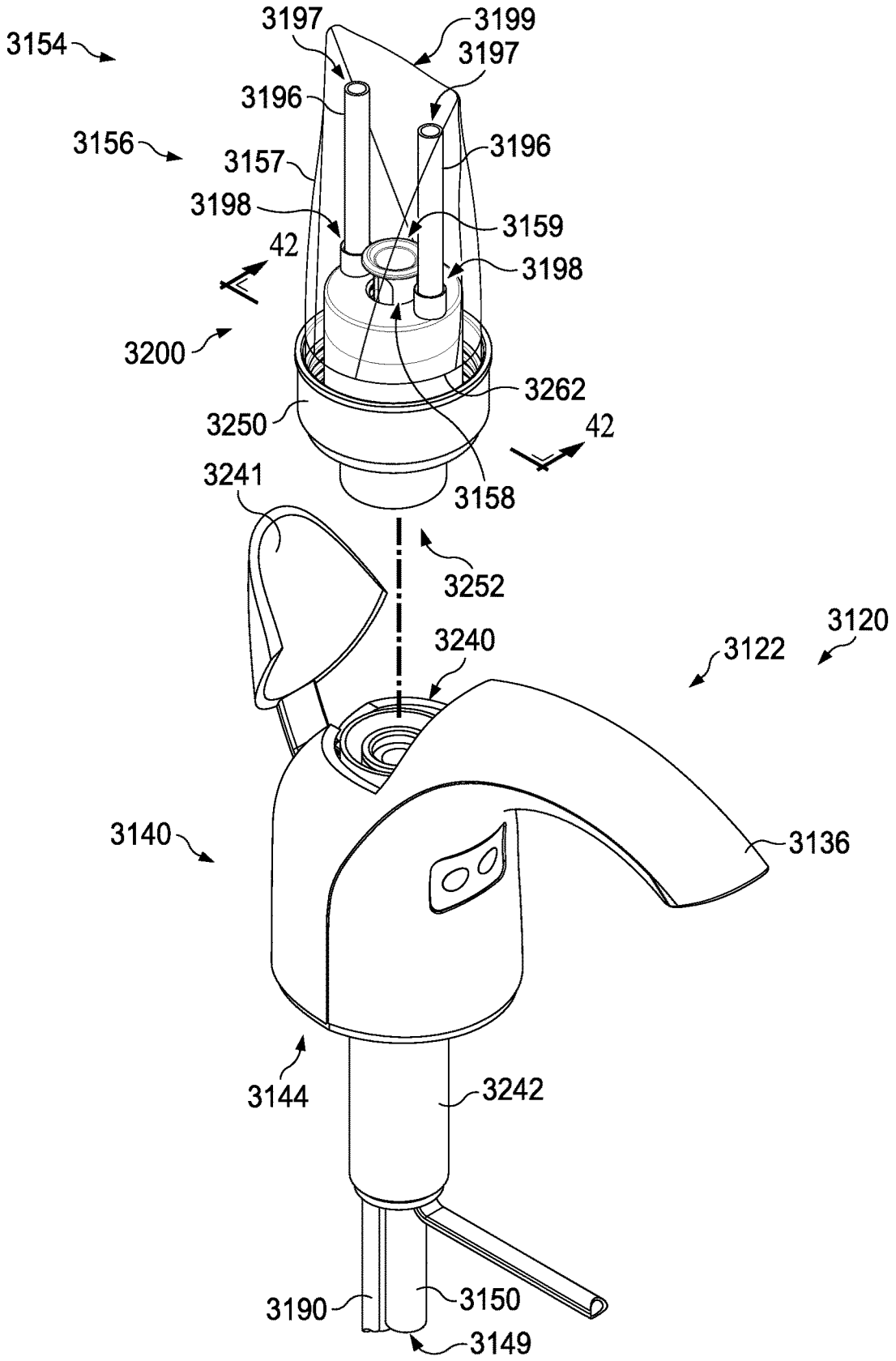
FIG. 41 is a front perspective view depicting a fluid dispenser in association with a refill unit, according to another embodiment, wherein the refill unit is shown to be uninstalled.
Figure 42:
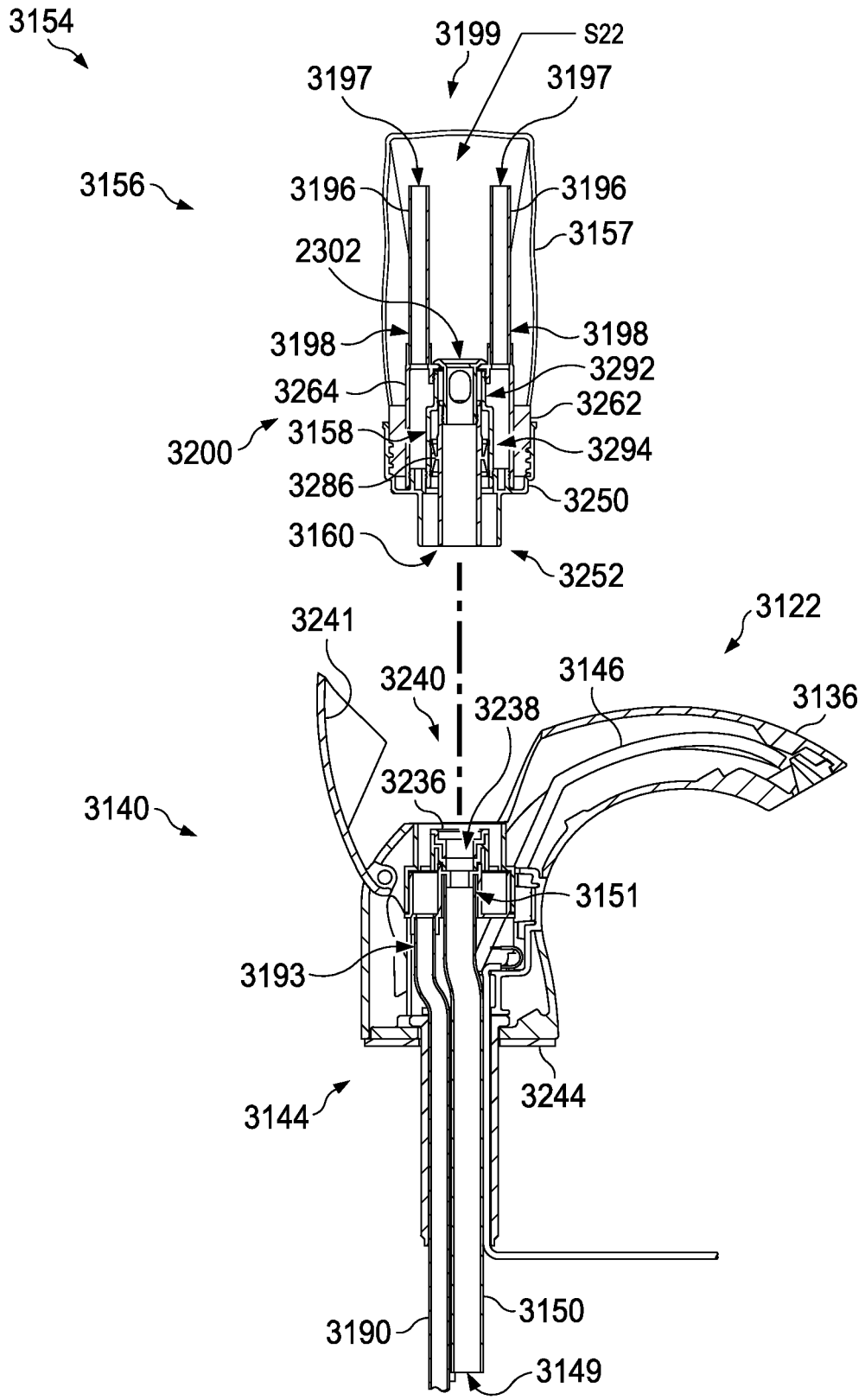
FIG. 42 is a sectional view taken along the section line 42-42 in FIG. 41, wherein a plunger and a tip member of the refill unit are shown to be in a released position.
Figure 43:
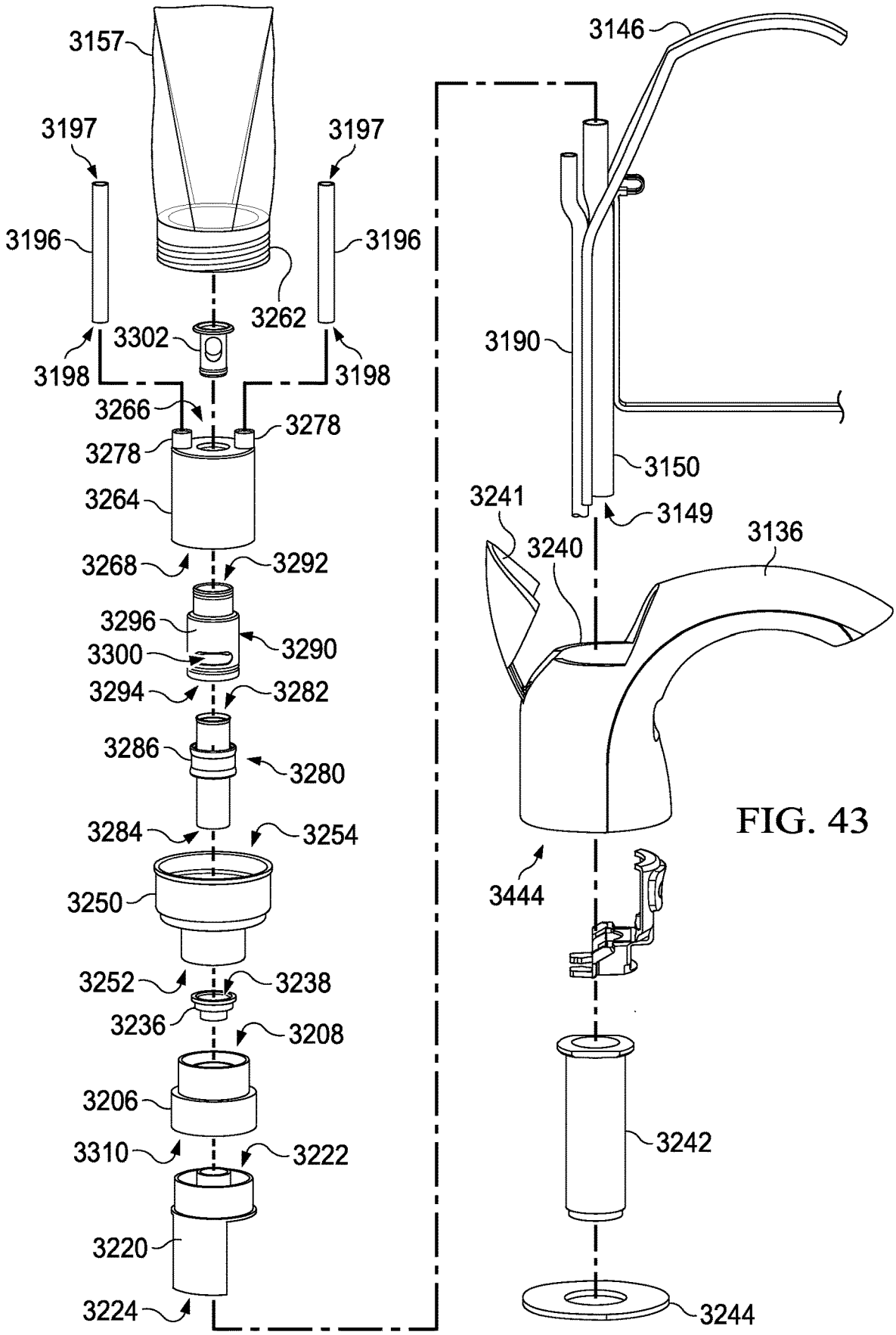
FIG. 43 is an exploded view depicting the fluid dispenser and the refill unit of FIG. 42.

As illustrated in FIGS. 41-43, the fluid refill system 3154 can include a refill unit 3156 having a refill reservoir 3157 and a pair of refill tubes 3196. Each refill tube 3196 can have respective proximal and distal ends 3197, 3198. The proximal end 3197 can extend to an upper end 3199 of the refill reservoir 3157 such that the proximal end 3197 is in fluid communication with the upper end 3199 and thus in fluid communication with airspace S22 within the refill reservoir 3157. A refill distribution conduit 3158 (FIG. 42) is shown to include a proximal end (e.g., defined by the tip member 3302) that is in fluid communication with a lower end 3200 of the refill reservoir 3157 and thus in fluid communication with refill product within the refill reservoir 3157. In one embodiment, as illustrated in FIGS. 41 and 42, the proximal end 3197 of the refill tube 3196 can be more proximate to the upper end 3199 of the refill reservoir 3157 than to the lower end 3200 of the refill reservoir 3157. The proximal end 3159 of the refill distribution conduit 3158 can be more proximate to the lower end 3200 of the refill reservoir 3157 than to the upper end 3199 of the refill reservoir 3157. As illustrated in FIGS. 41-43, the dispensation end 3252 can be disposed at the lower end 3200 of the refill reservoir 3157 and can facilitate the flow of air and refill fluid therefrom.

Figure 44:
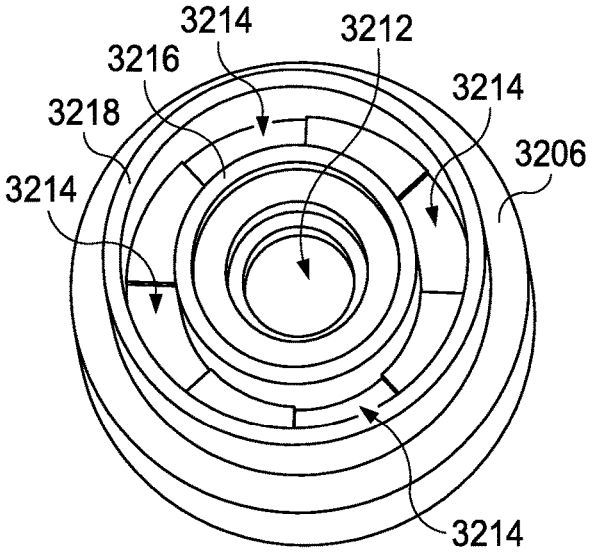
FIG. 44 is an upper perspective view depicting an adapter collar of the fluid dispenser of FIG. 43.

Referring now to FIGS. 42-44, the fluid dispenser 3122 can include an adapter collar 3206 that includes an upper end 3208 and a lower end 3210. The adapter collar 3206 can define a central bore 3212 and a plurality of circumferential apertures 3214 disposed circumferentially about the central bore 3212. The plurality of circumferential apertures 3214 can be disposed between an inner shoulder 3216 and an outer wall 3218.

Figure 45:
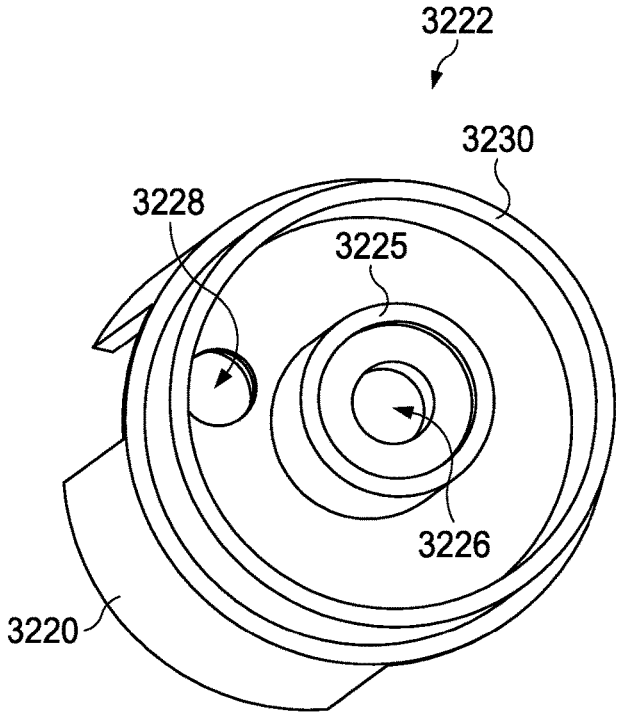
FIG. 45 is an upper perspective view depicting an adapter base of the fluid dispenser of FIG. 41.
Figure 46:
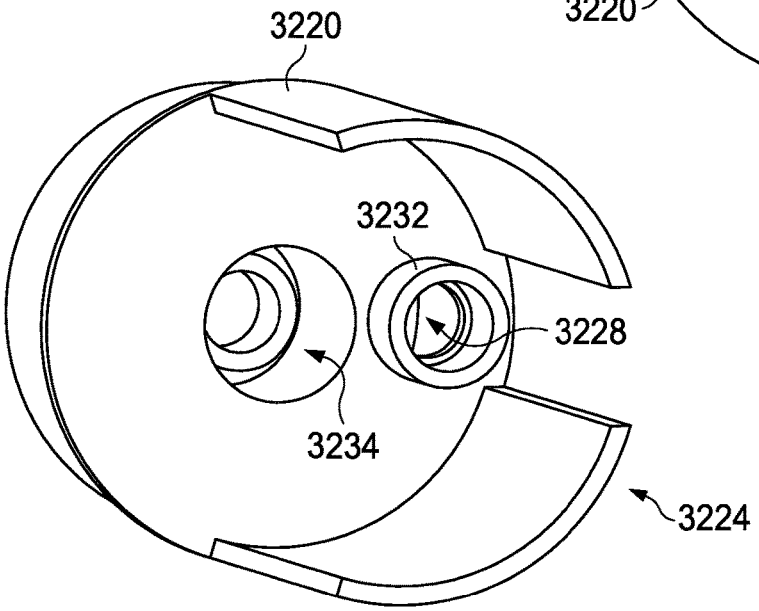
FIG. 46 is a lower perspective view depicting the adapter base of FIG. 45.

Referring now to FIGS. 43 and 45-46, the fluid dispenser 3122 can include an adapter base 3220 having an upper end 3222 (FIG. 45) and a lower end 3224 (FIG. 46). As illustrated in FIG. 45, the adapter base 3220 can include a central shoulder 3225 that defines a central bore 3226. The adapter base 3220 can also define a circumferential bore 3228 that is disposed between the central shoulder 3225 and an outer wall 3230. Each of the central bore 3226 and the circumferential bore 3228 can extend through the adapter base 3220 (e.g., between the upper and lower ends 3222, 3224). As illustrated in FIG. 46, the adapter base 3220 can include a collar 3232 through which the circumferential bore 3228 can extend. The central shoulder 3225 can define a central recess 3234 at the lower end 3224.

Referring again to FIGS. 42 and 43, the fluid dispenser 3122 can include a sealing member 3236 that can be disposed at the upper end 3208 of the adapter collar 3206. The sealing member 3236 can be engaged with the circumferential shoulder 3216 (FIG. 44) and can define a central bore 3238 (FIG. 42). In one embodiment, the sealing member 3236 can be formed of an elastomeric material, such as rubber, for example.

Figure 47:
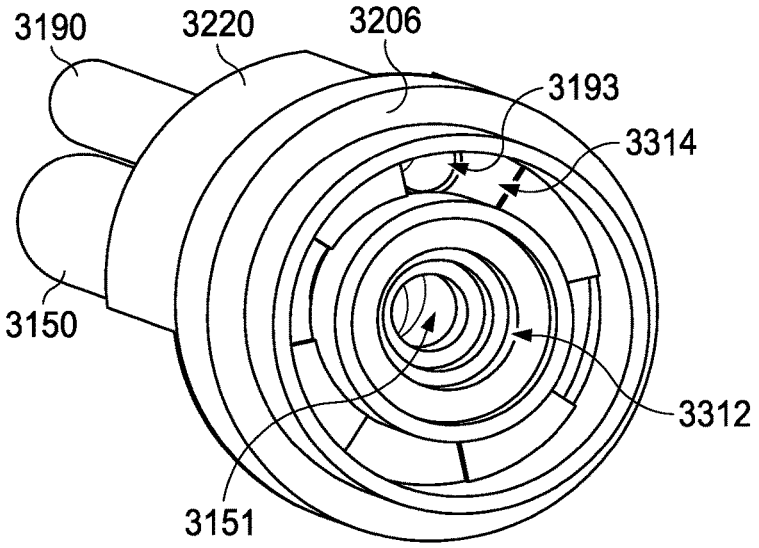
FIG. 47 is an upper perspective view depicting the adapter collar of FIG. 45 in combination with the adapter base of FIGS. 45 and 46 in association with a refill conduit and a storage vent conduit.
Figure 48:
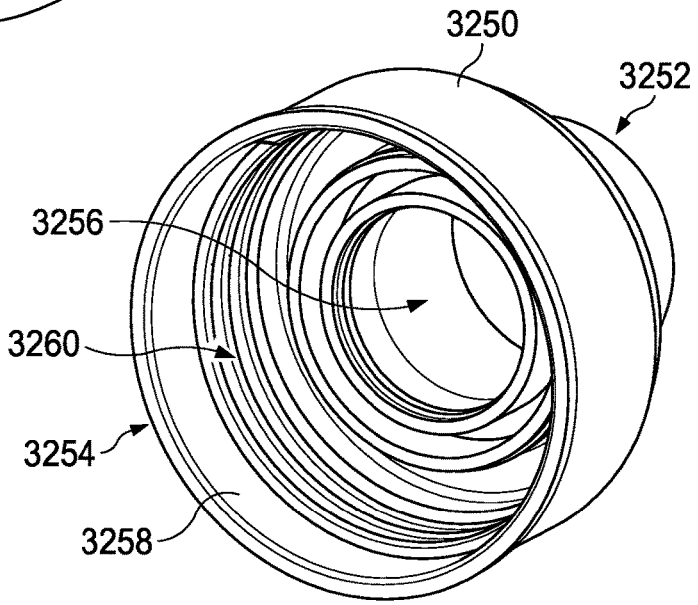
FIG. 48 is an upper perspective view depicting a filler cap of the refill unit of FIG. 41.

As illustrated in FIGS. 42, 43, and 47, the adapter collar 3206 and the adapter base 3220 can be coupled together such that the adapter collar 3206 overlies the adapter base 3220. The adapter collar 3206 and the adapter base 3220 can be arranged in such a manner that the circumferential bore 3228 (FIGS. 45 and 46) of the adapter base 3220 and one of the circumferential apertures 3214 of the adapter base 3220 are substantially aligned. A distal end 3151 of the refill conduit 3150 can be inserted into the central recess 3234 (FIG. 46) of the adapter base 3220 such that the refill conduit 3150 is in fluid communication with the central bores 3212, 3238 of the adapter collar 3206 and the sealing member 3236, respectively. A distal end 3193 of the storage vent conduit 3190 can be inserted into the collar 3232 (FIG. 46) of the adapter base 3220 such that the storage vent conduit 3190 is in fluid communication with the circumferential bore 3228 of the adapter base 3220 and one of the circumferential apertures 3214 of the adapter base 3220. The refill conduit 3150 and the storage vent conduit 3190 can accordingly be circumferentially spaced from each other.

Referring again to FIGS. 41-43, the housing 3136 of the fluid dispenser 3122 can define an upper opening 3240 along at a rear end 3140. The adapter collar 3206 and the adapter base 3220 can be disposed within the housing 3136 such that the refill conduit 3150 and the refill tubes 3196 extend into the upper opening 3240 and are accessible through the upper opening 3240. A lid 3241 can be pivotally coupled with the housing 3136 and can selectively overlie the upper opening 3240 to substantially conceal the refill conduit 3150 and the storage vent conduit 3190 within the housing 3136. The refill conduit 3150 and the storage vent conduit 3190 can extend from a bottom portion 3144 of the housing 3136. The refill conduit 3150 and the storage vent conduit 3190 can be routed through a sleeve 3242 that extends from the bottom portion 3144 of the housing 3136. When the fluid dispenser 3122 is installed on a countertop, the sleeve 3242 can extend entirely through the countertop to provide an effective path for routing the refill conduit 3150 and the storage vent conduit 3190 through the countertop and to the storage reservoir (not shown). A grommet 3244 can be sandwiched between the fluid dispenser 3122 and the countertop.

Referring now to FIGS. 41-43 and 48-52, the refill unit 3156 will now be described. As illustrated in FIGS. 41-43 and 48, the refill unit 3156 can include a filler cap 3250 having a dispensation end 3252 and a receptacle 3254. The filler cap 3250 can define a central bore 3256. The receptacle 3254 can include a wall 3258 that has an inner threaded surface 3260. As illustrated in FIGS. 41-43, the refill reservoir 3157 can have a threaded collar 3262 disposed at the lower end 3200 of the refill reservoir 3157. The threaded collar 3262 can be threadably coupled with the receptacle 3254 to selectively attach the refill reservoir 3157 with the filler cap 3250.

Figure 49:
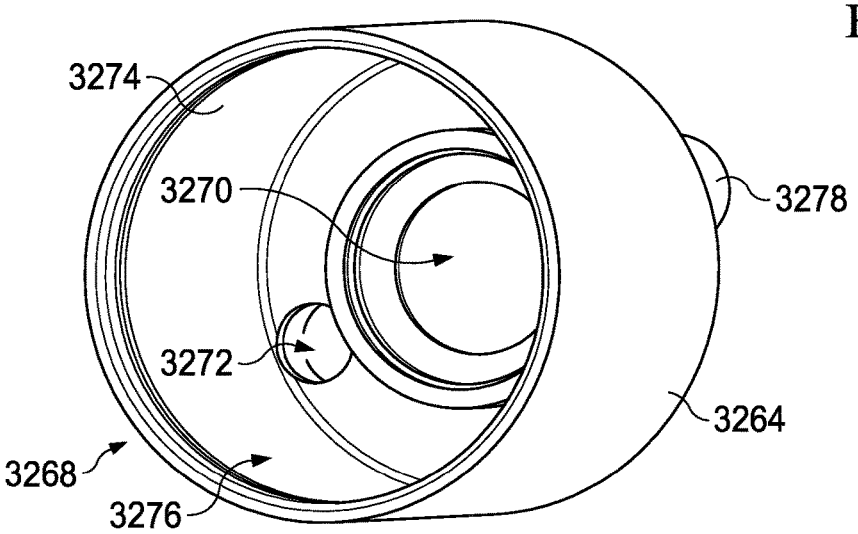
FIG. 49 is a lower perspective view depicting an air cap of the refill unit of FIG. 41.
Figure 50:
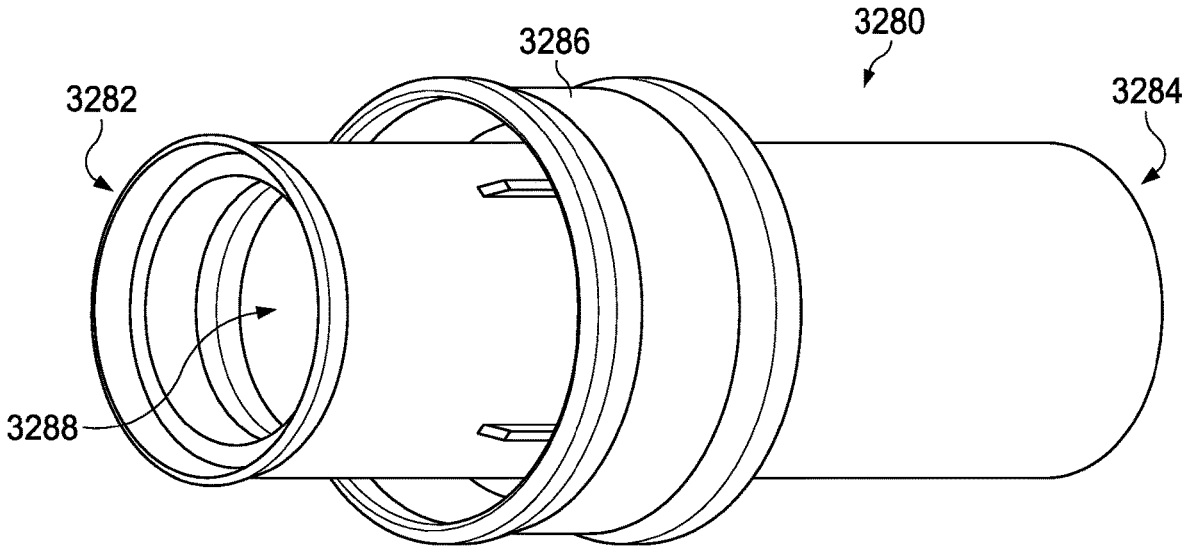
FIG. 50 is a perspective view depicting the plunger of the refill unit of FIG. 41.
Figure 51:
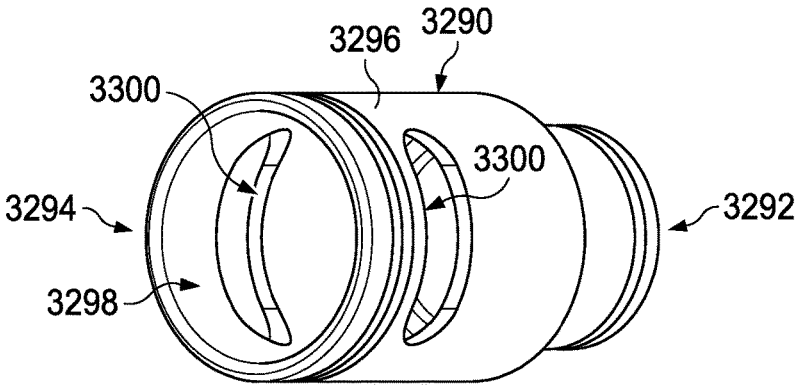
FIG. 51 is a perspective view depicting a seal body of the refill unit of FIG. 41.

Referring now to FIGS. 41-43 and 49, the refill unit 3156 can include an air cap 3264 having an upper end 3266 and a lower end 3268. As illustrated in FIG. 49, the air cap 3264 can define a central bore 3270 and a pair of circumferential bores (e.g., 3272) circumferentially spaced from the central bore. The air cap 3264 can include a wall 3274 that defines a receptacle 3276. The central bore 3270 and the pair of circumferential bores (e.g., 3272) can extend into the receptacle 3276. As illustrated in FIG. 34, the air cap 3264 can include a pair of collars 3278 through which the respective circumferential bores (e.g., 3272) can extend.

Referring now to FIGS. 41-43 and 50, the refill distribution conduit 3158 can include a plunger 3280 having an upper end 3282, a lower end 3284, and a collar 3286. The collar 3286 can be disposed between the upper end 3282 and the lower end 3284 and can have a larger overall diameter than the rest of the plunger 3280. The plunger 3280 can define a passageway 3288 that extends between the upper end 3282 and the lower end 3284.

Referring now to FIGS. 41-43 and 51, the refill distribution conduit 3158 can include a seal body 3290 having an upper end 3292, a lower end 3294, and a wall 3296 disposed at the lower end 3294. The seal body 3290 can define a passageway 3298 that extends between the upper end 3292 and the lower end 3294. The wall 3296 can define a pair of slotted apertures 3300 that each extend circumferentially about the wall 3296.

Referring now to FIGS. 41-43 and 52, the refill distribution conduit 3158 can include a tip member 3302 having a tip 3304, a head 3306, and a wall 3308. The wall 3308 can define a pair of slotted apertures 3310 and a passageway 3312 that extends to, and is in fluid communication with the slotted apertures 3310.

Referring again to FIG. 42, the plunger 3280 can be inserted into the seal body 3290 with the wall 3296 of the seal body 3290 surrounding the collar 3286 of the plunger 3280, such that the collar 3286 is disposed within the passageway 3288 of the seal body 3290. The upper end 3282 of the plunger 3280 can extend to the upper end 3292 of the seal body 3290. Each of the plunger 3280 and the seal body 3290 can be disposed within the receptacle 3276 of the air cap 3264 and sandwiched between the air cap 3264 and the filler cap 3250. The filler cap 3250 and the air cap 3264 can be secured together through any of a variety of securing methods, such as plastic welding. With the filler cap 3250 and the air cap 3264 secured together, the tip member 3302 can extend through the central bore 3270 of the air cap 3264 and the tip 3304 of the tip member 3302 can be secured to the upper end 3282 of the plunger 3280, such as through threaded engagement, for example. The passageway 3312 of the tip member 3302 and the passageway 3288 of the plunger can accordingly be in fluid communication with each other. The distal ends 3198 of the refill tubes 3196 can be coupled with the respective collars 3278 of the air cap 3264 such that the refill tubes 3196 are in fluid communication with the receptacle 3276 of the air cap 3264.

The plunger 3280 and the seal body 3290 can cooperate to at least partially define the refill distribution conduit 3158. The air cap 3264 can cooperate with the filler cap 3150 and the refill tubes 3196 to at least partially define a refill vent conduit. The portion of the refill vent conduit defined by the air cap 3264 and the filler cap 3150 can be coaxial with the refill distribution conduit 3158, such that vent air from the filler cap 3150 is routed around the refill distribution conduit 3158.

Figure 52:
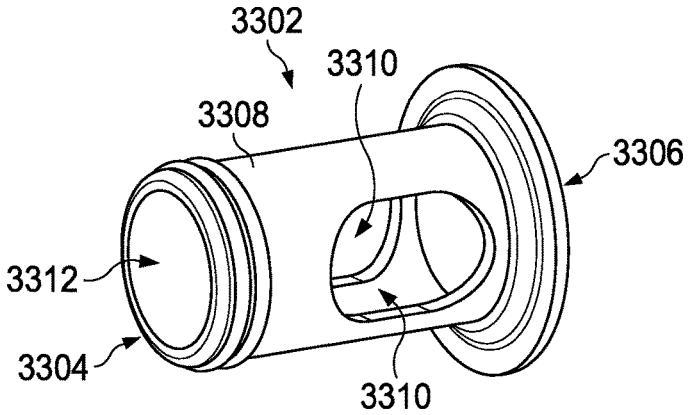
FIG. 52 is a perspective view depicting the tip member of the refill unit of FIG. 41.
Figure 53:
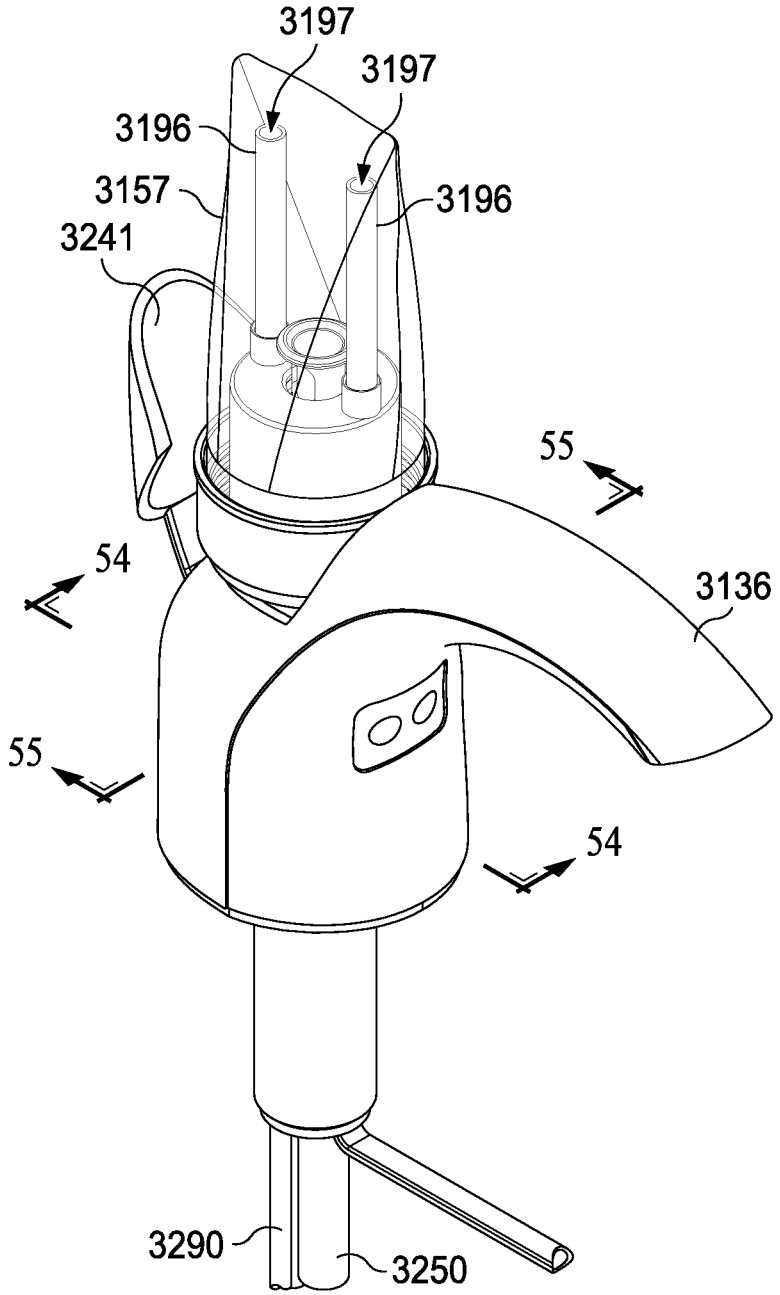
FIG. 53 is a front perspective view depicting the fluid dispenser and the refill unit of FIG. 41 but with the refill unit installed on the fluid dispenser.
Figure 54:
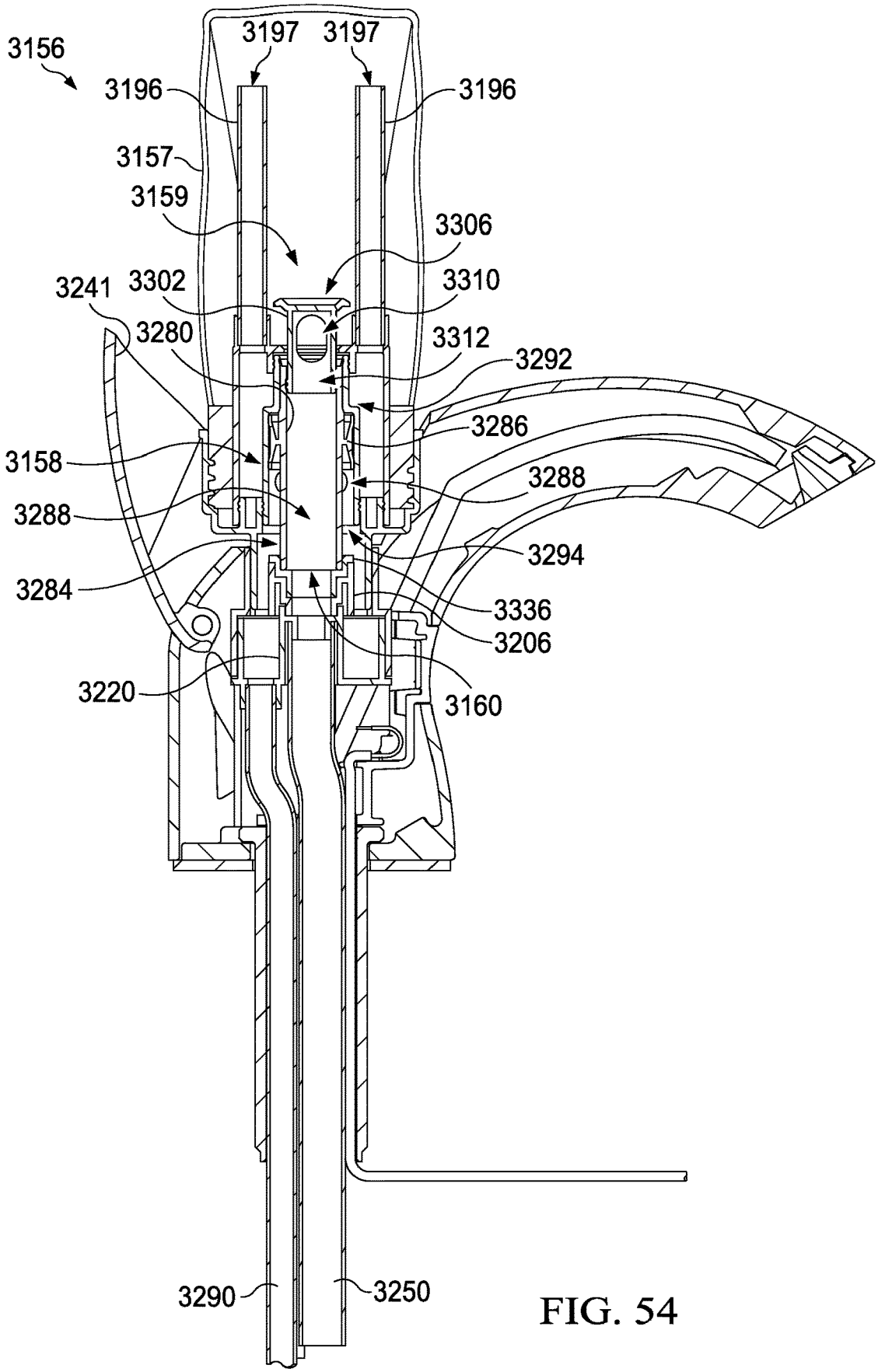
FIG. 54 is a sectional view taken along the section line 54-54 in FIG. 53, wherein the plunger and the tip member of the refill unit are shown to be in a depressed position.

Referring now to FIGS. 42-43 and 54-55, the plunger 3280 and the tip member 3302 can be slidable with respect to the seal body 3290 between a released position (FIG. 52) and a depressed position (FIGS. 54 and 55). Movement of the plunger 3280 between the released and depressed positions can facilitate selective fluid communication between the slotted apertures 3310 of the tip member 3302 and the passageway 3288 of the plunger 3280. As illustrated in FIG. 52, when the plunger 3280 and the tip member 3302 are in the released position, the collar 3286 can be more proximate to the lower end 3294 of the seal body 3290 than the upper end 3292. In such a position, the collar 3286 can block the slotted apertures 3300 (FIG. 43) of the seal body 3290 such that the receptacle 3276 (FIG. 49) of the air cap 3264 and the passageway 3298 (FIG. 51) of the seal body 3290 are fluidically decoupled from each other. Air within the refill reservoir 3157 is thus prevented from flowing through the refill tubes 3196 and into the passageway 3298 of the seal body 3290. A sealing member, such as a gasket (not shown), can be provided between the collar 3286 and the seal body 3290 to provide an effective seal therebetween. Additionally, when the plunger 3280 and the tip member 3302 are in the released position, the tip member 3302 can be substantially withdrawn into the air cap 3264 with the head 3306 (FIG. 54) of the tip member 3302 seated against the air cap 3264. As such, refill fluid stored within the refill reservoir 3157 can be prevented from flowing from the refill reservoir 3157 and through the passageway 3288 (FIG. 54) of the plunger 3280 towards the filler cap 3250. A sealing member, such as an O-ring, can be provided between the air cap 3264 and the head 3306 (FIG. 54) of the tip member 3302 to provide an effective seal therebetween. In one embodiment, the plunger 3280 can be biased into the released position, such as, for example, by a spring (not shown).

As illustrated in FIGS. 54 and 55, when the plunger 3280 and the tip member 3302 are in the depressed position, the collar 3286 can be more proximate to the upper end 3292 of the seal body 3290 than the lower end 3294. In such a position, the collar 3286 can be spaced from the slotted apertures 3300 (FIG. 43) of the seal body 3290 such that the receptacle 3276 (FIG. 49) of the air cap 3264 and the passageway 3298 (FIG. 51) of the seal body 3290 are in fluid communication with each other. Air within the refill reservoir 3157 is thus permitted to flow through the refill tubes 3196 and into the passageway 3298 of the seal body 3290. Additionally, when the plunger 3280 and the tip member 3302 are in the released position, the head 3306 of the tip member 3302 can be spaced from the air cap 3264. Refill fluid stored within the refill reservoir 3157 can thus be permitted to flow from the refill reservoir 3157, through the passageway 3288 of the plunger 3280 towards the filler cap 3250.

Referring now to FIGS. 41, 42, and 53-55, the refill unit 3156 can be selectively installed at the upper opening 3240 of the housing 3136 to facilitate refilling of the storage reservoir (not shown) with refill fluid from the refill reservoir 3157. Prior to installing the refill unit 3156 onto the fluid dispenser 3122, as illustrated in FIGS. 41 and 42, the plunger 3280 and the tip member 3302 can be in the released position. As such, the refill fluid and air within the refill reservoir 3157 is substantially prevented from flowing through the refill distribution conduit 3158 and the refill tube 3196, respectively such that the refill fluid and air are selectively contained within the refill reservoir 3157.

To install the refill unit 3156 onto the fluid dispenser 3122, the filler cap 3150 can be inserted into the adapter collar 3206. As the refill unit 3156 is being installed on the fluid dispenser 3122, the lower end 3284 of the plunger 3280 can interface with the sealing member 3236. As the refill unit 3156 is moved into the installed position, as illustrated in FIGS. 54 and 55, the plunger 3280 and the tip member 3302 can be urged into the depressed position to allow refill fluid to refill the storage reservoir (not shown) while permitting air to be exchanged between the refill reservoir 3157 and the storage reservoir (not shown).

With the refill unit 3156 installed on the fluid dispenser 3122, as illustrated in FIGS. 54 and 55, the plunger 3280 and the tip member 3302 can be urged into the depressed position such that the refill distribution conduit 3158 of the refill unit 3156 can be in fluid communication with the refill conduit 3150 of the fluid dispenser 3122, and the reservoir and the refill tubes 3196 of the refill unit 3156 can be in fluid communication with the refill conduit 3150 of the fluid dispenser 3122. As illustrated in FIG. 55, refill fluid from the refill reservoir 3157 can accordingly flow, as shown with arrows F1, through the slotted apertures 3310 of the tip member 3302, through the refill distribution conduit 3158, through the central bore 3238 of the sealing member 3236 (FIG. 42), through the central bore 3226 of the adapter base 3220 (FIGS. 45 and 46), through the central bore 3212 of the adapter collar 3206 (FIG. 44), through the refill conduit 3150 and to the storage reservoir (not shown). As the storage reservoir fills with refill fluid, air from the storage reservoir (not shown), can flow into the storage vent conduit 3190 (FIG. 42), through the circumferential bore 3228 of the adapter base 3220 (FIGS. 45 and 46), through one of the circumferential apertures 3214 of the adapter collar 3206 (FIG. 44), between the lower end 3284 of the plunger 3280 and the lower end 3294 of the seal body 3290, as shown by arrows F2, through the slotted apertures 3300 (FIG. 43) of the seal body 3290, through the circumferential bores (e.g., 3272) of the air cap 3264 (FIG. 49), through the refill tubes 3196, and into the refill reservoir 3157.

It will be appreciated that the orientation of upper and lower ends of a reservoir (or other container), as described herein, such as the upper and lower ends 1199, 1200 of the refill unit 1156, should be determined with the reservoir installed and oriented for purposes of using the reservoir as described herein.

The foregoing description of embodiments and examples has been presented for purposes of illustration and description. It is not intended to be exhaustive or limiting to the forms described. Numerous modifications are possible in light of the above teachings. Some of those modifications have been discussed and others will be understood by those skilled in the art. The embodiments were chosen and described for illustration of various embodiments. The scope is, of course, not limited to the examples or embodiments set forth herein, but can be employed in any number of applications and equivalent devices by those of ordinary skill in the art. Rather it is hereby intended the scope be defined by the claims appended hereto. Also, for any methods claimed and/or described, regardless of whether the method is described in conjunction with a flow diagram, it should be understood that unless otherwise specified or required by context, any explicit or implicit ordering of steps performed in the execution of a method does not imply that those steps must be performed in the order presented and may be performed in a different order or in parallel.

What is claimed is:

1. A counter-mount fluid dispenser comprising:

a housing configured to be mounted above a countertop;

an outlet nozzle located near a first end of the housing;

a dispensation conduit routed through at least a portion of the housing to the outlet nozzle wherein a first end of the dispensation conduit is located proximate the outlet nozzle and a second end of the dispensation conduit is in fluid communication with a pump;

a reservoir;

a movable access member;

wherein the movable access member forms a part of the housing, the movable access member is movable between a non-accessing position and an accessing position;

wherein the dispensation conduit remains in place when the movable access member is moved between the non-accessing position and the accessing position and when the reservoir is refilled;

wherein the dispensation conduit is supplied fluid from the reservoir;

wherein the pump is in fluid communication with the reservoir;

a refill port;

wherein the refill port is at least partially concealed when the movable access member is in the non-accessing position and the refill port is accessible when the moveable access member is in the accessing position;

the refill port is configured to mate with a refill connector of a refill container;

wherein when the refill connector is inserted into the refill port, a sealing member forms a seal that prevents fluid from leaking out of the refill port.

2. The counter-mount fluid dispenser of claim 1 further comprising a valve that is biased closed by and opens when the refill connector is inserted into the refill port to allow fluid to flow into the reservoir.

3. The counter-mount fluid dispenser of claim 1 wherein the moveable access member moves outward from the housing to be in a accessing position.

4. The counter-mount fluid dispenser of claim 3 wherein the moveable access member is located proximate the outlet nozzle.

5. The counter-mount fluid dispenser of claim 4, wherein the dispensation conduit and outlet nozzle are secured to the moveable access member and move along with the moveable access member.

6. The counter-mount fluid dispenser of claim 1 wherein the moveable access member rotates from the non-accessing position to be in a accessing position.

7. The counter-mount fluid dispenser of claim 1 wherein the moveable access member is located on a top of the housing.

8. The counter-mount fluid dispenser of claim 7 wherein the moveable access member slides.

9. The counter-mount fluid dispenser of claim 7 wherein the moveable access member rotates.

10. The counter-mount fluid dispenser of claim 7 wherein the moveable access member pivots about an axis.

11. The counter-mount fluid dispenser of claim 3 wherein the moveable access member slides out of the housing to be in the accessing position and into the housing to be in the non-accessing position.

12. The counter-mount fluid dispenser of claim 3 wherein the housing is in the shape of a spout and the movable access member is located on the end of the spout.

13. The counter-mount fluid dispenser of claim 1 wherein the refill port comprises a lock or latch, wherein the lock or latch retains the refill connector while the reservoir is being refilled.

14. The counter-mount fluid dispenser of claim 1 further comprising a keyed connection on the refill port to prevent unauthorized connection to the refill port.

15. A counter-mount fluid dispenser comprising:

a housing configured to be mounted above a countertop;

a reservoir;

an outlet nozzle located near a first end of the housing;

a dispensation conduit routed through at least a portion of the housing to the outlet nozzle wherein a first end of the dispensation conduit is located proximate the outlet nozzle and a second end of the dispensation conduit is in fluid communication with a pump;

wherein the housing has an unseated position and a seated position;

wherein the housing is in the seated position during use;

wherein the dispensation conduit remains in place when the housing is moved from the seated position to the unseated position and remains in place when the reservoir is refilled;

a refill port;

wherein the refill port is located inside of the housing;

wherein when the housing is in the unseated position, the refill port is accessible; and wherein when the housing is in the seated position the refill port is non-accessible;

the refill port is configured to mate with a refill connector of a refill container;

wherein when the refill connector is inserted into the refill port, a sealing member forms a seal that prevents fluid from leaking out of the refill port; and wherein the refill port is in fluid communication with the reservoir; and wherein the dispensation conduit is in fluid communications with the reservoir.

16. The counter-mount fluid dispenser of claim 15 further comprising a vent for venting the reservoir.

17. The counter-mount fluid dispenser of claim 15 further comprising a keyed connection on the refill port to prevent unauthorized connection to the refill port.

18. The counter-mount fluid dispenser of claim 17 wherein the keyed connection is a mechanical connection.

19. A counter-mount fluid dispenser comprising:

a housing configured to be mounted above a countertop;

wherein the housing has an arcuate shaped upper surface and an arcuate shaped lower surface;

an outlet nozzle located near a first end of the housing;

a reservoir;

a dispensation conduit routed through at least a portion of the housing to the outlet nozzle wherein a first end of the dispensation conduit is located proximate the outlet nozzle and a second end of the dispensation conduit is in fluid communication with a pump;

wherein the dispensation conduit remains in place when the reservoir is refilled;

a refill port;

wherein the refill port is located on the arcuate shaped lower surface;

wherein the refill port is not visible from directly above the housing; and wherein the refill port includes a valve;

wherein the valve is biased to a closed position and is opened by a refill connector when a refill connector is connected to the refill port; and wherein the refill port is in fluid communication with the reservoir; and wherein the dispensation conduit is in fluid communication with the reservoir.

20. The counter-mount fluid dispenser of claim 19 further comprising a vent port, wherein the vent port is located on the arcuate shaped lower surface.

* * * * *